US006586149B2

(12) United States Patent
Kawamura et al.

(10) Patent No.: US 6,586,149 B2
(45) Date of Patent: Jul. 1, 2003

(54) LIGHT-RECEIVING MEMBER, IMAGE-FORMING APPARATUS, AND IMAGE-FORMING METHOD

(75) Inventors: Kunimasa Kawamura, Suntoh-gun (JP); Shigenori Ueda, Mishima (JP); Toshiyuki Ehara, Yokohama (JP); Junichiro Hashizume, Numazu (JP); Ryuji Okamura, Mishima (JP); Masaya Kawada, Mishima (JP); Tetsuya Karaki, Sunto-gun (JP); Hironori Ohwaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/808,959

(22) Filed: Mar. 16, 2001

(65) Prior Publication Data

US 2001/0051308 A1 Dec. 13, 2001

(30) Foreign Application Priority Data

Mar. 16, 2000 (JP) ..... 2000-074433
May 22, 2000 (JP) ..... 2000-150140

(51) Int. Cl.[7] ..... G03G 5/14; G03G 5/082; G03G 13/08

(52) U.S. Cl. ..... 430/66; 430/69; 430/111.4; 430/124; 430/132; 399/159

(58) Field of Search ..... 430/66, 67, 56, 430/69, 127, 430, 132, 111.4, 108.8, 124, 126; 399/159

(56) References Cited

U.S. PATENT DOCUMENTS

| | | | | |
|---|---|---|---|---|
| 3,666,363 A | | 5/1972 | Tanaka et al. | |
| 4,071,361 A | | 1/1978 | Marushima | |
| 4,247,196 A | | 1/1981 | Ogawa et al. | |
| 4,469,434 A | | 9/1984 | Yamazaki et al. | |
| 4,770,966 A | * | 9/1988 | Kazama et al. | 430/66 |
| 4,797,336 A | | 1/1989 | Honda et al. | 430/60 |
| 5,242,776 A | * | 9/1993 | Doi et al. | 430/66 |
| 5,733,698 A | | 3/1998 | Lehman et al. | 430/66 |
| 5,976,745 A | | 11/1999 | Aoki et al. | 430/66 |
| 6,001,521 A | * | 12/1999 | Hashizume et al. | 430/58.1 |
| 6,171,742 B1 | | 1/2001 | Kawada et al. | |

FOREIGN PATENT DOCUMENTS

| | | | |
|---|---|---|---|
| EP | 0154160 | | 9/1985 |
| EP | 0926560 | | 6/1999 |
| EP | 0953883 | A1 * | 11/1999 |
| EP | 0957404 | A1 * | 11/1999 |
| EP | 0971271 | A1 * | 1/2000 |
| JP | 54-143149 | | 11/1979 |
| JP | 57-115551 | | 7/1982 |
| JP | 57-124777 | | 8/1982 |
| JP | 61-219961 | | 9/1986 |
| JP | 6-317920 | | 11/1994 |
| JP | 8-129266 | | 5/1996 |
| JP | 9-297420 | | 11/1997 |

OTHER PUBLICATIONS

Japanese Patent Office Machined–Assisted Translation of JP08–129266 (Pub May 21, 1996).*

* cited by examiner

*Primary Examiner*—Janis L. Dote
(74) *Attorney, Agent, or Firm*—Fitzpatrick, Cella, Harper & Scinto

(57) ABSTRACT

A light-receiving member comprising a conductive substrate, and formed superposingly thereon a photosensitive layer and a surface protective layer in order. The light-receiving member has a surface roughness Ra of from 15 nm to 100 nm. Also disclosed is an image-forming apparatus having such a light-receiving member, and an image-forming method of rendering visible an electrostatic pattern formed on the light-receiving member. The light-receiving member promises stable formation of images over a long period of time.

31 Claims, 13 Drawing Sheets

LIGHT-RECEIVING MEMBER, IMAGE-FORMING APPARATUS, AND IMAGE-FORMING METHOD

BACKGROUND OF THE INVENTION

1. Field of the Invention

This invention relates to a light-receiving member, an image-forming apparatus and an image-forming method. More particularly, it relates to a light-receiving member having a photosensitive layer used to form an electrostatic latent image thereon, an image-forming apparatus having the light-receiving member, and an image-forming method making use of the light-receiving member.

2. Related Background Art (1) Image-Forming Apparatus

A number of methods as disclosed in U.S. Pat. Nos. 2,297,692, 3,666,363 and 4,071,361 are conventionally known as electrophotography. In general, copies are obtained by forming an electrostatic latent image on an light-receiving member (e.g., an electrostatic latent image bearing member) by utilizing a photoconductive material and by various means, subsequently developing the latent image by the use of a toner to form a toner image, transferring the toner image as a developed image to a transfer medium such as paper as occasion calls, and then fixing the toner image by the action of heat, pressure, or heat and pressure, or solvent vapor. In the course of the foregoing, untransferred toner remains on the light-receiving member even after the toner image has been transferred to the transfer medium, and hence such untransferred toner has ever been collected through a cleaning step and put away outside the system as waste toner.

With an increase in the throughput of information in recent years, there is a more increasing demand for image-forming apparatus such as copying machines and laser beam printers having a large copying volume (i.e., large-sized high-speed machines).

As light-receiving members, light-receiving member performances adapted to high-speed are required to be improved. At the same time, in these days where more minute image quality is demanded, toners have been directed toward smaller particle diameters, not to speak of improvements in light-receiving member performances, and those having a weight-average particle diameter of from 5 to 11 $\mu$m as measured by COULTER Counter or the like are in wide use.

Meanwhile, in order to improve cleaning performance, contrived are a blade with grooves as disclosed in Japanese Patent Application Laid-open No. 54-143149 and a blade with projections as disclosed in Japanese Patent Application Laid-open No. 57-124777. These publications, however, do not refer to any cleaning system suited for image-forming apparatus having a process speed of 400 mm/sec or higher and comprising a fine-particle toner improved in fixing performance and an a-Si (amorphous silicon) light-receiving member.

FIG. 1 is a schematic view for describing an example of an image-forming process in a copying machine which is a kind of the image-forming apparatus. Here is given a diagrammatic cross-sectional view of the construction of the image-forming apparatus.

A light-receiving member 101 is rotated in the direction of an arrow X. The light-receiving member 101 is formed in a drum, and is provided with a sheet-like inner-surface heater

123 on the drum inside, by means of which the light-receiving member 101 is temperature-controlled. Around the light-receiving member 101, it is provided with a charging means primary charging assembly 102, an electrostatic latent image forming portion 103, a developing means developing assembly 104, a transfer paper feed system 105, a transfer means transfer charging assembly 106(*a*), a separation charging assembly 106(*b*), a cleaner 125, a transport system 108 and a destaticizing light source 109.

An image-forming process is described below by further giving a specific example. The light-receiving member 101 is uniformly electrostatically charged by means of the primary charging assembly 102, to which a high voltage of from +6 to +8 kV is kept applied. Light emitted from a halogen lamp 110 reflects from an original 112 placed on an original glass plate 111 and travels via mirrors 113, 114 and 115, and an optical image is formed by a lens 118 of a lens unit 117. The optical image is guided via a mirror 116 to the electrostatic latent image forming portion and projected on the light-receiving member 101, thus an electrostatic latent image is formed on the light-receiving member 101. To this latent image, a toner for developing electrostatic latent images is supplied from the developing assembly 104, and the latent image is formed into a developed image made visible (hereinafter also "toner image").

Meanwhile, a transfer material P is fed toward the light-receiving member 101 via the transfer paper feed system 105 while its leading end is timing-controlled by means of a registration roller 122. To the transfer material P, an electric field having a polarity opposite to that of the toner is imparted from the side of the transfer charging assembly 106(*a*) at a gap formed between the transfer charging assembly 106(*a*) to which a high voltage of from +7 to +8 kV is kept applied and the light-receiving member 101. Thus, the toner image held on the surface of the light-receiving member 101 is transferred to the transfer material P. The transfer material P is separated from the light-receiving member 101 by means of the separation charging assembly 106(*b*), to which a high AC voltage is kept applied at a peak-to-peak voltage of from 12 to 14 kVp-p and a frequency of from 300 to 600 Hz, and is made to pass the transport system 108 to come to a fixing assembly 124. The transfer material P is, after the toner image held thereon has been fixed by means of the fixing assembly 124, delivered outside the apparatus.

The toner remaining on the light-receiving member 101 is removed from the surface of the light-receiving member 101 by means of a cleaning roller 107 and a cleaning blade 121 which are provided in the cleaner 125. Any electrostatic latent image remaining on the surface of the light-receiving member 101 is eliminated by means of the destaticizing light source 109

(2) Light-Receiving Member

With regard to techniques for device members used in the light-receiving member, various materials are proposed, such as selenium, cadmium sulfides, zinc oxide, phthalocyanine and amorphous silicon (hereinafter "a-Si"). In particular, non-single-crystal deposited films composed chiefly of silicon atoms as typified by a-Si films, e.g., amorphous silicon deposited films of a-Si compensated with hydrogen and/or a halogen (e.g., fluorine or chlorine) are proposed for light-receiving members having high performance and high durability and causing no environmental pollution, and some of them have put into practical use. As processes for forming such deposited films, a large number of processes are conventionally known, such as sputtering, a process in which material gases are decomposed by heat (heat-assisted CVD), a process in which material gases are decomposed by light (photo-assisted CVD), and a process in which material gases are decomposed by plasma (plasma-assisted CVD). In particular, plasma-assisted CVD, i.e., a process in which material gases are decomposed by glow discharge that utilizes a direct-current or high-frequency (RF or VHF) power or a microwave power to form a thin-film deposited film on an insulating substrate made of glass or quartz or formed of a heat-resistant synthetic resin film, or a substrate having been conductive-treated by providing a metal on the surface of any of these, or a conductive substrate made of stainless steel or aluminum, is preferred in the formation of non-single-crystal silicon films, preferably a-Si deposited films, for light-receiving members.

Proposals are made in variety in order to improve electrophotographic performance of light-receiving members having a photosensitive layer formed of amorphous silicon. For example, Japanese Patent Application Laid-open No. 57-115551 discloses an example of a light-receiving member comprising a photoconductive layer constituted of an amorphous material composed chiefly of silicon atoms and containing at least one of hydrogen atoms and halogen atoms, and provided thereon with a surface barrier layer constituted of a non-photoconductive amorphous material composed chiefly of silicon atoms and carbon atoms and containing hydrogen atoms.

Japanese Patent Application Laid-open No. 61-219961 also discloses an example of a light-receiving member constituted of an a-Si type photosensitive layer and formed thereon as a surface protective layer an a-C:H (amorphous carbon) film containing 10 to 40 atom % of hydrogen atoms.

Japanese Patent Application Laid-open No. 6-317920 discloses a process for producing, using a high-frequency power having a frequency of 20 MHz or higher, a light-receiving member constituted of a photoconductive layer formed of a non-single-crystal silicon material composed chiefly of silicon atoms and an a-C:H surface protective layer containing 8 to 45 atom % of hydrogen atoms.

European Patent Publication No. 154160 also discloses a method, and an apparatus, for forming a light-receiving member device having a top blocking layer formed by microwave plasma-assisted CVD using a microwave power (e.g., frequency: 2.45 GHz) as a material gas decomposition source.

These techniques have brought about improvements in electrical, optical and photoconductive performances as well as service environmental properties and running performance, and also have enabled improvement in image quality level.

However, in recent years, image-forming apparatus are demanded to have much higher performances and much longer service life. Under such circumstances, even image-forming apparatus having ever exhibited sufficient performances have had to be put to studies in some cases, depending on service environment and prerequisite image quality.

For example, as mentioned previously, with an increase in the throughput of information in recent years, there is a more increasing demand for image-forming apparatus such as copying machines and laser beam printers having a large copying volume (i.e., large-sized high-speed machines). In other words, image-forming apparatus are increasingly being made high-speed. In image-forming apparatus having been thus made high-speed, the capability of fixing toner images to transfer materials depends on how the toner images on transfer materials are heated in a fixing assembly. In achievement of high speed, the temperature of the fixing assembly must be made higher as the time for which a transfer material passes the inside of the fixing assembly is shorter. This causes an increase in the power consumption in the fixing assembly which already occupies about 80% of power consumption of the whole image-forming apparatus.

Even under such circumstances, the reduction of power consumption as commercial needs is an important subject. Accordingly, the fixing performance of toners themselves is being improved so that a good fixing performance can be attained even without making the fixing assembly have so much a high temperature. Also, not only in high-speed light-receiving member but also in medium-speed to low-speed light-receiving member, efforts on energy saving and resource saving are continually made from every aspect as a part of countermeasures for ecology. As one of them, it is attempted to achieve power saving of fixing assemblies. In this case, too, well fixable toners having a good fixing performance even at a temperature lower than conventional toners are also on development so that good fixing performance can be attained even when the fixing assembly is operated at a low temperature.

Such well fixable toners contain low-melting materials (such as binder resin and/or wax), and are so designed as to melt and fix well even when fixed at a relatively low temperature. When such well fixable toners are used, sufficient performance is achievable in practical use with regard to image quality and fixing performance. However, their low-melting properties may also act on the surface of the light-receiving member to cause a side effect that the toner melt-adheres to the surface of the light-receiving member.

What is meant by "melt-adhere" is that the toner melts to come to adhere to the surface of the light-receiving member during its service over a long period of time. Depending on the degree of adhesion, marks of melt-adhesion may appear on solid white images or halftone images, resulting in a difficulty in practical use. Where such melt-adhesion has occurred and its marks have appeared on images, a service person must go to a client to perform maintenance service, requiring an expense. Also, since the light-receiving member is detached from the main body of a light-receiving member to perform the maintenance service, there is a possibility that the light-receiving member is struck against something during the maintenance service to become unserviceable. Such a phenomenon of melt-adhesion may occur frequently, depending on any combination of environment in which the image-forming apparatus is used, components contained in the toner, surface properties of the light-receiving member, pressure at which the cleaner is brought into pressure contact, process speed and so forth.

As also mentioned previously, as light-receiving members, light-receiving member performances adapted to high-speed are required to be improved, and also, in these days where more minute image quality is demanded, toners have been directed toward smaller particle diameters, not to speak of improvements in light-receiving member performances, and those having a weight-average particle diameter of from 5 to 8 $\mu$m as measured by COULTER Counter or the like are in wide use. However, having a small particle diameter is also a trend that is disadvantageous for the melt-adhesion. Hence, in order to improve the capability of making the toner adhere to the light-receiving member with difficulty or of scraping off any toner having adhered thereto, a countermeasure must be taken such that the blade is made to have a high hardness or brought into pressure contact at a higher pressure.

However, making the blade have a high hardness brings the blade properties from rubbery condition into glassy condition, and hence the blade tends to abrade the light-receiving member. Once such abrasion has occurred, in the case of a-Si type high-hardness light-receiving members, the surface may be abraded unevenly to cause stripe-like uneven abrasion, which may appear on images when images are formed. Accordingly, it is desirable to use the a-Si type light-receiving member under conditions that may cause no abrasion of the surface.

As another method of preventing the melt-adhesion, in some cases silica or the like is added to the toner itself as an abrasive, is used to modify components or is used in a larger quantity. Incorporation of an abrasive in the toner itself provides a higher capability of rubbing the drum (light-receiving member) surface and hence makes any molten toner adhere thereto with difficulty. This can prevent the melt-adhesion on the one hand, but on the other hand still strengthens the force of rubbing the light-receiving member surface as a side effect. Hence, it is difficult to balance these so as to only prevent the melt-adhesion without the abrasion of the light-receiving member surface.

As stated previously, after images such as copied images have been formed using the image-forming apparatus such as an electrophotographic apparatus, the toner remains partly on the outer periphery of the photosensitive member light-receiving member, and hence such residual toner must be removed. Such residual toner may be removed by a cleaning step making use of, besides the cleaning blade described previously, a fur brush, a magnet brush or the like.

However, the toner having a small average particle diameter, used for the achievement of higher image quality of printed images in recent years, makes it difficult to remove the residual toner completely in the above cleaning step, too. This may cause a problem of toner adhesion that, as a result of repeated copying, the residual toner clings or melt-adheres to the photosensitive member surface to cause faulty images in the form of black spots on white background images.

As a countermeasure for solving the above problem, an approach thereto is also made from the aspect of the light-receiving member. As disclosed in Japanese Patent Application Laid-open No. 9-297420, a method is available in which, in a photosensitive member using amorphous silicon to form a photosensitive layer, the surface of a conductive substrate on which the photosensitive layer is to be formed by film formation is previously roughed by cutting or by means of a rotary ball mill. In this case, the substrate surface is defined by the value of macroscopic surface roughness measured with a surface profile analyzer.

Japanese Patent Application Laid-open No. 8-129266 also defines a value of surface roughness Ra, which, however, defines the shape of a conductive substrate worked, and the substrate surface is defined by the value of macroscopic surface roughness measured with a surface profile analyzer.

In recent years, however, with progress of digitization of electrophotographic apparatus, it is becoming predominant to form latent images using a light source composed chiefly of a single wavelength. As the result, the method proposed above in which the substrate is previously cut may have a problem that an interference pattern ascribable to the substrate surface configuration appears on printed images. Also, it may result in a cost increase to additionally provide the step of roughing the conductive substrate surface previously. Conversely, the working of a substrate in a roughness that may cause no interference pattern may make it impossible to well keep the toner adhesion from occurring.

SUMMARY OF THE INVENTION

The present invention was made taking account of the above various points. Accordingly, an object of the present invention is to provide a light-receiving member, an image-forming apparatus and an image-forming method which enable stable formation of images over a long period of time.

Another object of the present invention is to provide a light-receiving member, an image-forming apparatus and an image-forming method which are widely applicable to high-speed machines and also to medium-or low-speed machines, promising a low power consumption and an overall low burden to environment.

Still another object of the present invention is to provide a light-receiving member, an image-forming apparatus and an image-forming method which enable formation of images in so high an image quality as to be free from, or substantially not problematic on, any faulty images due to melt-adhesion or filming without dependence on environment.

A further object of the present invention is to provide an image-forming apparatus having a superior running performance, which can always form sharp images without causing any wear which is causative of scratches on the light-receiving member or faulty images even when used over a long period of time.

In addition, a still further object of the present invention is to provide a light-receiving member, an image-forming apparatus and an image-forming method which enable formation of good images, preventing the toner adhesion at the time of cleaning.

As stated previously, in order to ensure fixing performance when the image-forming apparatus is driven at a higher speed or the fixing assembly is operated at a lower temperature, low-melting well fixable toners are being on development. However, where such toners are used on conventional a-Si light-receiving members, the problem of melt-adhesion or filming may occur when used over a long period of time. Also, extensive studies are made on cleaning conditions relating closely to the prevention of melt-adhesion or filming. However, any cleaning set under conditions that can perfectly prevent the melt-adhesion may conversely cause the stripe-like abrasion of the light-receiving member surface when used over a long period of time. In such a case, there is a problem that the stripe-like abrasion appears on halftone images surface to directly result in troubles on image quality.

We have made extensive studies on whether or not this problem, caused when a higher speed and a lower power consumption are to be achieved on image-forming apparatus, can be solved by improving surface properties of the light-receiving member. As a countermeasure therefor, a method can be contemplated in which, e.g., the outermost surface of the light-receiving member is made more readily slippery so as to prevent the melt-adhesion or filming and at the same time made harder so as to prevent the scratches and wear. Studies made on any materials most suited for such a purpose have revealed that particularly an amorphous carbon film containing hydrogen (hereinafter "a-C:H film") is most suitable. This a-C:H film, as being also called diamond-like carbon (DLC), has a very high hardness and also a peculiar solid lubricity, and hence this is considered to be a material most suited for use in such a purpose.

Accordingly, the present inventors made extensive studies on the extent to which the melt-adhesion or filming may occur when the light-receiving member making use of the a-C:H in the surface layer is used in combination with the well fixable toners. As the result, expectedly a remarkable effect was seen in the prevention of the melt-adhesion or filming, compared with conventional surface layers making use of a-SiC. It, however, was not the case that the effect was sure. For example, when applied to apparatus having a very high process speed as in the case of very high-speed image-forming apparatus, the melt-adhesion or filming still occurred in some cases. The cause thereof is unclear, and is presumed as follows: With an increase in process speed of an image-forming apparatus, the relative speed of the cleaner portion and light-receiving member increases relatively. In such a case, even though the a-C:H film has a solid lubricity, a frictional force still acts more or less. As a mechanism for the cleaning of the light-receiving member making use of a-Si, cleaning blades are commonly used, where there is a possibility that the cleaning blade stands chattered when the apparatus is driven at a high speed. Where such chattering occurs, the effect of compression between the cleaning blade and the light-receiving member surface becomes higher, so that the toner is strongly pressed against the light-receiving member surface to come to tend to cause the melt-adhesion or filming, as so presumed.

To solve this problem, the present inventors made further studies. As the result, it has been revealed that the rate of occurrence of the melt-adhesion or filming correlates with the surface roughness of the outermost surface of a surface layer such as an a-C:H surface layer.

Nevertheless, it has been discovered that the effect of preventing toner adhesion does not necessarily depend on the macroscopic substrate surface roughness measured with a surface profile analyzer and is rather governed by a microscopic surface roughness peculiar to amorphous silicon films.

With regard to the relationship between the surface roughness and the melt-adhesion or the like, goods results were obtainable when the surface layer is in a surface roughness Ra of 15 nm or more where the reference length is set to be 10 $\mu$m. What is meant by the fact that the surface layer has a surface roughness not smaller than a suitable size is that the part where the surface layer comes into contact with the cleaning blade stands in point contact when viewed microscopically, thus the frictional force is reduced there, as so considered. As the result, the cleaning blade may less chatter to strongly prevent the melt-adhesion from occurring, as so considered. On the other hand, however, the melt-adhesion or filming was seen to tend to conversely occur at a higher rate when the surface roughness Ra was beyond 100 nm. The cause thereof is still a matter of presumption. Where the light-receiving member surface is too uneven, its hills may collide against the cleaning blade conversely, and the toner is compressed there to tend to cause the melt-adhesion or filming. Such a condition has probably been brought about, as so presumed.

The present invention provides a light-receiving member comprising a conductive substrate, and formed superposingly thereon a photosensitive layer and a surface protective layer in order, wherein;

the light-receiving member has a surface roughness Ra of from 15 nm to 100 nm.

The present invention also provides an image-forming method comprising the step of rendering visible an electrostatic pattern formed on a light-receiving member having the above surface roughness Ra, by the use of a toner containing at least a binder resin, a charge control agent and a wax, and having a weight-average particle diameter of from 3 $\mu$m to 11 $\mu$m; the binder resin having a Tg (glass transition temperature) of from 40° C. to 80° C., and the wax having a main peak in the region of molecular weight of from 400 to 10,000 and having at least one endothermic peak in the region of from 60° C. to 150° C. at the time of heating in differential thermal analysis.

The present invention still also provides an image-forming apparatus comprising;

a light-receiving member for holding thereon an electrostatic latent image;

a charging means for applying a voltage to a charging member to charge the light-receiving member;

an electrostatic-latent-image-forming means for forming the electrostatic latent image on the light-receiving member thus charged;

a developing means for forming a developed image on the light-receiving member by causing an electrostatic-latent-image-developing toner carried on a toner-carrying member, to move to the electrostatic latent image formed on the light-receiving member;

a transfer means for electrostatically transferring the developed image formed on the light-receiving member, to a transfer material via, or not via, an intermediate member; and a fixing means for fixing to the transfer material the developed image held thereon;

the light-receiving member being a light-receiving member comprising a conductive substrate, and formed superposingly thereon a photosensitive layer and a surface protective layer in order;

the surface protective layer comprising non-single-crystal carbon containing from 35 atom % to 55 atom % of atoms selected from the group consisting of hydrogen atoms and halogen atoms, and having a surface roughness Ra of from 15 nm to 100 nm; and the photosensitive layer comprising a non-single-crystal material composed chiefly of silicon atoms and containing atoms selected from the group consisting of hydrogen atoms and halogen atoms; and the toner containing at least a binder resin, a charge control agent and a wax, and having a weight-average particle diameter of from 3 $\mu$m to 11 $\mu$m; the binder resin having a Tg (glass transition temperature) of from 40° C. to 80° C., and the wax having a main peak in the region of molecular weight of from 400 to 10,000 and having at least one endothermic peak in the region of from 60° C. to 150° C. at the time of heating in differential thermal analysis.

The present invention further provides an image-forming method comprising;

a charging step of applying a voltage to a charging member to charge a light-receiving member;

an electrostatic-latent-image-forming step of forming an electrostatic latent image on the light-receiving member thus charged;

a developing step of forming a developed image on the light-receiving member by causing an electrostatic-latent-image-developing toner carried on a toner-carrying member, to move to the electrostatic latent image formed on the light-receiving member;

a transfer step of electrostatically transferring the developed image formed on the light-receiving member, to a transfer material via, or not via, an intermediate member; and a fixing step of fixing to the transfer material the developed image held thereon;

the light-receiving member being a light-receiving member comprising a conductive substrate, and formed superposingly thereon a photosensitive layer and a surface protective layer in order;

the surface protective layer comprising non-single-crystal carbon containing from 35 atom % to 55 atom % of atoms selected from the group consisting of hydrogen atoms and halogen atoms, and having a surface roughness Ra of from 15 nm to 100 nm; and the photosensitive layer comprising a non-single-crystal material composed chiefly of silicon atoms and containing atoms selected from the group consisting of hydrogen atoms and halogen atoms; and the toner containing at least a binder resin, a charge control agent and a wax, and having a weight-average particle diameter of from 3 $\mu$m to 11 $\mu$m; the binder resin having a Tg (glass transition temperature) of from 40° C. to 80° C., and the wax having a main peak in the region of molecular weight of from 400 to 10,000 and having at least one endothermic peak in the region of from 60° C. to 150° C. at the time of heating in differential thermal analysis.

DESCRIPTION OF THE PREFERRED EMBODIMENTS

The present invention will be described below in detail.

(1) Light-Receiving Member

First, preferred examples of the construction of the light-receiving member used in the present invention are described with reference to diagrammatic cross-sectional views.

Figure 2:
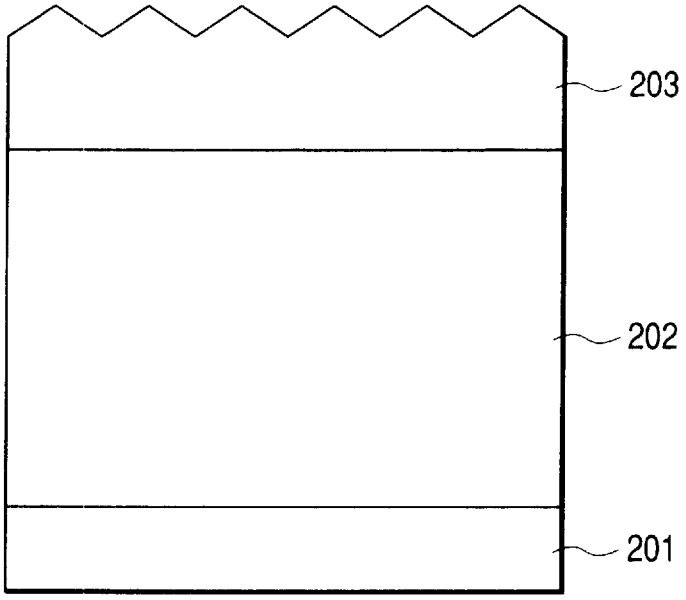
FIGS. 2, 3, 4, 5, 6, 7, 8A, 8B, 8C, 10 and 11 are each a diagrammatic cross-sectional view for describing an example of the layer construction of a light-receiving member.

FIG. 2 is a diagrammatic cross-sectional view showing a preferred example of the light-receiving member used in the present invention. Shown in FIG. 2 is a light-receiving member having a conductive substrate 201 and having on this conductive substrate a photoconductive layer (photosensitive layer) 202 and a surface layer 203 as the outermost layer.

The photoconductive layer 202 may preferably have a-Si containing at least hydrogen and/or a halogen. The surface layer 203 is formed of a non-single-crystal carbon and contains at least hydrogen and/or a halogen. Also, its surface has an unevenness as a surface roughness Ra of from 15 nm to 100 nm in a reference length of 10 $\mu$m.

Figure 3:
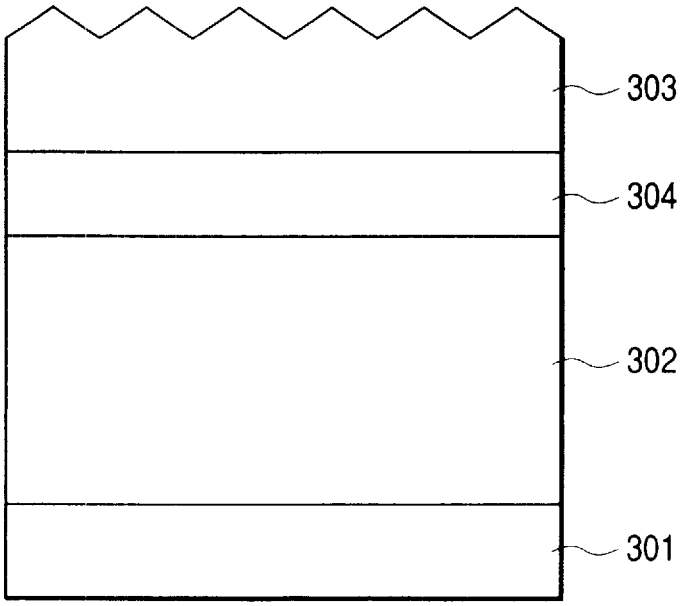

FIG. 3 is a diagrammatic cross-sectional view for describing another preferred example of the light-receiving member, where a buffer layer 304 constituted of a non-single-crystal material such as amorphous silicon carbide, amorphous silicon nitride or amorphous silicon oxide is further provided between a surface layer 303 and a photoconductive layer 302 in the same light-receiving member as that shown in FIG. 2. In FIG. 3, reference numeral 301 denotes a conductive substrate.

Figure 4:
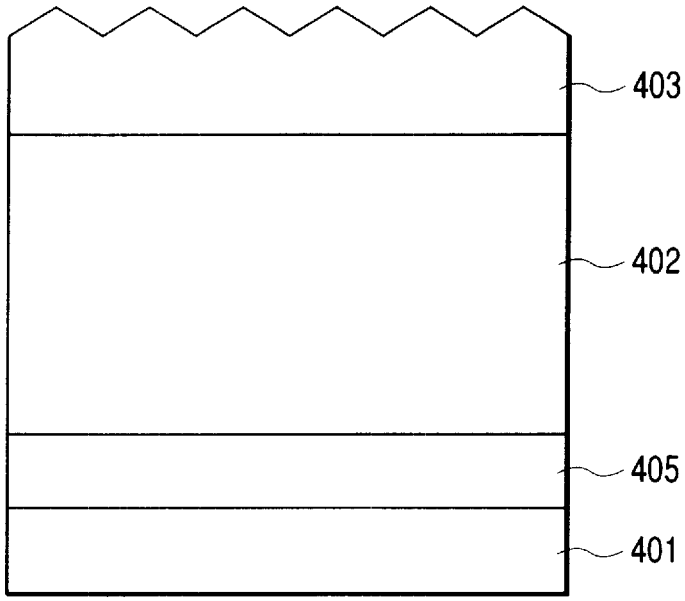

FIG. 4 is a diagrammatic cross-sectional view for describing still another preferred example of the light-receiving member, where a lower-part blocking layer 405 is further provided between a photoconductive layer 402 and a conductive substrate 401 in the light-receiving member shown in FIG. 2. In FIG. 4, reference numeral 403 denotes a surface layer.

Figure 5:
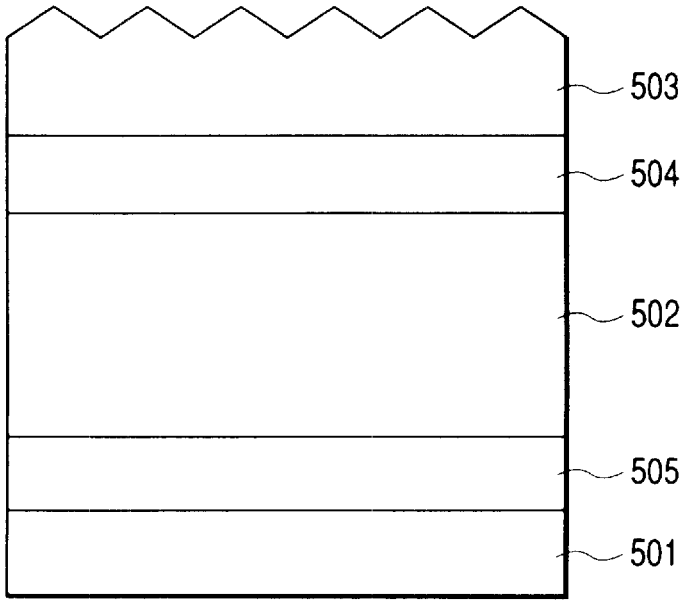

FIG. 5 is a diagrammatic cross-sectional view for describing still another preferred example of the light-receiving member, where a lower-part blocking layer 505 and a buffer layer 504 are further provided in addition to a conductive substrate 501, a photoconductive layer 502 and a surface layer 503 in the light-receiving member shown in FIG. 2.

Figure 6:
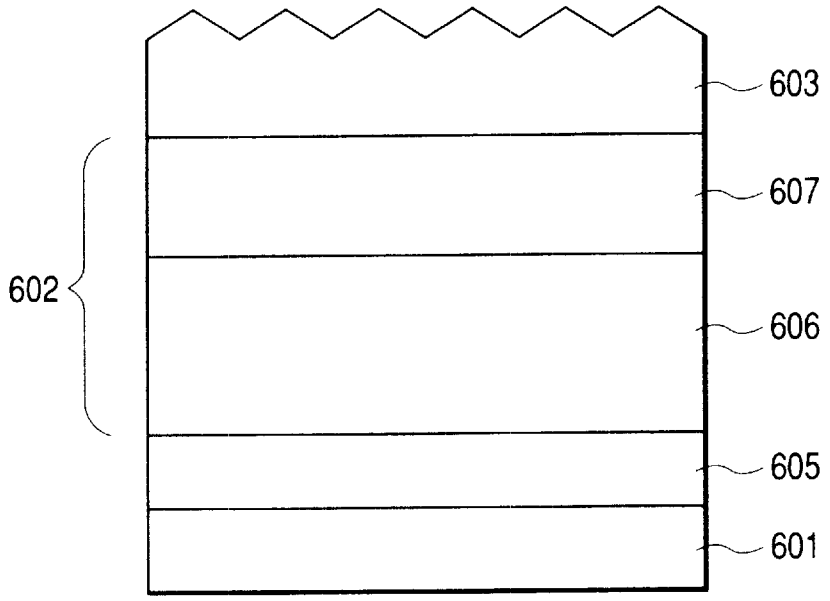

In FIG. 6, shown is a light-receiving member which is called a function-separated type since the photoconductive layer is functionally separated into a charge generation layer and a charge transport layer. Here, a photoconductive layer 602 having a-Si containing at least hydrogen and/or a halogen, functionally separated into two layers of a charge transport layer 606 (preferably having a wide band gap) and a charge generation layer 607 capable of absorbing light efficiently (preferably having a narrow band gap compared with the former), is deposited on a conductive substrate 601. On this layer, a surface layer 603 formed of non-single-crystal carbon is superposed. In the present invention, the order of the charge transport layer 606 and charge generation layer 607 is not limited to the order shown in the present diagrammatic view, and may be any desired order. In the drawing, reference numeral 605 denotes a lower-part blocking layer.

Figure 7:
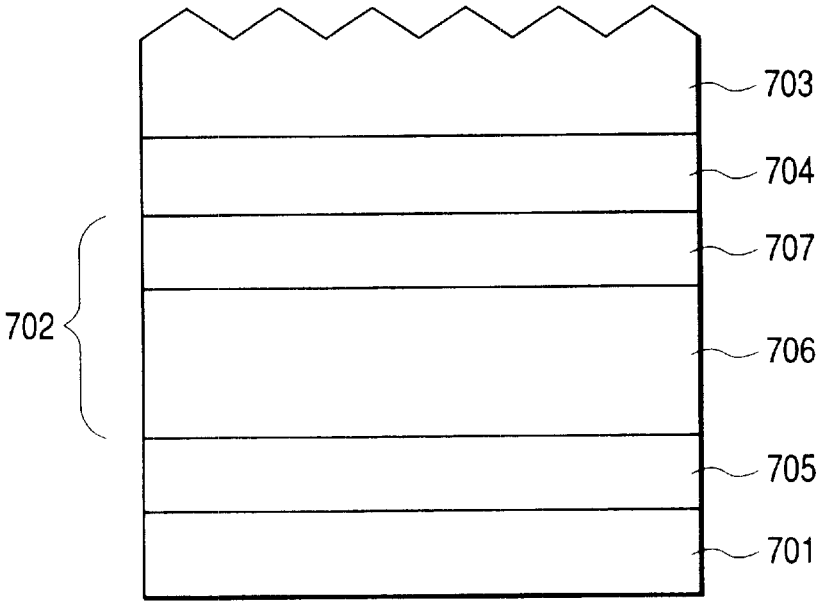

FIG. 7 is a diagrammatic cross-sectional view for describing still another preferred example of the light-receiving member, where a conductive substrate 701, a lower-part blocking layer 705, a charge transport layer 706, a charge generation layer 707, a buffer layer 704 and a surface layer 703 are provided in this order. Photoconductive layer 702 is functionally separated into charge transport layer 706 and charge generation layer 707.

Figure 8A:
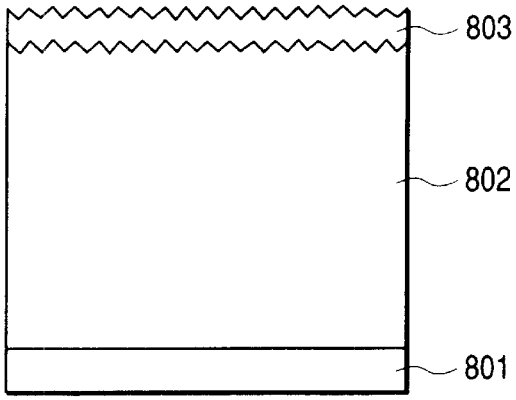
Figure 8B:
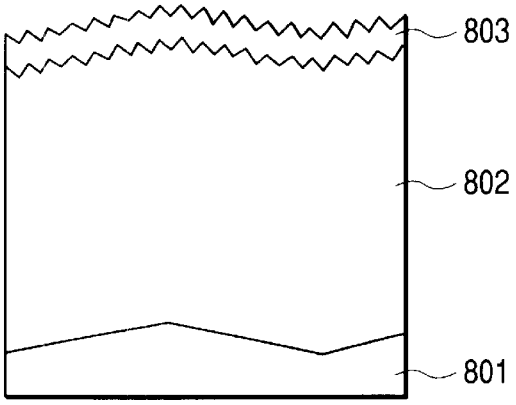
Figure 8C:
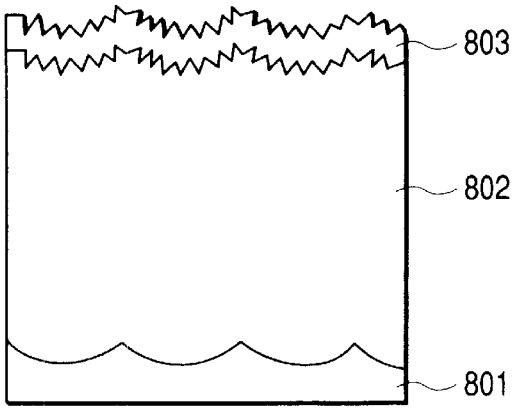

FIGS. 8A to 8C each show the construction where a conductive substrate 801, a photoconductive layer 802 and a surface layer 803 are superposed in this order, like the construction shown in FIG. 2. In those shown in FIGS. 8A to 8C, what greatly differs from the light-receiving member shown in FIG. 2 is that unevenness is also formed on the photoconductive layer 802 on its surface layer side. Here, FIGS. 8B and 8C each show an example in which the substrate surface is grooved or dimpled in order to, e.g., prevent interference fringes.

In the light-receiving members exemplified in FIGS. 2 to 7, the respective layers may involve a continuous compositional change, or need not have any clear interface(s).

(a) Conductive Substrate

The conductive substrate (201, 301, 401, 501, 601, 701 and 801 in FIGS. 2 to 7, 8A to 8C) used in the light-receiving member of the present invention may include substrates comprising an insulating substrate of aluminum, iron, chromium, magnesium, stainless steel, an alloy of any of these, glass, quartz, ceramic, plastic or heat-resistant synthetic resin film the surface of which has been conductive-treated by vacuum deposition or the like of a conductive material at least on the side where the photoconductive layer is formed. It is also preferable to mirror-polish the surfaces of these by means of a lathe. As the shape of the substrate, it may be in the form of a roller or an endless belt.

(b) Surface Layer (Surface Protective Layer)

The surface layer (203, 303, 403, 503, 603, 703 and 803 in FIGS. 2 to 7, 8A to 8C) used in the light-receiving member of the present invention may preferably be formed of non-single-crystal carbon. What is herein meant by "non-single-crystal carbon" chiefly indicates amorphous carbon having a nature intermediate between graphite and diamond, and may also partly contain a microcrystalline or polycrystalline component. This surface layer has a free surface, and is provided chiefly in order to achieve what is aimed in the present invention, i.e., the prevention of melt-adhesion, scratching and wear in long-term service.

Of course, the surface protective layer may be formed of a-SiC(H,X), a-SiN(H,X) or the like. In such a case, too, the interfacial composition of the photoconductive layer and surface protective layer may continuously be changed so that any interfacial reflection at the corresponding part can be kept from occurring.

The surface layer (surface protective layer) of the present invention may be formed by plasma-assisted CVD, sputtering, ion implantation or the like, using as a material gas a hydrocarbon which is gaseous at normal temperature and normal pressure. Films formed by plasma-assisted CVD has both a high transparency and a high hardness, and is preferable for their use as surface layers of light-receiving members. Also, as discharge frequency of the power used in plasma-assisted CVD when the surface layer in the present invention is formed, any frequency may be used. In an industrial scale, preferably usable is high-frequency power of 1 to 50 MHz, which is called an RF frequency band, in particular, 13.56 MHz. Also, especially when high-frequency power of a frequency band of from 50 to 450 MHz is used, which is called VHF, the film formed can have both a higher transparency and a higher hardness, and is more preferable for its use as the surface layer.

Materials that can serve as gases for feeding carbon may include, as those effectively usable, gaseous or gasifiable hydrocarbons such as $CH_4$, $C_2H_6$, $C_3H_8$ and $C_4H_{10}$. In view of readiness to handle and carbon feed efficiency at the time of layer formation, $CH_4$ and $C_2H_6$ are preferred. Also, any of these carbon-feeding material gases may further optionally be diluted with a gas such as $H_2$, He, Ar or Ne when used. Of course, silicon-atom-feeding gas such as $SiH_4$ and oxygen- or nitrogen-atom-feeding gas such as $O_2$, NO or $NH_3$ may appropriately be used, depending on what composition the surface layer to be formed should have.

The surface layer in the present invention has a surface roughness Ra of from 15 nm to 100 nm. It may more preferably have a surface roughness Ra of from 20 nm to 80 nm, and particularly preferably from 25 nm to 60 nm. If it has an Ra smaller than 15 nm, the effect of preventing melt-adhesion or filming can not be sufficient in some cases. Also, if it has an Ra larger than 100 nm, the melt-adhesion or filming tends to conversely occur in a large proportion.

As a method of measuring the surface roughness Ra, it may include the following method.

Ra refers to an arithmetic mean roughness, and is meant to be a value found according to the following expression (I) when a portion of 10 $\mu$m is drawn out of a roughness curve (cross-sectional shape of the longest surface of the light-receiving member), as reference length in the direction of its average line, the X-axis is set in the direction of the average line of this drawn-out portion, the Y-axis is set in the direction of lengthwise magnification, and the roughness curve is represented by y=f(x).

Expression (1)

$$Ra=1/l\int_0^l|f(x)|dx$$

(wherein l represents the reference length.)

The surface roughness Ra in such a microscopic region can readily be measured with an AFM (atomic force microscope) or STM (scanning tunnel microscope).

The surface roughness in the present invention refers to the value of surface roughness Ra measured with an atomic force microscope (AFM) Q-SCOPE 250, manufactured by Quesant Co., and is one determined by expanding the above Ra to the measuring range of 10 $\mu$m×10 $\mu$m to measure the microscopic surface roughness in a high precision and good reproducibility.

To control the surface roughness Ra of the surface protective layer in the range of from 15 nm to 100 nm, fine unevenness may be formed by, e.g., optimizing the conditions for cutting (or etching) the conductive substrate. The roughness may also be controlled by regulating various parameters on the formation of the photoconductive layer. In general, the higher the discharge excitation power is and the higher the bias voltage is, the more greatly the surface tends to be roughed. Also, after deposition is completed up to the photoconductive layer or buffer layer, the roughness may be regulated by roughing the surface by plasma discharging applied using fluorine-containing gas or hydrogen gas to effect etching.

As a result of extensive studies further made, the present inventors have discovered that, in the light-receiving member comprising the conductive substrate and formed superposingly thereon at least the photoconductive layer containing amorphous silicon and the surface protective layer, the surface roughness Ra in the measuring range of 10 $\mu$m×10 $\mu$m may be 15 nm to 100 nm, where the toner can be more kept from adhering.

The present inventors have also discovered that controlling the light-receiving member to have a surface free energy of from 25 mN/m to 49 mN/m is effective for keeping the toner from adhering.

The interfacial composition of the surface protective layer and photosensitive layer (photoconductive layer) of the light-receiving member may also continuously be changed, whereby the toner can more effectively be kept from adhering.

In the present invention, the feature that the interfacial composition of the surface protective layer and photosensitive layer is continuously changed is defined by the following expression.

$$0\leqq(\mathrm{Max}-\mathrm{Min})/(\mathrm{Max}+\mathrm{Min})\leqq 0.4$$

(where Min and Max represent the minimum value and maximum value, respectively, of reflectance (%) of light having a wavelength in the range of from 450 nm to 650 nm).

Here, the reflectance referred to in the present invention indicates the value of reflectance (percentage) measured with a spectrophotometer MCPD-2000, manufactured by Ohtsuka Denshi K. K. Roughly speaking, first, spectral emission intensity I(O) of a light source of a spectroscope is taken, and then spectral reflection intensity I(D) of a photosensitive member is taken, to determine reflectance R I(D)/I(O). In order to measure it in a high precision and a good reproducibility, it is desirable for the detector to be fastened with a jig so that a constant angle can be kept with respect to the photosensitive member, having a curvature.

Figure 9A:
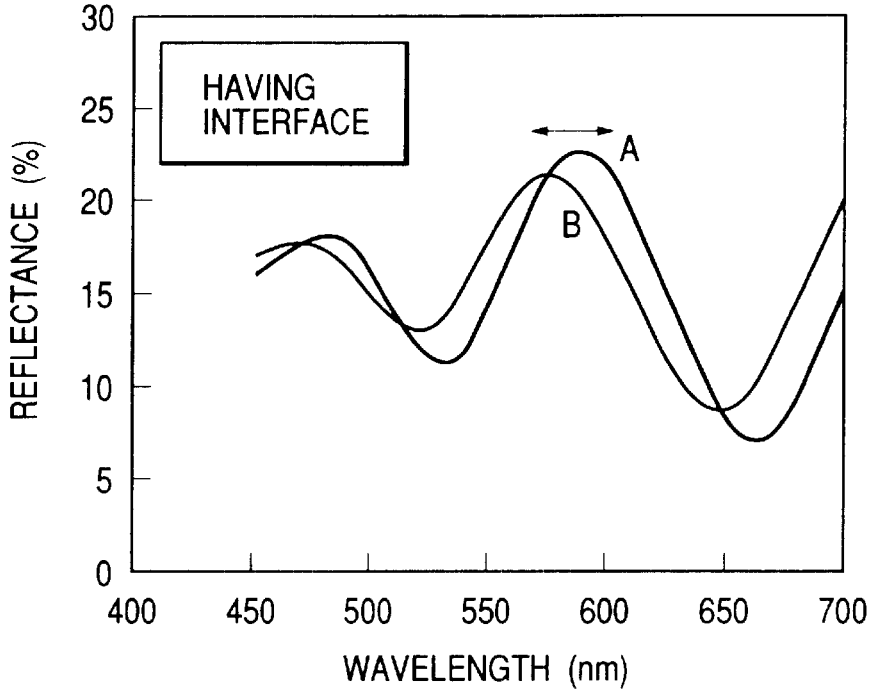
FIGS. 9A and 9B are graphs for describing examples of interfacial reflection control of surface protective layers.
Figure 9B:
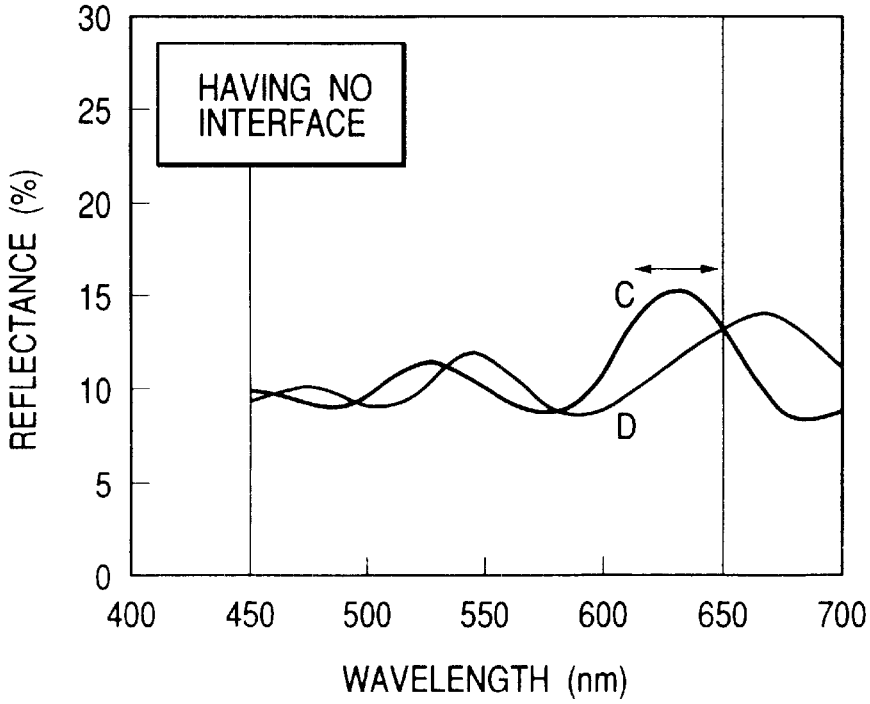

Specific examples of interfacial control are shown in FIGS. 9A and 9B. FIG. 9A shows an example of measurement of "having interface", which is outside the above expression. FIG. 9B shows an example of measurement of "having no interface", which satisfies the above expression. The presence of a double line is due to the difference ascribable to errors in layer thickness of respective surface protective layers, and its waveform shifts from the right to the left on the graph in accordance with the difference in layer thickness. Its maximum value corresponds to the amplitude of the waveform. Hence, in the case of "having interface", compared with "having no interface", the reflectance greatly varies with respect to variations of layer thickness when viewed on a fixed single wavelength. More specifically, the sensitivity varies greatly with respect to variations of layer thickness.

Fine roughness causes substantial unevenness in layer thickness of the surface protective layer on the optical path of incident light of image exposure light. This uneven layer thickness causes a greater variation in sensitivity in the case of "having interface" than in the case of "having no interface", so that any fog serving as the center around which the toner may adhere may occur or the images may have a low sharpness.

Here, in the present invention, it is preferable to take into consideration the value of surface free energy. This value can be calculated upon actual measurement based on the theory described below.

Surface Free Energy

The surface free energy is described below.

The adhesion of residual toner and foreign matter to the photosensitive member surface falls under the category of physical bond and is caused by intermolecular force (van der Waals force).

The surface free energy (y) exists as a phenomenon the intermolecular force causes at the outermost surface.

"Wetting" of substance is roughly grouped into three types. They are "adhesion wetting" where substance 1 adheres to substance 2, "spread wetting" where substance 1 spreads over substance 2, and "immersion wetting" where substance 1 immerses in or soaks into substance 2.

With Regard to the Adhesion Wetting;

the relationship between the substance 1 and the substance 2 stands as shown below, according to Young's equation, in relation to surface free energy (γ) and wettability.

Equation (1)

$$\gamma 1=\gamma 2\cdot\cos\theta 12+\gamma 12$$

γ1: Surface free energy of the surface of substance 1.

γ2: Surface free energy of the surface of substance 2.

γ12: Interfacial free energy of substance 1/substance 2.

θ12: Contact angle of substance 1/substance 2.

In the above equation, thinking about the adhesion of any foreign matter or water to the photosensitive member surface in the image-forming apparatus, the substance 1 may be regarded as the photosensitive member and the substance 2 as the foreign matter.

As is known from Equation (1), in order to make the surface wet with difficulty, i.e., make θ12 large, it is effective to make the work of wetting γ1 of the photosensitive member and the toner large and to make γ2 and γ12 small.

In the cleaning step of electrophotography, the surface free energy γ1 of the photosensitive member may be controlled, whereby the state of adhesion on the right-hand member of Equation (1) can be controlled consequently.

S. Kitazaki and T. Hata report in Japan Adhesion Society No. 8(3), 131–141 (1972) that, in relation to interfacial free energy (synonymous with interfacial tension), the Forkes' theory, which relates to non-polar intermolecular force, can further be extended to a polar or hydrogen-bonding intermolecular force.

According to this extended Forkes' theory, the surface free energy of each substance can be determined in two or three components. The theory of three components is shown below taking the case of adhesion wetting. This theory is established by a hypothetical basis as shown below.

1. Addition rule of surface free energy (γ): Equation (2):

$$\gamma=\gamma d+\gamma p+\gamma h$$

γd: Bipolar component (wetting ascribable to polarity=adhesion).

γp: Dispersion component (non-polar wetting=adhesion).

γh: Hydrogen-bonding component (wetting ascribable to hydrogen bond=adhesion).

Where this is applied in the Forkes' theory, the interfacial free energy γ12 of the two substances is expressed as follows:

$$\gamma 12=\gamma 1+\gamma 12-(\gamma 1d\cdot\gamma 2d)^{1/2}-2\cdot(\gamma 1p\cdot\gamma 2o)^{1/2}-2\cdot(\gamma 1h\cdot\gamma 2h)^{1/2}$$

and also Equation (3):

$$\gamma 12=[(\sqrt{(\gamma 1d)}-\sqrt{(\gamma 2d)}]^2[\leftrightarrows(\gamma 1p)-\sqrt{(\gamma 2p)}]^2+[\sqrt{(\gamma 1h)}-\sqrt{\gamma 2h)}]^2$$

As a method of measuring the surface free energy, reagents in which the respective components of surface free energy, p, d and h, are known may be used, and the adhesion to the reagent may be measured to make calculation. Stated specifically, pure water, methylene iodide and α-bromonaphthalene are used as the reagents. Contact angles of each reagent to the photosensitive member surface are measured with a contact angle meter CA-S ROLL, manufactured by Kyowa Kaimen K. K., and the surface free energy γ is calculated on a surface-free-energy-analyzing software, EG-11, of the same company.

The surface protective layer of the light-receiving member of the present invention may preferably further contain hydrogen atoms. Incorporation of hydrogen atoms is considered to effectively compensate any structural defects in the film to reduce the density of localized levels. As the result, the transparency of the film is improved and, in the surface protective layer, any unwanted absorption of light is kept from taking place, bringing about an improvement in photosensitivity. Also, the presence of hydrogen atoms in the film is said to play an important role for the solid lubricity.

The hydrogen atoms may preferably be in a content of from 35 to 55 atom %. If they are in a content less than 35 atom %, the above effect may not be obtainable in some cases. If on the other hand they are in a content more than 55 atom %, the a-C:H film may have so low a hardness as to be unsuitable as the surface protective layer of the light-receiving member. The hydrogen atoms may more preferably be in a content of from 40 to 50 atom %, and particularly preferably from 45 to 50 atom %.

The surface protective layer is suitably usable as long as it has an optical band gap in a value of approximately from 1.2 to 2.2 eV, and more preferably 1.6 eV or more in view of sensitivity.

The surface protective layer is suitably usable as long as it has a refractive index of approximately from 1.8 to 2.8.

The surface protective layer may have a layer thickness of from 5 to 1,000 nm, and preferably from 10 to 200 nm. If it is thinner than 5 nm, it may have a problem on mechanical strength. If it is thicker than 1,000, it may have a problem on photosensitivity.

In the present invention, the surface protective layer may optionally further be incorporated with atoms capable of controlling conductivity. The atoms capable of controlling conductivity which may be contained in the surface protective layer may include what is called impurities in the field of semiconductors. Usable are atoms belonging to Group IIIb of the periodic table, capable of providing p-type conductive properties, or atoms belonging to Group Vb of the periodic table, capable of providing n-type conductive properties. The atoms capable of controlling conductivity which are contained in the surface protective layer may be in a content appropriately determined as occasion calls, and may preferably be in a content of from 10 to 10,000 atom ppm, more preferably from 50 to 5,000 atom ppm, and most preferably from 100 to 1,000 atom ppm.

The surface protective layer formed of a-C:H in the present invention may also optionally contain halogen atoms. The halogen atoms contained in the surface protective layer may be in an amount of from 35 to 55 atom % as amount including that of hydrogen atoms. As halogen atoms, they may preferably be contained in an amount not more than 25 atom %, and preferably from 5 to 15 atom %, and particularly preferably from 5 to 10 atom %.

In the present invention, as a method of measuring the content of the hydrogen atoms and halogen atoms contained in the surface protective layer of the light-receiving member, the following method is available.

When the surface protective layer is formed, the film is deposited on a mirror-polished silicon wafer under the same processing conditions as those at the time of film formation to prepare a sample. This sample is set in an infrared spectrophotometer to measure infrared absorption spectra. When hydrogen content is measured, the hydrogen content in the film can be determined from the area of a C-Hn absorption peak appearing around 2,960 $cm^{-1}$ and the layer thickness. Also, when halogen content is measured, e.g., in the case of fluorine atoms, the content can be determined from the area of a C-Fn endothermic peak appearing around 1,200 $cm^{-1}$ and the layer thickness.

To control the quantity of the hydrogen atoms and/or halogen atoms to be contained in the surface protective layer, the temperature of conductive substrates in the manufacture of light-receiving members, the quantity of material substance(s) used for incorporating hydrogen atoms and/or halogen atoms and fed into a reactor, and the discharge power may be controlled, for example.

The material substance used for incorporating hydrogen atoms in the surface protective layer may include hydrogen and hydrocarbon gases. The substance used for incorporating halogen atoms may include $C_2F_6$, $CF_4$ and $C_3F_8$.

The conductive substrate temperature set when the surface protective layer is deposited may be regulated in the range of from room temperature to 350° C. Too high substrate temperature may make band gap lower to provide a low transparency, and hence it is preferable to set temperature a little low.

With regard to the high-frequency power, it may preferably be as high as possible because the decomposition of hydrocarbons proceeds sufficiently. Stated specifically, it may preferably be 5 W·min/ml or higher with respect to hydrocarbon material gases. Too high power, however, may cause abnormal discharge to make the light-receiving member have poor characteristics. Accordingly, the power must be controlled to a level where no abnormal discharge may occur.

With regard to discharge space pressure, it may preferably be a relatively high vacuum because, when films are formed using not readily decomposable material gases such as hydrocarbons, polymers tend to be produced if any species to be decomposed collide against one another in the gaseous phase. It may preferably be kept at approximately from 13.3 Pa to 1,330 Pa when usual RF (typically 13.56 MHz) power is used, and approximately from 13.3 mPa to 1,330 Pa when VHF band (typically 50 to 450 MHz) power is used.

(c) Photoconductive Layer (Photosensitive Layer)

The photoconductive layer of the light-receiving member in the present invention may preferably be constituted of a non-single-crystal material composed chiefly of silicon atoms and containing hydrogen atoms and/or halogen atoms. The hydrogen atoms and halogen atoms compensate unbonded arms of silicon atoms and contribute to an improvement in layer quality, in particular, an improvement of photoconductivity and charge-holding performance. Of course, either of organic materials and inorganic materials are usable as long as they have photoconductivity. The inorganic materials may include non-single-crystal silicon, particularly preferably amorphous silicon (abbreviated as "a-Si(H,X)"), and besides a-Se.

The "non-single-crystal material composed chiefly of silicon atoms" herein referred to indicates amorphous silicon chiefly, and may also partly contain microcrystalline and polycrystalline components.

The photoconductive layer in the present invention can be formed using as a material gas $SiH_4$, $Si_2H_6$, $Si_3H_8$ or $Si_4H_{10}$.

The hydrogen atoms or halogen atoms, or the hydrogen atoms and halogen atoms in total, contained in the photoconductive layer may preferably be in a content of from 10 to 40 atom %, and more preferably from 15 to 25 atom %, based on the total of all atoms.

To control the quantity of the hydrogen atoms and/or halogen atoms to be contained in the photoconductive layer, the temperature of conductive substrates in the manufacture of light-receiving members, the quantity of material substance(s) used for incorporating hydrogen atoms and/or halogen atoms and fed into a reactor, and the discharge power may be controlled, for example.

The material substance used for incorporating hydrogen atoms in the photoconductive layer may include hydrogen. The substance used for incorporating halogen atoms may include $C_2F_6$, $CF_4$ and $C_3F_8$.

In the present invention, the photoconductive layer may optionally further be incorporated with atoms capable of controlling conductivity. As the atoms capable of controlling conductivity, usable are atoms belonging to Group IIIb of the periodic table, or atoms belonging to Group Vb of the periodic table.

The atoms capable of controlling conductivity which are contained in the photoconductive layer may preferably be in an amount of from 0.01 to 10,000 atom ppm, more preferably from 0.05 to 5,000 atom ppm, and most preferably from 0.1 to 1,000 atom ppm.

In the present invention, the photoconductive layer may further be incorporated with at least one atoms selected from carbon atoms, oxygen atoms and nitrogen atoms. Such at least one atoms selected from carbon atoms, oxygen atoms and nitrogen atoms may be in a content of from 0.00005 to 10 atom %, more preferably from 0.0001 to 8 atom %, and most preferably from 0,001 to 5 atom %. Any of these atoms need not necessarily be contained over the whole layer, and may be contained only partly, or distributed in the direction of layer thickness.

To control the quantity of the carbon atoms, oxygen atoms and nitrogen atoms to be contained in the photoconductive layer, the quantity of material substance used for incorporating these atoms and fed into a reactor may be controlled, for example.

The material substance used for incorporating carbon atoms in the photoconductive layer may include $CH_4$, $C_2H_6$, $C_3H_8$ and $C_4H_{10}$. Also, the substance used for incorporating nitrogen atoms or oxygen atoms may include $NH_3$, NO, $N_2O$, $NO_2$, $O_2$, $CO_2$ and $N_2$.

In the present invention, the photoconductive layer may have a layer thickness determined appropriately as desired taking account of the desired light-receiving member performance to be attained, economical effect and so forth. It may preferably have a layer thickness of from 10 to 50 $\mu$m, more preferably from 20 to 45 $\mu$m, and most preferably from 25 to 40 $\mu$m.

The photoconductive layer in the present invention may be formed by plasma-assisted CVD, sputtering, ion implantation or the like, using as material gases the gases described above. Also, as discharge frequency of the power used in plasma-assisted CVD when the photoconductive layer in the present invention is formed, any frequency may be used. In an industrial scale, preferably usable is high-frequency power of 1 to 50 MHz, which is called an RF frequency band, in particular, 13.56 MHz.

The conductive substrate temperature set when the photoconductive layer is deposited may be regulated in the range of from 200 to 350° C., and more preferably form 250 to 300° C.

With regard to discharge space pressure, it may preferably be kept at approximately from 13.3 Pa to 1,330 Pa when usual RF (typically 13.56 MHz) power is used, and approximately from 13.3 mPa to 1,330 Pa when VHF band (typically 50 to 450 MHz) power is used.

The photoconductive layer described above may also have the construction functionally separated into the two charge generation layer and charge transport layer as shown in FIGS. 6 and 7.

(d) Buffer Layer

Figure 10:
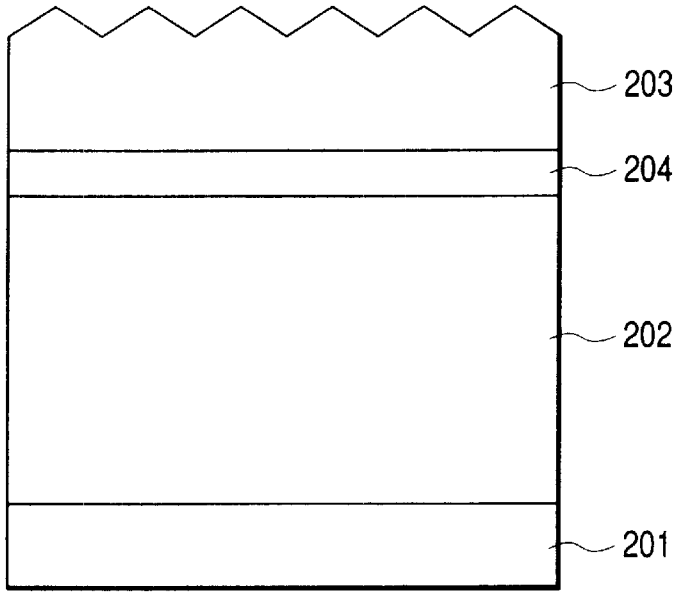

The light-receiving member of the present invention may be provided with the buffer layer between the surface protective layer and the photoconductive layer. In such a case, a buffer layer 204 is provided in the manner as shown in FIG. 10. Other reference numerals denote the same as those in FIG. 2.

The buffer layer may preferably be constituted of a non-single-crystal material composed chiefly of silicon atoms and further containing at least one of atoms selected from carbon atoms, nitrogen atoms and oxygen atoms. Such a non-single-crystal material may include amorphous silicon carbide, amorphous silicon nitride and amorphous silicon oxide.

At least one of atoms selected from carbon atoms, oxygen atoms and nitrogen atoms used in the buffer layer may preferably be in a content of from 10 to 90 atom %, more preferably from 30 to 80 atom %, and most preferably from 50 to 70 atom %, based on the total of the silicon atoms and the atoms selected from carbon atoms, oxygen atoms and nitrogen atoms.

The buffer layer may preferably have a layer thickness of from 0.01 to 10 $\mu$m, more preferably from 0.1 to 1 $\mu$m, and most preferably from 0.2 to 0.8 $\mu$m.

As material gases used in the buffer layer in the present invention, they may preferably include the following.

Materials that can serve as gases for feeding carbon may include, as those effectively usable, gaseous or gasifiable hydrocarbons such as $CH_4$, $C_2H_6$, $C_3H_8$ and $C_4H_{10}$.

Materials that can serve as gases for feeding nitrogen or oxygen may include, as those effectively usable, gaseous or gasifiable compounds such as $NH_3$, NO, $N_2O$, $NO_2$, $O_2$, CO, $CO_2$ and $N_2$.

The buffer layer may also be formed by plasma-assisted CVD, sputtering, ion implantation or the like. Also, as discharge frequency of the power used in plasma-assisted CVD when the buffer layer in the present invention is formed, any frequency may be used. In an industrial scale, preferably usable is high-frequency power of 1 to 50 MHz, which is called an RF frequency band, in particular, 13.56 MHz.

The conductive substrate temperature set when the buffer layer is deposited may be regulated in the range of from 200 to 350° C., and more preferably form 250 to 300° C.

With regard to discharge space pressure, it may preferably be kept at approximately from 13.3 Pa to 1,330 Pa when usual RF (typically 13.56 MHz) power is used, and approximately from 13.3 mPa to 1,330 Pa when VHF band (typically 50 to 450 MHz) power is used.

(e) Other Layer

Figure 11:
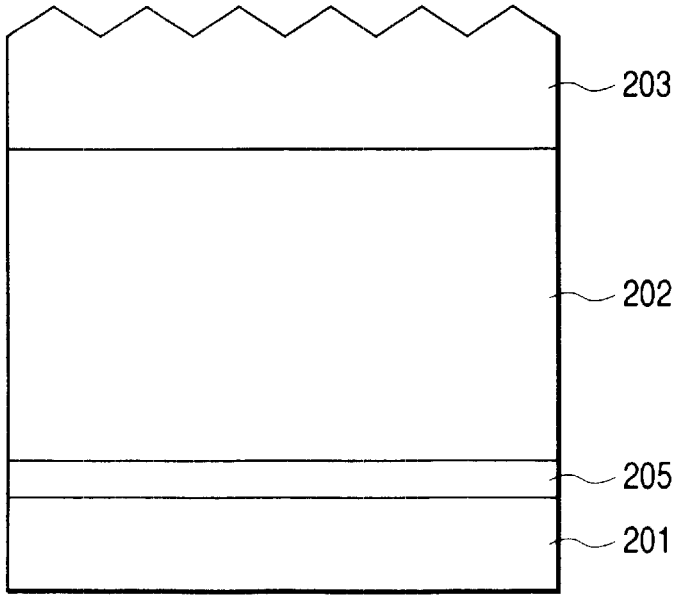

In addition to the surface protective layer, buffer layer and photoconductive layer, the light-receiving member of the present invention may be provided with a lower-part blocking layer 205 between the photoconductive layer and the conductive substrate as shown in FIG. 11.

The lower-part blocking layer 205 may preferably be constituted of a non-single-crystal material composed chiefly of silicon atoms and further containing at least one of atoms selected from carbon atoms, nitrogen atoms and oxygen atoms. Such a non-single-crystal material may include amorphous silicon carbide, amorphous silicon nitride and amorphous silicon oxide.

At least one of atoms selected from carbon atoms, oxygen atoms and nitrogen atoms used in the lower-part blocking layer may preferably be in a content of from 0.001 to 50 atom %, more preferably from 0.005 to 30 atom %, and most preferably from 0.01 to 10 atom %, based on the total of the silicon atoms and the atoms selected from carbon atoms, oxygen atoms and nitrogen atoms.

In another embodiment, the lower-part blocking layer may contain atoms belonging to Group IIIb of the periodic table (preferably B), capable of providing p-type conductive properties, or atoms belonging to Group Vb of the periodic table (preferably As or P), capable of providing n-type conductive properties. The atoms capable of controlling conductivity which are contained in the lower-part blocking layer may be in a content appropriately determined as occasion calls, and may preferably be in a content of from 10 to 10,000 atom ppm, and more preferably from 50 to 5,000 atom ppm.

The lower-part blocking layer may preferably have a layer thickness of from 0.01 to 10 $\mu$m, more preferably from 0.1 to 5 $\mu$m, and most preferably from 1 to 4 $\mu$m.

As material gases used in the lower-part blocking layer in the present invention, they may preferably include the following. Materials that can serve as gases for feeding silicon may include gases such as $SiH_4$, $Si_2H_6$ and $Si_3H_{10}$. Materials that can serve as gases for feeding carbon may include gases such as $CH_4$, $C_2H_6$, $C_3H_8$ and $C_4H_{10}$. Materials that can serve as gases for feeding nitrogen or oxygen may include gases such as $NH_3$, NO, $N_2O$, $NO_2$, $O_2$, CO, $CO_2$ and $N_2$.

The lower-part blocking layer may also be formed by plasma-assisted CVD, sputtering, ion implantation or the like. Also, as discharge frequency of the power used in plasma-assisted CVD when the lower-part blocking layer in the present invention is formed, any frequency may be used. In an industrial scale, preferably usable is high-frequency power of 1 to 50 MHz, which is called an RF frequency band, in particular, 13.56 MHz, or VHF band (50 to 450 MHz) power.

The conductive substrate temperature set when the lower-part blocking layer is deposited may also be regulated in the range of from 200 to 350° C, and more preferably form 250 to 300° C.

With regard to discharge space pressure, it may preferably be kept at approximately from 13.3 Pa to 1,330 Pa when usual RF (typically 13.56 MHz) power is used, and approximately from 13.3 mPa to 1,330 Pa when VHF band (typically 50 to 450 MHz) power is used.

In the present invention, even where a photosensitive drum having a diameter of 100 mm or smaller is used as the light-receiving member, good image formation can be performed over a long period of time on account of superior anti-contamination properties and solid lubricity which are attributable to the light-receiving member having the construction described above. This tendency is more conspicuous when a photosensitive drum having a diameter of 75 mm or smaller is used.

(2) Light-Receiving Member Production Process in the Present Invention

Examples of the production of the light-receiving member in the present invention are given below.

Figure 12:
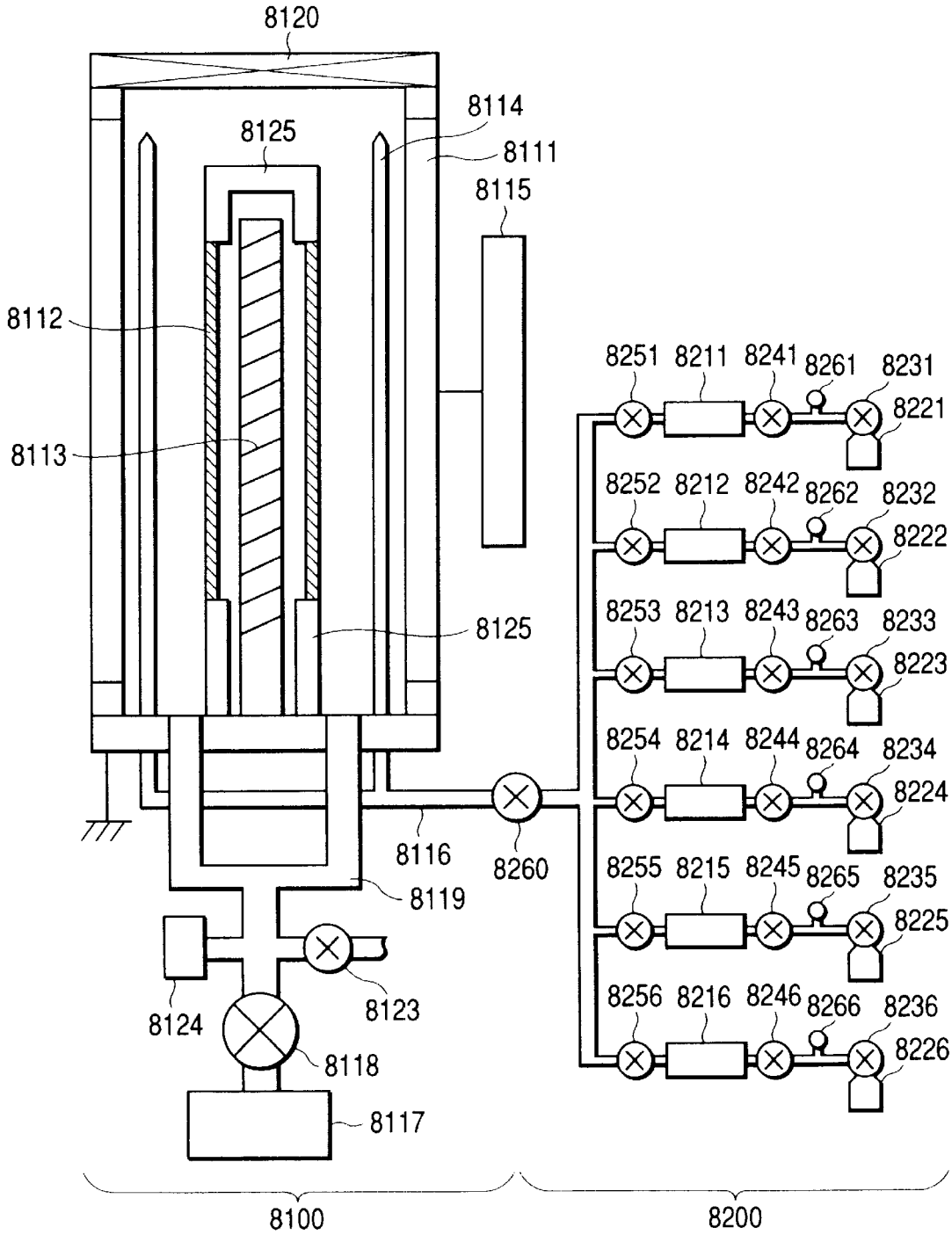
FIGS. 12 and 13 are each a diagrammatic cross-sectional view for describing an example of a film-forming system which is a kind of a plasma-assisted processing system.

FIG. 12 is a schematic cross-sectional view diagrammatically showing an example of a system (film-forming system) for forming deposited films by plasma-assisted CVD (plasma-assisted CVD system) using high-frequency (hereinafter abbreviated as "RF") power, which system is used for producing the light-receiving member usable in the image-forming apparatus of the present invention.

The plasma-assisted CVD system has a deposited-film formation system (deposition system) 8100 and a material gas feed system 8200. In gas cylinders 8221 to 8226 shown in the drawing, material gases for forming the light-receiving member of the present invention as exemplified by $SiH_4$, $H_2$, $CH_4$, $B_2H_6$, NO and Ar are hermetically enclosed. When the gas cylinders 8221 to 8226 are attached, the respective gases are previously be so made as to be kept introduced into gas pipes of flow-in valves 8241 to 8246 through valves 8231 to 8236, respectively.

The deposited-film formation system 8100 has a reactor 8111 which is a vertical vacuum tube. A plurality of gas-introducing pipes 8114 extending in the vertical direction are provided along the inner wall of this reactor 8111, and a large number of minute holes are made in the sidewalls of the gas feed pipes 8114 along its lengthwise direction. At the center of the reactor 8111, a spirally coiled heater 8113 is provided extendingly in the vertical direction. A cylinder 8112 serving as the substrate of the light-receiving member (photosensitive drum) can be inserted into the reactor 8111 after its top cover 8120 is opened, and be vertically installed in the reactor 8111 with the heater 8113 inside. Also, a high-frequency power is supplied through a high-frequency matching box 8115 provided on one side of the reactor 8111.

To the bottom of the reactor 8111, a material gas feed line 8116 connected to the gas-introducing pipes 8114 is attached, and this feed line 8116 is connected to the material gas feed system 8200 via an auxiliary value 8260. An exhaust pipe 8119 is also attached to the bottom of the reactor 8111. This exhaust pipe 8119 is connected to an exhaust unit (vacuum pump) 8117 via a main exhaust valve 8118. To the exhaust valve 8118, a vacuum gauge 8124 and an exhaust sub-valve (leak valve) 8123 are further attached.

Using such a system, the light-receiving member can be formed in the following manner. For example, an aluminum cylinder (cylindrical conductive substrate) 8112 whose surface has been mirror-polished by means of a lathe is inserted to a substrate holder 8125. After the top cover 8120 is opened, the substrate holder 8125 with the cylindrical substrate is so inserted into the reactor 8111 as to hold the heater 811 inside.

Next, the valves 8231 to 8236 of the gas cylinders 8221 to 8226, the flow-in valves 8241 to 8246 and the leak valve 8123 of the reactor 8111 are checked to make sure that they are closed, and the flow-out valves 8251 to 8256 and the auxiliary valve 8260 are also checked to make sure that they are opened. Then, firstly the main exhaust valve 8118 is opened to evacuate the insides of the reactor 8111 and gas pipes by means of the vacuum pump 8117.

Thereafter, valves 8231 to 8236 are opened so that gases are respectively introduced from the gas cylinders 8221 to 8226, and each gas is controlled to have a desired pressure by operating pressure controllers 8261 to 8266.

Next, the flow-in valves 8241 to 8246 are slowly opened so that the gases are respectively introduced into mass flow controllers 8211 to 8216. Then, the flow-out valve 8256 and auxiliary valve 8260, through which Ar is introduced, are slowly opened to make Ar gas flow into the reactor 8111 through the gas-introducing pipes 8114. In that course, the exhaust rate of the vacuum pump 8117 is so adjusted that the Ar gas flow rate comes to be the desired flow rate, watching the vacuum gauge 8124. Thereafter, a temperature controller (not shown) is operated to heat the conductive substrate 8112 by means of the heater 8113. At the time the conductive substrate 8112 has been heated to a stated temperature, the flow-out valve 8256 and the auxiliary valve 8260 are closed to stop the gas from flowing into the reactor 8111.

Next, the flow-out valves 8251 to 8256 necessary for forming respective layers and the auxiliary valve 8260 are slowly opened so that material gases are fed into the reactor 8111 through the gas feed pipes 8114. In that course, the flow rates of the materials gases are adjusted with the mass flow controllers 8211 to 8216 so as to be at the desired flow rates. The exhaust rate of the vacuum pump 8117 is so adjusted that the pressure inside the reactor 8111 comes to be the desired pressure, watching the vacuum gauge 8124. Thereafter, the electric power of an RF power source (not shown) is set at the desired electric power, and an RF power is supplied to the inside of the reactor 8111 through a high-frequency matching box 8115 to cause RF glow discharge to take place. Thus, the desired layer is started being formed on the substrate 8112 or on a film having already been formed. After a film with the desired thickness has been formed, the RF glow discharge is stopped, and the flow-out valves 8251 to 8256 and the auxiliary valve 8260 are closed to stop gases from flowing into the reactor 8111. The formation of a layer is thus completed.

Needless to say, when the respective layers are formed, the flow-out valves other than those for necessary gases are all closed. Also, in order to prevent the respective gases from remaining inside the reactor 8111 and the pipes extending from the flow-out valves 8251 to 8256 to the reactor 8111, the flow-out valves 8251 to 8256 are closed and the auxiliary valve 8260 is opened, where the main valve 8118 is further full opened to once evacuate the inside of the system to a high vacuum. This is operated as occasion calls.

In the course of film formation, the conductive substrate 8112 and the conductive substrate holder 8125 may optionally be rotated at the desired rotational speed by means of a drive unit (not shown) so that the layer can uniformly be formed.

To form the surface layer comprised of a-C:H, the inside of the reactor 8111 is once evacuated to a high vacuum, and thereafter the stated gas, e.g., the hydrocarbon gas such as $CH_4$, $C_2H_6$, $C_3H_8$ or $C_4H_{10}$ and optionally the material gas such as hydrogen gas, helium gas or argon gas, having been mixed by a mixing panel, are fed into the reactor 8111 through the gas-introducing pipes 8114. Next, the flow rates of the respective gases are adjusted by means of the mass flow controllers 8211 to 8216 so as to come to the desired flow rates. In that course, the exhaust rate is so adjusted that the pressure inside the reactor 8111 comes to be a stated pressure of 133.3 Pa or below, watching the vacuum gauge 8124. After making sure that the pressure has become stable, a high-frequency power source (not shown) is set at the desired electric power, and the electric power is supplied to the inside of the reactor 8111 to cause high-frequency glow discharge to take place. Here, the high-frequency matching box 8115 is so adjusted that any reflection wave becomes minimum, thus the value found by subtracting reflected power from inputted power of the high-frequency power is adjusted to the desired value. The material gases such as hydrocarbon gas fed into the reactor 8111 are decomposed by the discharge energy of the high-frequency power, so that the stated a-C:H deposited film is formed on the photoconductive layer. After the film with the desired thickness has been formed, the supply of the high-frequency power is stopped, and the material gases are stopped from flowing into the reactor 8111, where the inside of the reactor 8111 is once evacuated to a high vacuum, thus the formation of the surface layer is completed.

Figure 13:
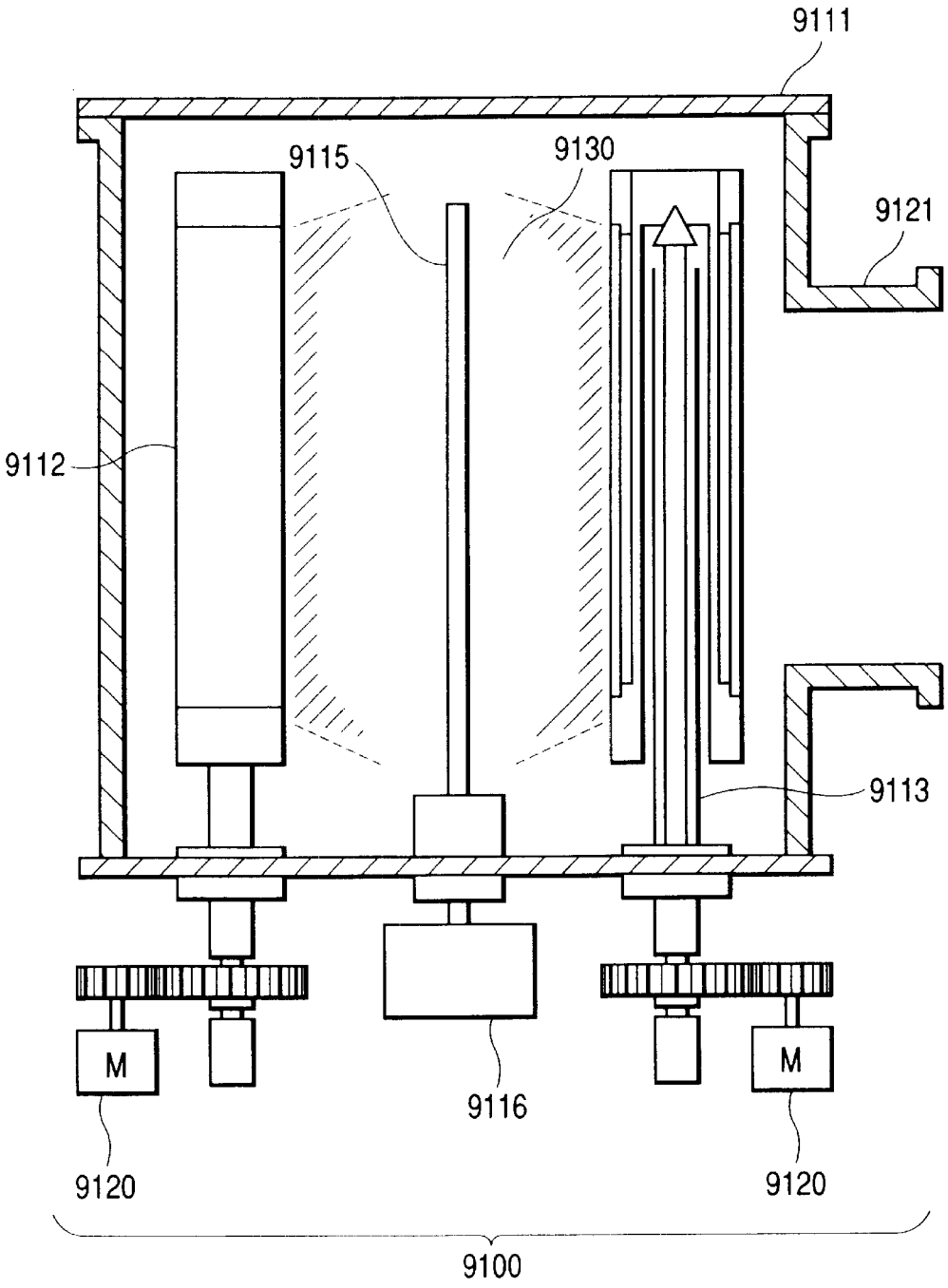

FIG. 13 is a schematic cross-sectional view diagrammatically showing an example of a system for forming deposited films by plasma-assisted CVD (plasma-assisted CVD system) using VHF power, which system is used for producing the light-receiving member usable in the image-forming apparatus of the present invention. Using this system of VHF plasma-assisted CVD, deposited films can be formed in the following way.

Here, FIG. 13 illustrates only the part of a deposition system 9100 making use of a VHF power source, which is used in place of the deposition system 8100 making use of an RF power source, of the plasma-assisted CVD system shown in FIG. 12. The same material gas feed system 8200 as that shown in FIG. 12 is connected to the deposition system 9100.

First, cylindrical conductive substrates 9112 are set in a reactor 9111. The conductive substrates 9112 are each rotated by means of a drive unit 9120. The inside of the reactor 9111 is evacuated through an exhaust tube 9121 by means of an evacuation device (not shown) as exemplified by a diffusion pump, to control the pressure inside the reactor 9111 to be not higher than $1.33\times10^{-5}$ Pa. Subsequently, the temperature of each cylindrical substrate 9112 is controlled at a stated temperature of from 50° C. to 500° C. by means of a heater 9113 for heating the substrate.

Before material gases for forming the deposited films are flowed into the reactor 9111, valves 8231 to 8236 of gas cylinders in a material gas feed system 8200 (the same system as that shown in FIG. 12) and a leak valve (not shown) of the reactor are checked to make sure that they are closed, and also flow-in valves 8241 to 8246, flow-out valves 8251 to 8256 and an auxiliary valve 8260 are checked to make sure that they are opened. Then, firstly a main valve (not shown) is opened to evacuate the insides of the reactor 9111 and gas pipes.

Next, at the time a vacuum gauge (not shown) has been read to indicate a pressure of about $6.65\times10^{-4}$ Pa, the auxiliary valve 8260 and flow-out valves 8251 to 8256 of the material gas feed system 8200 are closed. Thereafter, valves 8231 to 8236 are opened so that gases are respectively introduced from gas cylinders 8221 to 8226, and each gas is controlled to have a pressure of $2\times10^{-5}$ Pa by operating pressure controllers 8261 to 8266. Next, the flow-in valves 8241 to 8246 are slowly opened so that gases are respectively introduced into mass flow controllers 8211 to 8216. After the film formation is thus ready to start, the deposited films are formed on the conductive substrate 9112 in the following way.

At the time the substrate 9112 has had a stated temperature, some flow-out valves of gases necessary for forming layers, among the flow-out valves 8251 to 8256, and the auxiliary valve 8260 are slowly opened so that stated gases are fed into a discharge space 9130 in the reactor 9111 from the gas cylinders 8211 to 8226 through a gas feed pipe (not shown). Next, the mass flow controllers 8211 to 8216 are operated so that each material gas is so regulated as to flow at a stated rate. In that course, the opening of the main valve (not shown) is so adjusted that the pressure inside the discharge space 9130 comes to be a stated pressure of not higher than 133 Pa, watching the vacuum gauge (not shown).

At the time the inner pressure has become stable, a VHF power source (not shown) of, e.g., frequency 105 MHz is set at the desired electric power, and a VHF power is supplied to an electrode 9115 through a matching box 9116 to cause glow surrounded by the conductive substrates 9112, the material gas fed thereinto is excited by discharge energy to undergo dissociation, and a stated deposited film is formed on each conductive substrate 9112. At that time, the output of a heater 9113 for the substrate is adjusted simultaneously with the supply of the VHF power to change the temperature of the conductive substrate at a predetermined value. Here, the substrate is rotated at the desired rotational speed by means of the drive unit 9120 so that the layer can be uniformly formed.

After a film with the desired thickness has been formed on each substrate, the supply of VHF power is stopped, and the flow-out valves are closed to stop gases from flowing into the reactor. The formation of built-up films is thus completed.

The same operation as the above is repeated plural times, whereby light-receiving members having photosensitive layers with the desired multi-layer structure can be formed.

Needless to say, when the corresponding layers are formed, the flow-out valves other than those for necessary gases are all closed. Also, in order to prevent the respective gases from remaining inside the reactor 9111 and the pipes extending from the flow-out valves 8251 to 8256 to the reactor 9111, the flow-out valves 8251 to 8256 are closed and the auxiliary valve 8260 is opened, where the main valve (not shown) is further full opened to once evacuate the inside of the system to a high vacuum. This is operated as occasion calls.

Where the a-Si photosensitive layer is formed by PCVD using the above system (FIG. 12), it may be formed in the same manner as the above, and may be formed, e.g., in the following way. First, a photosensitive drum substrate 8112 is set in the reactor 8111. After the top cover 8120 is closed, the inside of the reactor 8111 is evacuated to a pressure of a stated pressure or below by means of the exhaust unit 8117. Thereafter, continuing the evacuation, the substrate 8112 is heated from the inside by means of the heater 8113 to control the substrate to have a stated temperature within the range of, e.g., from 20° C. to 450° C. At the time the substrate 8112 has been maintained at the stated temperature, the desired material gases are fed into the reactor 8111 though the feed pipes 8114 while the gases are controlled by means of their corresponding flow-rate control assemblies (not shown). The material gases thus fed is, after the inside of the reactor 8111 has been filled with them, driven off outside the reactor 8111 through the exhaust pipe 8119.

The vacuum gauge 8124 is checked to make sure that the inside of the reactor 8111 thus filled with the material gases has reached a stated pressure and has become stable, and then a high-frequency power is supplied into the reactor 8111 in the desired input power quantity from a high-frequency power source (not shown; RF band of 13.56 MHz, or VHF band of from 50 to 150 MHz) to cause glow discharge to take place in the reactor 8111. Components of the material gases are decomposed by the energy of this glow discharge, so that plasma ions are formed and the a-Si deposited film composed chiefly of silicon is formed on the substrate 8112. Here, parameters of gas species, gas feed quantity, gas feed ratio, pressure, substrate temperature, input power, layer thickness and so forth may be regulated to form a-Si deposited films having various characteristics, whereby electrophotographic performances can be controlled.

After the a-Si deposited film has been thus formed on the surface of the substrate 8112 in the desired layer thickness, the supply of the high-frequency power is stopped, and the auxiliary valve 8260 and so forth are closed to stop material gases from flowing into the reactor 8111, thus the formation of the a-Si deposited film is completed for one layer.

The same procedure as the above may be repeated a plurality of times, whereby an a-Si deposited film, i.e., the a-Si photosensitive layer, having the desired multi-layer structure can be formed. Thus the light-receiving member having on the substrate 812 the a-Si photosensitive layer having multi-layer structure can be produced.

As to the control to lessen the interfacial reflection between the surface protective layer and the photoconductive layer according to the present invention, it can be achieved by continuously changing power conditions and gas composition for the next layer without stopping the high-frequency power and also without stopping the feeding of material gases when the formation of the a-Si deposited film is completed for one layer. Alternatively, it can also be achieved by once stopping the high-frequency power but forming films by starting the feeding of the material gases under constitution of the previous layer and while continuously changing the constitution as desired.

In the above, electrophotographic performances of the a-Si deposited layer in its lengthwise direction, to be formed on the substrate 8112, can be controlled by regulating the flow rate distribution in the lengthwise direction of the feed pipes 8114 in respect of the material gases fed into the reactor 8111 through the minute holes distributed in the lengthwise direction of the feed pipes 8114, the rate of flow-out of exhaust gas from the exhaust tube, the discharge energy and so forth.

Needless to say, the gas species and valve operations may be changed according to the conditions under which each layer is formed.

(3) Image-Forming Method and Image-Forming Apparatus

As the image-forming method in the present invention, any known method may be used, provided that the light-receiving member described above, or this member and the electrostatic-latent-image-developing toner described later, is/are used.

One preferable construction of the image-forming apparatus in the present invention is that already described with reference to FIG. 1. Of course, the present invention is by no means limited to it. Also, in the image-forming apparatus of the present invention, it may have the same means as those used in conventional image-forming apparatus, except that the light-receiving member described above, or this member and the electrostatic-latent-image-developing toner described later, is/are used.

Figure 1:
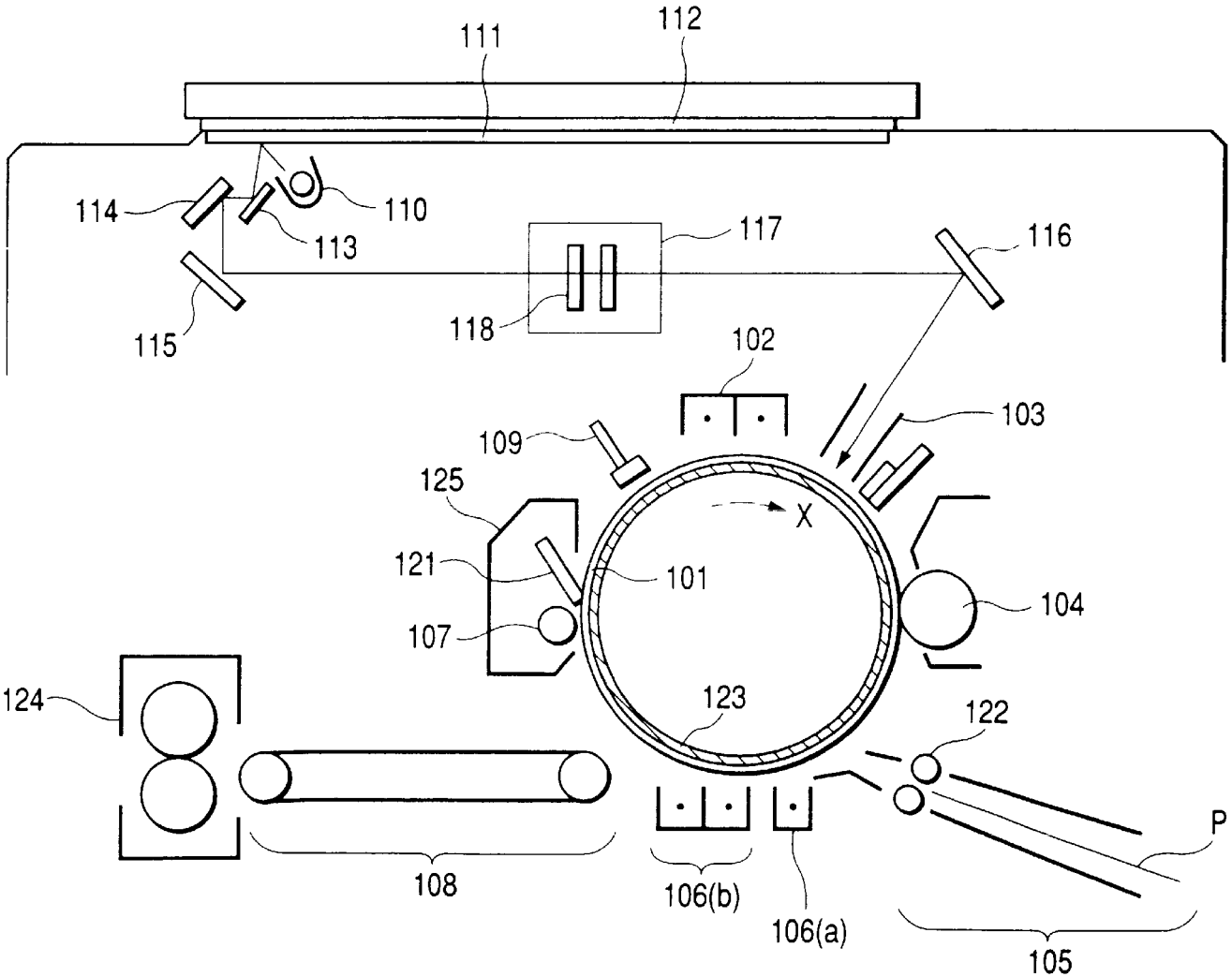
FIG. 1 is a diagrammatic cross-sectional view for describing an example of the construction of an image-forming apparatus.

FIG. 1 is a schematic illustration of an example of the image-forming apparatus. Its exposure light source may be one which performs exposure in accordance with electronic data, using a laser, an LED or a liquid-crystal shutter.

Figure 14:
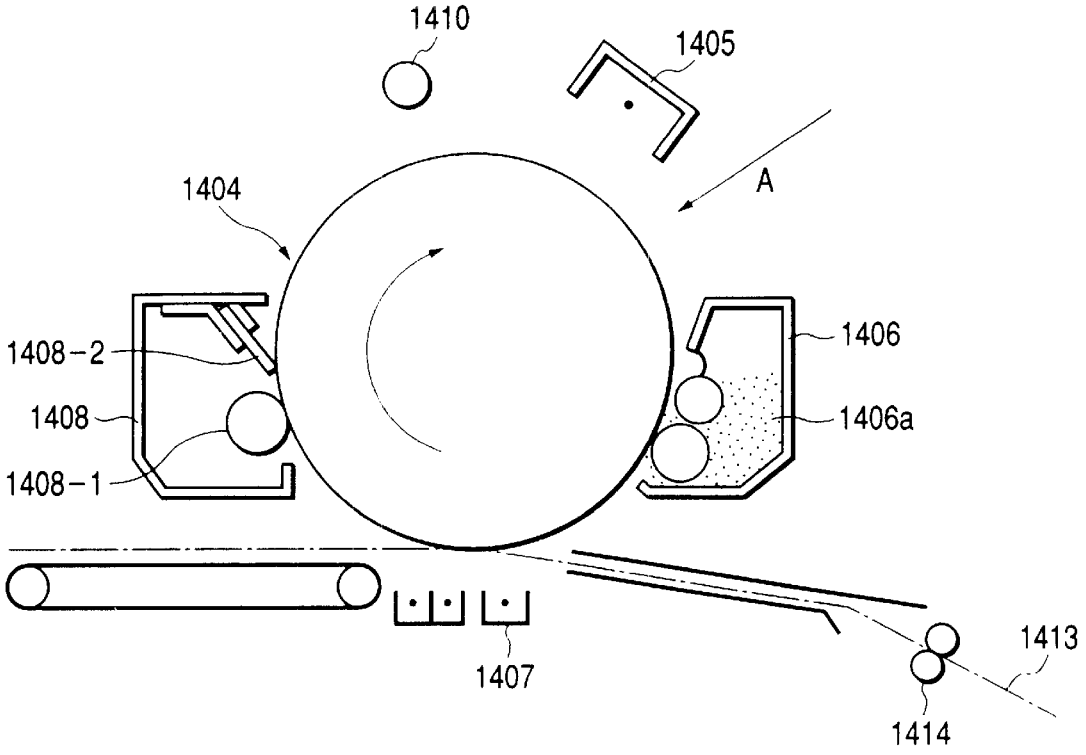
FIG. 14 is a diagrammatic cross-sectional view for describing an example of components that surround a light-receiving member of an image-forming apparatus.

In an electrophotographic apparatus which is an image-forming apparatus making use of the light-receiving member (electrophotographic photosensitive member) produced in the manner as described above, an example of its components that surround the photosensitive member is shown in FIG. 14. Incidentally, the apparatus of this example is suitable when a cylindrical electrophotographic photosensitive member is used. Alternatively, the photosensitive art member may have any desired form such as the form of an endless belt.

As shown in FIG. 14, around a light-receiving member 1404 so referred to in the present invention, it is provided with a primary charging assembly 1405 for charging the light-receiving member 1404 so that an electrostatic latent image can be formed thereon; a developing assembly 1406 for feeding a developer containing a toner 1406*a,* to the light-receiving member 1404 on which the electrostatic latent image is to be formed; a transfer charging assembly 1407 for transferring the toner held on the surface of the light-receiving member, to a transfer material 1413 such as paper; and a cleaner 1408 for making the light-receiving member surface clean. In this example, the light-receiving member surface is cleaned with an elastic roller 1408-1 and a cleaning blade 1408-2 so that the light-receiving member surface can effectively uniformly be cleaned. Only any one of them may be provided, or the both need not be provided depending on the construction of the apparatus. A destaticizing lamp 1410 for eliminating electric charges from the light-receiving member surface is also provided between the cleaner 1408 and the primary charging assembly 1405 to make the light-receiving member ready for the next operation of image formation. Also, the transfer material 1413 is forwarded by means of a feed roller 1414. As a light source of exposure light A, a halogen light source or a light source chiefly composed of single wavelength may be used.

(4) Electrostatic-Latent-Image-Developing Toner

The electrostatic-latent-image-developing toner (hereinafter "toner") used in the image-forming apparatus or image-forming method of the present invention contains at least a binder resin, a charge control agent and a wax.

The toner used in the present invention can enjoy a good fixing performance even when the transfer material is passed inside the fixing assembly in a short time in a high-speed image-forming apparatus and also when the fixing assembly is operated at a lower temperature than ever for the purpose of energy saving.

As the binder resin for the toner in the present invention, it is possible to use the following binder resin.

For example, usable ones are homopolymers of styrene and derivatives thereof such as polystyrene, poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. Preferred binder resins are styrene copolymers or polyester resins.

Comonomers copolymerizable with styrene monomers in the styrene copolymers may include monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof as exemplified by maleic acid, butyl maleate, methyl maleate and dimethyl maleate; vinyl esters as exemplified by vinyl chloride, vinyl acetate and vinyl benzoate; ethylenic olefins as exemplified by ethylene, propylene and butylene; vinyl ketones as exemplified by methyl vinyl ketone and hexyl vinyl ketone; and vinyl ethers as exemplified by methyl vinyl ether, ethyl vinyl ether and isobutyl vinyl ether. Any of these vinyl monomers may be used alone or in combination of two or more types.

The styrene polymers or styrene copolymers may be cross-linked or may be in the form of mixed resins obtained by mixing resins having different molecular weight and/or composition.

As a cross-linking agent for the binder resin, compounds having at least two polymerizable double bonds may chiefly be used. For example, they include aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

The binder resin may be synthesized by any process of bulk polymerization, solution polymerization, suspension polymerization and emulsion polymerization by which the above monomers can be polymerized.

In the bulk polymerization, low-molecular weight polymers can be obtained by carrying out the polymerization at a high temperature and accelerating the rate of termination reaction. There is, however, a problem of a difficulty in reaction control.

In the solution polymerization, low-molecular weight polymers can readily be obtained under mild conditions by utilizing a difference in the chain transfer of radicals that is ascribable to solvents, and controlling the amount of initiators and the reaction temperature. Thus, the latter is preferred when a low-molecular weight component is to be formed in the resin composition used in the present invention. As solvents used in the solution polymerization, xylene, toluene, cumene, cellosolve acetate and isopropyl alcohol may be used. In the case of a mixture of styrene monomer, xylene, toluene or cumene is preferred. The solvent may appropriately be selected according to the polymers to be produced by polymerization. Reaction temperature may vary depending on the solvents to be used, initiators, and polymers to be produced. The reaction may preferably be carried out at 70° C. to 230° C. The solution polymerization may preferably be carried out using the monomers in an amount of from 30 parts by weight to 400 parts by weight based on 100 parts by weight of the solvent. Other polymer(s) may also preferably be mixed in the solution when polymerization is terminated, whereby several kinds of polymers can well be mixed.

As methods for obtaining high-molecular weight components or gel components, emulsion polymerization and suspension polymerization are preferred. Of these, the emulsion polymerization is a method in which monomers almost insoluble in water are dispersed in an aqueous phase in the form of small particles by the use of an emulsifying agent and then polymerized in the presence of a water-soluble polymerization initiator. In this method, the heat of reaction can readily be controlled and the phase where polymerization takes place (an oily phase comprised of polymers and monomers) and the aqueous phase are separated, so that the rate of termination reaction can be low and hence the rate of polymerization can be high, making it possible to obtain a product with a high degree of polymerization. In addition, because of a relative simple polymerization process and also because of a polymerization product formed of fine particles, the product can readily be mixed with colorants, charge control agents and other additives in the manufacture of toners, and hence this method is more advantageous than other methods, as a method of producing binder resins for toners.

The emulsion polymerization, however, tends to make the resulting polymer impure because of the emulsifying agent added, and also requires operations such as salting-out to take out the polymer. Hence, the suspension polymerization is a simple and preferred method.

The suspension polymerization may be carried out using monomers in an amount of not more than 100 parts by weight, and preferably from 10 to 90 parts by weight, based on 100 parts by weight of a water-based solvent. Usable dispersants may include polyvinyl alcohol, a polyvinyl alcohol partially saponified product, and calcium phosphate, and can be in a suitable quantity according to the monomer quantity based on the water-based solvent. Usually, any of these dispersants may be used in an mount of from 0.05 to 1 part by weight based on 100 parts by weight of the water-based solvent. The polymerization may suitably be carried out at a temperature of from 50 to 95° C., which should appropriately be selected according to polymerization initiators to be used and the intended polymer.

Any types of polymerization initiators may be used without any particular limitations as long as they are insoluble or sparingly insoluble in water.

The polymerization initiator used may include t-butylperoxy-2-ethylhexanoate, cumene perpivalate, t-butylperoxylaurate, benzoyl peroxide, lauroyl peroxide, octanoyl peroxide, di-t-butyl peroxide, t-butylcumyl peroxide, dicumyl peroxide, 2,2'-azobisisobutyronitrile, 2,2'-azobis(2-methylbutyronitrile), 2,2'-azobis(2,4-dimethylvaleronitrile), 2,2'-azobis(4-methoxy-2,4-dimethylvaleronitrile), 1,1-bis(t-butylperoxy)-3,3,5-trimethylcyclohexane, 1,1-bis(t-butylperoxy)cyclohexane, 1,4-bis(t-butylperoxycarbonyl)cyclohexane, 2,2-bis(t-butylperoxy)octane, n-butyl-4,4-bis(t-butylperoxy) valylate, 2,2-bis(t-butylperoxy)butane, 1,3-bis(t-butylperoxy-isopropyl)benzene, 2,5-dimethyl-2,5-di(t-butylperoxy) hexane, 2,5-dimethyl-2,5-di(t-butylperoxy) hexane, 2,5-dimethyl-2,5-di(benzoylperoxy)hexane, di-t-butylperoxyisophthalate, 2,2-bis(4,4-di-t-butylperoxycyclohexyl)propane, di-t-butylperoxy-α-methylsuccinate, di-t-butylperoxydimethylglutarate, di-t-butylperoxyhexahydroterephthalate, di-t-butylperoxyazelate, 2,5-diemthyl-2,5-di(t-butylperoxy) hexane, diethylene glycol-bis(t-butylperoxycarbonate), di-t-butylperoxytrimethyladipate, tris(t-butylperoxy) triazine, and vinyl tris(t-butylperoxy)silane. Any of these may used alone or in combination.

The initiator may be used in an amount of not less than 0.05 part by weight, and preferably from 0.1 part by weight to 15 parts by weight, based on 100 parts by weight of the monomers.

As the binder resin of the toner used in the present invention, it is preferable to use a polyester resin. The polyester resin used in the present invention, may preferably have the composition as shown below.

The polyester resin is obtained by polycondensation of an alcohol component with an acid component (carboxylic acid, carboxylate or carboxylic anhydride).

The alcohol component may include dihydric or higher alcohol components.

As a dihydric alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol and derivatives thereof, represented by the following Formula (1):

(1)

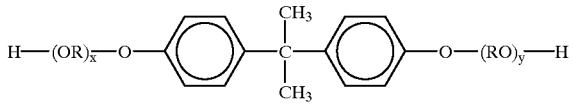

wherein R represents an ethylene group or a propylene group, x and y are each an integer of 0 or more, and an average value of x+y is 0 to 10;

and a diol represented by the following Formula (2).

(2)

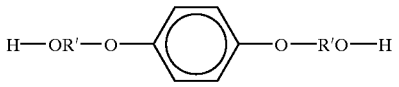

wherein R' represents —$CH_2CH_2$—,

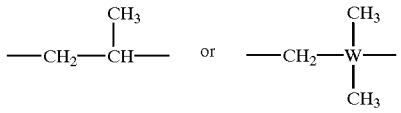

The acid component may include dibasic or higher carboxylic acids. As a dibasic acid component, it may include dicarboxylic acids and derivatives thereof as exemplified by benzene dicarboxylic acids such as phthalic acid, terephthalic acid, isophthalic acid and phthalic anhydride, and anhydrides or lower alkyl esters thereof; alkyldicarboxylic acids such as succinic acid, adipic acid, sebacic acid and azelaic acid, and anhydrides or lower alkyl esters thereof; alkenylsuccinic acids or alkylsuccinic acids such as n-dodecenylsuccinic acid and n-dodecylsuccinic acid, and anhydrides or lower alkyl esters thereof; unsaturated dicarboxylic acids such as fumaric acid, maleic acid, citraconic acid and itaconic acid, and anhydrides or lower alkyl esters thereof.

A trihydric or higher alcohol component and a tribasic or higher acid component serving also as cross-linking components may also be used in combination.

The trihydric or higher, polyhydric alcohol component may include, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

The tribasic or higher, polycarboxylic acid component in the present invention may include, e.g., trimellitic acid, pyromellitic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, empol trimer acid, anhydrides of these, and lower alkyl esters of these. It may also include a tetracarboxylic acid represented by the following Formula (4), anhydrides thereof, and lower alkyl esters thereof.

(4)

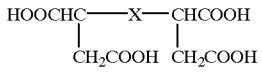

wherein X represents an alkylene group or alkenylene group having 5 to 30 carbon atoms having at least one side chain having 3 or more carbon atoms.

The alcohol component used in the present invention may be in an amount of from 40 to 60 mol %, and preferably from 45 to 55 mol %; and the acid component, from 60 to 40 mol %, and preferably from 55 to 45 mol %.

The trihydric or higher, polyhydric and polybasic components may preferably be in an amount of from 1 to 60 mol % of the whole components.

Of these, from the viewpoint of developing performance, fixing performance, running performance and cleaning performance, the binder resin may particularly preferably be a styrene/unsaturated carboxylic acid derivative copolymer, a polyester resin, a block copolymer of these, a grafted product of these, or a mixture of a styrene copolymer with a polyester resin.

The binder resin used in the toner in the present invention may have a Tg (glass transition temperature) of from 40° C. to 80° C., and preferably from 50° C. to 70°, which is preferable because the fixing performance can be maintained and improved without damaging storage stability of the toner.

The binder resin used in the present invention may preferably have, in molecular weight distribution as measured by GPC (gel permeation chromatography), a peak in the region of molecular weight of from 3,000 to 50,000 and also another peak in the region of molecular weight of not less than 100,000. This is preferable in view of fixing performance and running performance.

The binder resin may also contain THF(tetrahydrofuran)-insoluble matter in an amount not more than 50% by weight in order to improve anti-offset properties and to make proper the melt viscosity of a kneaded product when the toner is produced.

In order to maintain a good fixing performance, the binder resin used in the present invention may also be made to have a controlled molecular weight distribution by mixing a high-molecular weight polymer component and a low-molecular weight polymer component.

In the toner according to the present invention, in addition to the above binder resin components, the following compound may be incorporated in a proportion smaller than the content of the binder resin components. The compound may include, e.g., silicone resins, polyurethanes, polyamides, epoxy resins, polyvinyl butyral, rosin, modified rosins, terpene resins, phenolic resins, and copolymers of two or more types of α-olefins.

The toner used in the present invention contains a charge control agent.

A charge control agent capable of controlling the toner to be positively chargeable includes the following materials.

Nigrosine and products modified with a fatty acid metal salt; quaternary ammonium salts such as tributylbenzylammonium 1-hydroxy-4-naphthoslulfonate and tetrabutylammonium teterafluoroborate, and analogues of these, i.e., onium salts such as phosphonium salts, and lake pigments of these, triphenylmethane dyes and lake pigments of these (laking agents include tungstophosphoric acid, molybdophosphoric acid, tungstomolybdophosphoric acid, tannic acid, lauric acid, gallic acid, ferricyanic acid and ferrocyanic acid), and metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate; guanidine compounds, and imidazole compounds. Any of these may be used alone or in a combination of two or more kinds.

Of these, triphenylmethane compounds and quaternary ammonium salts whose counter ions are not halogens may preferably be used. Homopolymers of monomers represented by the following Formula (5):

(5)

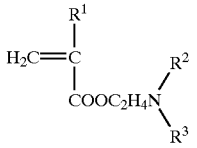

wherein $R^1$ represents H or $CH_3$; $R^2$ and $R^3$ each represent a substituted or unsubstituted alkyl group (preferably having 1 to 4 carbon atoms);

or copolymers of polymerizable monomers such as styrene, acrylates or methacrylates as described above may also be used as positive charge control agents. In this case, these charge control agents can also act as binder resins (as a whole or in part).

In particular, a triphenylmethane compound represented by the following Formula (6) is preferred in the constitution of the present invention.

(6)

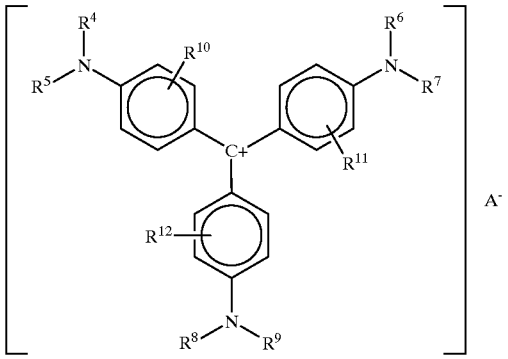

In the formula, $R^4$, $R^5$, $R^6$, $R^7$, $R^8$ and $R^9$ may be the same or different from one another and each represent a substituent selected from the group consisting of a hydrogen atom, a substituted or unsubstituted alkyl group and a substituted or unsubstituted aryl group; $R^{10}$, $R^{11}$ and $R^{12}$ may be the same or different from one another and each represent a hydrogen atom, a halogen atom, an alkyl group or an alkoxyl group; and $A^-$ represents an anion selected from the group consisting of a sulfate ion, a nitrate ion, a borate ion, a phosphate ion, a hydroxide ion, an organic sulfate ion, an organic sulfonate ion, an organic phosphate ion, a carboxylate ion, an organic borate ion and a tetrafluoroborate ion.

A charge control agent capable of controlling the toner to be negatively chargeable includes the following materials.

For example, organic metal complex salts and chelate compounds are effective, including monoazo metal compounds, acetylacetone metal compounds, aromatic hydroxycarboxylic acid metal compounds and aromatic dicarboxylic acid metal compounds, and besides, including aromatic hydroxycarboxylic acids, aromatic mono- and polycarboxylic acids, and anhydrides or esters thereof, and phenol derivatives such as bisphenol.

Azo type metal compounds represented by the following Formula (7) are preferred.

(7)

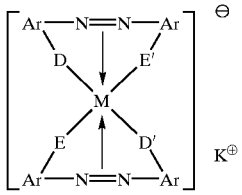

In the formula, M represents a central metal of coordination, as exemplified by Sc, Ti, V, Cr, Co, Ni, Mn or Fe; Ar represents an aryl group such as a phenyl group or a naphthyl group, which may have a substituent selected from the group consisting of a nitro group, a halogen atom, a carboxyl group, a $C_6H_5NHCO$— group, and an alkyl group or alkoxyl group having 1 to 18 carbon atoms; D, D', E and E'each represent —O—, —CO—, —NH— or —$NR^{13}$— ($R^{13}$ is an alkyl group having 1 to 4 carbon atoms); and $K^+$ represents a hydrogen ion, a sodium ion, a potassium ion, an ammonium ion or an aliphatic ammonium ion.

As the central metal, Fe or Cr is particularly preferred. As the substituent the aryl group may have, a halogen atom, an alkyl group or a $C_6H_5NHCO$— group is preferred. A mixture of complexes having different counter ions may also preferably be used.

Basic organic acid metal compounds represented by the following Formula (8) are also capable of imparting negative chargeability, and may be used in the present invention.

(8)

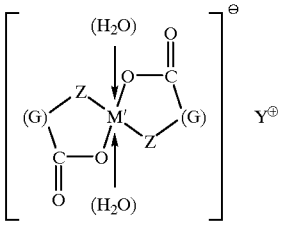

In the formula, MI represents a central metal of coordination, and is Cr, Co, Ni, Mn, Fe, Zn, Al, Si or B; G is any one of the following Formulas (9); $Y^+$ represents a hydrogen ion, a sodium ion, a potassium ion, an ammonium ion, an aliphatic ammonium or nothing; and Z represents —O— or —COO—:

Formulas (9)

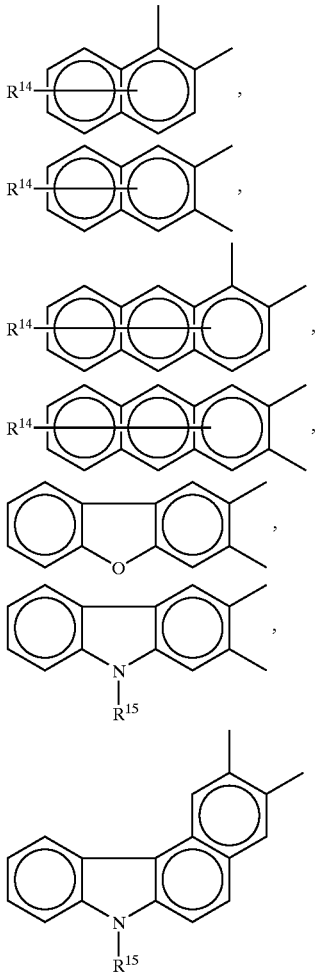

In the formulas, $R^{14}$ represents a hydrogen atom, a halogen atom, a nitro group or an alkyl group; $R^{15}$ represents a hydrogen atom, or an alkyl group or alkenyl group having 1 to 18 carbon atoms).

As the central metal, Fe, Cr, Si, Zn or Al is particularly preferred. As the substituent, an alkyl group, a $C_6H_5NHCO$— group, an aryl group or a halogen atom is preferred. As the counter ion, a hydrogen ion, an ammonium ion or an aliphatic ammonium ion is preferred.

As methods for making toner particles hold the charge control agent, there are a method of internally adding it to the toner particles and a method of externally adding it to the toner particles. Either may be used in the present invention. The amount of the charge control agent used depends on the type of the binder resin, the presence of any other additives, and the manner by which the toner is produced, including the manner of dispersion, and can not be sweepingly specified. Preferably, the charge control agent may be used in an amount ranging from 0.1 to 10 parts by weight, and more preferably from 0.5 to 5 parts by weight, based on 100 parts by weight of the binder resin.

In the present invention, the toner also contains a wax for the purpose of improving its releasability at the time of fixing. Such a wax may include, e.g., aliphatic hydrocarbon waxes such as low-molecular weight polyethylene, low-molecular weight polypropylene, microcrystalline wax and paraffin wax; oxides of aliphatic hydrocarbon waxes, such as polyethylene oxide wax, or block copolymers thereof; waxes composed chiefly of fatty acid esters, such as carnauba wax, sasol wax and montanic acid ester wax; and those obtained by deoxidizing fatty acid esters in part or whole, such as deoxidized carnauba wax. It may further include saturated straight-chain fatty acids such as palmitic acid, stearic acid, montanic acid and also long-chain alkylcarboxylic acids having long-chain alkyl groups; unsaturated fatty acids such as brassidic acid, eleostearic acid and parinaric acid; saturated alcohols such as stearyl alcohol, aralkyl alcohols, behenyl alcohol, carnaubic alcohol, seryl alcohol, mesyl alcohol, and long-chain alkyl alcohols having long-chain alkyl groups; polyhydric alcohols such as sorbitol; fatty acid amides such as linolic acid amide, oleic acid amide and lauric acid amide; saturated fatty acid bisamides such as methylene bisstearic acid amide, ethylene biscapric acid amide, ethylene bislauric acid amide and hexamethylene bisstearic acid amide; unsaturated fatty acid amides such as ethylene bisoleic acid amide, hexamethylene bisoleic acid amide, N,N'-dioleyladipic acid amide and N,N'-dioleylsebacic acid amide; aromatic bisamides such as m-xylene bisstearic acid amide and N,N'-distearylisophthalic acid amide; fatty acid metal salts (those commonly called metallic soap) such as calcium stearate, calcium laurate, zinc stearate and magnesium stearate; waxes obtained by grafting vinyl monomers such as styrene and acrylic acid onto aliphatic hydrocarbon waxes; partially esterified products of fatty acids such as behenic monoglyceride with polyhydric alcohols; and methyl ester compounds having hydroxyl groups, obtained by, e.g., hydrogenation of vegetable fats and oils.

Waxes preferably usable may include alkylene polymers obtained by thermal decomposition of low-molecular weight alkylene polymers formed by radical polymerization of alkylenes under a high pressure or polymerization thereof in the presence of a Ziegler catalyst or any other catalyst; alkylene polymers obtained by thermal decomposition of high-molecular weight alkylene polymers; those obtained by separation and purification of low-molecular weight alkylene polymers formed as by-products when alkylene polymers are polymerized; and waxes obtained by extraction and fractionation of specific components from distillation residues of polymethylene hydrocarbons obtained by the Arge process from synthetic gases comprised of carbon monoxide and hydrogen, or from synthetic hydrocarbons obtained by hydrogenation of these. An antioxidant may also be added to these waxes. The wax may also include straight-chain alcohols, fatty acids, acid amides, esters or montan type derivatives. Those from which impurities such as fatty acids have been removed are also preferred.

Particularly preferred are those obtained by polymerization of olefins such as ethylene, by-products from the polymerization, and those composed basically of hydrocarbons having up to thousands of carbon atoms, such as Fischer-Tropsch wax. Long-chain alkyl alcohols terminated with hydroxyl groups, having up to hundreds of carbon atoms are also preferred. Still also, alcohols to which alkylene oxide has been added may preferably be used.

From these waxes, waxes may further be fractionated according to molecular weight by press sweating, solvent fractionation, vacuum distillation, ultracritical gas extraction or fractionation recrystallization (e.g., molten liquid crystallization and crystal filtration) to have a sharp molecular weight distribution. Such waxes are more preferred because components having necessary melt behavior ranges can be held in a larger proportion.

In the present invention, any of these waxes or compounds may be used alone or in a combination of two or more types, and may be used in an amount of from 0.1 to 20 parts by weight, and preferably from 0.5 to 10 parts by weight.

The wax may have in its molecular weight distribution a main peak in the region of molecular weight of from 400 to 10,000, and preferably from 700 to 5,000. The wax having such a molecular weight distribution can endow the toner with preferable thermal properties.

The wax may also have, at the time of heating in differential thermal analysis, at least one endothermic peak in the region of from 60° C. to 150° C., and preferably from 75° C. to 140° C. This brings about a more improvement in fixing performance and transfer performance and also a suitable gloss on images.

As to the endothermic peak at the time of heating in differential thermal analysis, the wax can be effective as long as it has at least one peak. It may simultaneously have, at the time of heating, an endothermic peak in a region beyond 150° C. It may also have, at the time of heating, a plurality of endothermic peaks in the region of from 60° C. to 150° C. It, however, is not a preferable case that the endothermic peak at the time of heating is present in a region lower than 60° C., because images tend to be formed at a low density and the toner is liable to become unstable during its storage.

As methods for incorporating the wax in toner particles, available are a method in which the binder resin is dissolved in a solvent, the binder resin solution temperature is made higher and the wax is added and mixed with stirring, and a method in which the wax is mixed at the time of kneading.

In the case when the toner in the present invention employs as the binder resin a styrene copolymer, in order that the effect attributable to the wax can sufficiently be exhibited and also the toner can be prevented from lowering in storage stability and developing performance, the wax may preferably have a molecular weight distribution as shown below.

In the molecular weight distribution of toner as measured by GPC (gel permeation chromatography), the toner may have at least one peak (P1) present in the region of molecular weight of from 3,000 to 50,000, preferably in the region of molecular weight of from 3,000 to 30,000, and particularly preferably in the region of molecular weight of from 5,000 to 20,000. This can make the toner have good fixing performance, developing performance and anti-blocking properties. If the toner has no peak in the region of molecular weight of from 3,000 to 50,000 and has a peak in the region of molecular weight less than 3,000, it may have no good anti-blocking properties. If it has a peak in the region of molecular weight more than 50,000, it may have no good fixing performance. Also, the toner may particularly preferably have at least one peak (P2) present in the region of molecular weight of from 300,000 to 5,000,000 and has a maximum peak present in the region of molecular weight of 100,000 or more in the region of molecular weight of from 300,000 to 2,000,000. This makes it possible to obtain a toner having good high-temperature anti-offset properties, anti-blocking properties and developing performance. The larger this peak molecular weight is, the stronger the toner can be against high-temperature offset. Where, however, the peak is present in the region of molecular weight of 5,000,000 or more, there is no problem in the case of a heat roll to which a pressure can be applied, but, in the case where no pressure is applied, the toner may have so large an elasticity as to affect its fixing performance. Accordingly, in heat fixing carried out at a relatively low pressure, it is preferable that a peak is present in the region of molecular weight of from 300,000 to 2,000,000 and this peak is the maximum peak in the region of molecular weight of 100,000 or more.

It is also preferable to use a toner having at least 50%, preferably from 60% to 90%, and particularly preferably from 65% to 85%, of a component present in the region of molecular weight not more than 100,000. As long as the toner has such a component within this range, it shows a good fixing performance. If this component is less than 50%, the toner tends not only to have no sufficient fixing performance but also to be inferior in its pulverizing properties when produced. If this component is more than 90%, the toner may have a poor anti-offset properties.

In the case when the polyester resin is used, the toner may preferably have, in its molecular weight distribution as measured by GPC, a main peak present in the region of molecular weight of from 3,000 to 15,000, preferably in the region of molecular weight of from 4,000 to 12,000, and particularly preferably in the region of molecular weight of from 5,000 to 10,000. In addition, the toner may preferably have at least one peak or shoulder in the region of molecular weight of 15,000 or more, or at least 5% of the region of molecular weight of 50,000 or more. It may also preferably have a ratio of weight-average molecular weight (Mw) to number-average molecular weight (Mn), Mw/Mn, of 10 or more.

If the toner has the main peak in the region of molecular weight less than 3,000, it tends to have low anti-blocking properties and developing performance. If the toner has the main peak in the region of molecular weight more than 15,000, it may have no good fixing performance. The toner can have good anti-offset properties when it has the peak or shoulder in the region of molecular weight of 15,000 or more, at least 5% of the region of molecular weight of 50,000 or more, and Mw/Mn of 10 or more.

For the purpose of improving high transfer performance, charge stability, developing performance, fluidity and running performance, an inorganic fine powder may preferably be added to the toner in the present invention.

As the inorganic fine powder, any known material may be used, and may preferably be selected from fine powders of silica, aluminum oxide and titanium oxide, or double oxides thereof. In particular, fine silica powder is especially preferred. For example, such fine silica powder includes what is called dry-process silica or fumed silica produced by vapor phase roxidation of silicon halides or alkoxides and what is called wet-process silica produced from alkoxide or water glass, either of which may be used. The dry-process silica is more preferred because of less silanol groups on the surface and inside of the fine silica powder and less production residues such as $Na_2O$ and $SO_3^{2-}$.

In the dry-process silica, it is also possible to use, in its production step, other metal halide compound such as aluminum chloride or titanium chloride together with the silicon halide to give a composite fine powder of silica with other metal oxide. The fine silica powder includes these, too.

The inorganic fine powder used in the present invention may have a BET specific surface area of 30 $m^2/g$ or more, and particularly in the range of from 50 to 400 $m^2/g$, as measured by nitrogen adsorption according to the BET method. Such a powder is preferred because it can provide good results. Also, the inorganic fine powder may be contained in an amount of from 0.1 to 8 parts by weight, preferably from 0.5 to 5 parts by weight, and more preferably from 1 to 3 parts by weight, based on 100 parts by weight of the toner.

For the purpose of imparting hydrophobicity and controlling of chargeability, the inorganic fine powder used in the present invention may be treated with a treating agent such as a silicone varnish (including various modified silicone varnishes), a silicone oil (including various modified silicone oils), a silane coupling agent, a silane coupling agent having functional groups, or other organosilicon compound or organotitanium compound, or with various treating agents used in combination. Such an inorganic fine powder is preferred.

The treatment with silicone oil may be made by a method in which, e.g., the fine silica powder treated with a silane coupling agent and the silicone oil are directly mixed by means of a mixing machine such as a Henschel mixer, or the silicone oil is sprayed on the fine silica powder serving as a base. Alternatively, the silicone oil may be dissolved or dispersed in a suitable solvent and thereafter the fine silica powder may be added and mixed, followed by removal of the solvent.

After the treatment, the inorganic fine powder may preferably be heated to 200° C. or above (more preferably 250° C. or above) in an inert gas to stabilize surface coatings.

In the toner according to the present invention, other additives may also optionally be used, which may include lubricant powders as exemplified by Teflon powder, zinc stearate powder and polyvinylidene fluoride powder; abrasives as exemplified by cerium oxide powder, silicon carbide powder and strontium titanate powder; fluidity-providing agents as exemplified by titanium oxide powder and aluminum oxide powder; anti-caking agents; and conductivity-providing agents as exemplified by carbon black powder, zinc oxide powder and tin oxide powder. Reverse-polarity organic fine particles and inorganic fine particle may also be used in a small quantity as a developability improver.

The toner according to the present invention may be used in combination with a suitable carrier so as to be used as a two-component developer. As the carrier (carrier particles) used when the toner is used in two-component development, carrier particles conventionally known are all usable. Stated specifically, the carrier may include particles of iron, nickel, cobalt, manganese, chromium and rare earth elements and alloys or oxides thereof, which have been surface-oxidized or unoxidized. The carrier may preferably have an average particle diameter of from 20 to 300 $\mu$m.

A coated carrier comprising any of these carrier particles onto the surfaces of which a resin such as a styrene resin, an acrylic resin, a silicone resin, a fluorine resin or a polyester resin has been applied may preferably be used.

The toner according to the present invention may also be incorporated with a magnetic material so that it can be used as a magnetic toner. In this case, the magnetic material may also serve as the colorant. In the present invention, the magnetic material contained in the magnetic toner may include iron oxides such as magnetite, hematite and ferrite; metals such as iron, cobalt and nickel, or alloys of any of these metals with aluminum, cobalt, copper, lead, magnesium, tin, zinc, antimony, beryllium, bismuth, cadmium, calcium, manganese, selenium, titanium, tungsten or vanadium, and mixtures of any of these.

These magnetic materials may preferably be those having a number-average particle diameter of 2 $\mu$m or less, and preferably from about 0.1 to 0.5 $\mu$m. The magnetic materials may be incorporated in the toner in an amount of from 20 to 200 parts by weight based on 100 parts by weight of the binder resin, and particularly preferably from 40 to 150 parts by weight based on 100 parts by weight of the binder resin.

The number-average particle diameter may be determined by measuring particle diameters by means of a digitizer, on a photograph taken under magnification and projection using a transmission electron microscope.

Colorants usable in the toner according to the present invention may include any suitable dyes. Such colorants of the toner may include carbon black, aniline black, acetylene black, Naphthol Yellow, Hanza Yellow, Rhodamine Lake, Alizarine Lake, red iron oxide, Phthalocyanine Blue and Indanethrene Blue. Any of these may be used in a quantity necessary and sufficient for maintaining optical density of fixed images, and may be used in an amount of from 0.1 to 20 parts by weight, and preferably from 0.2 to 10 parts by weight, based on 100 parts by weight of the binder resin. For the same purpose, dyes may also be used. Such dyes may include, e.g., azo dyes, anthraquinone dyes, xanthene dyes and methine dyes, which may each be used in an amount of from 0.1 to 20 parts by weight, and preferably from 0.3 to 10 parts by weight, based on 100 parts by weight of the binder resin.

To produce the toner for developing electrostatic latent images according to the present invention, the above binder resin, charge control agent and wax and optionally the pigment or dye as the colorant, the magnetic material and other additives are thoroughly mixed using a mixing machine such as a Henschel mixer or a ball mill, and then the mixture formed is melt-kneaded by means of a heat kneading machine such as a heating roll, a kneader or an extruder to compatibilize the resins, into which the metal compound, the pigment, the dye and the magnetic material are dispersed or dissolved, followed by cooling for solidification and thereafter pulverization and classification. Thus the toner according to the present invention can be obtained.

As other method for obtaining the toner according to the present invention, the toner may be produced by polymerization, e.g., suspension polymerization. Such a suspension polymerization toner is obtained in the following way. The polymerizable monomer, the wax and the charge control agent, and optionally the pigment or dye, the magnetic iron oxide and the polymerization initiator (also optionally the cross-linking agent and other additives) are uniformly dissolved or dispersed to form a monomer composition. Thereafter, this monomer composition is dispersed in a continuous phase (e.g., water) containing a dispersion stabilizer by means of a suitable stirrer, simultaneously carrying out polymerization reaction to produce toner particles having the desired particle diameters.

As the polymerizable monomer used in such suspension polymerization, the monomers constituting the binder resin as described previously are usable.

In order to improve fluidity and charging stability, any desired additives may optionally be well mixed by means of a mixing machine such as a Henschel mixer to produce the toner according to the present invention.

The toner according to the present invention has a weight-average particle diameter of from 3 to 11 μm, and preferably from 5 to 10 μm. If it has a weight-average particle diameter larger than 11 μm, the toner may have an insufficient charge quantity necessary for the development in the developing step, so that only toner having a small particle diameter, showing a relatively high charge quantity on the toner-carrying member, tends to participate selectively in the development. In such a case, the toner on the toner-carrying member may come to have rough particle diameters with repetitive development on many sheets to further come to have a smaller charge quantity, so that image density tends to decrease because of under development. If on the other hand the toner has a weight-average particle diameter smaller than 3 μm, it may have a charge quantity in so excess as to make the mirror force between the toner and the toner-carrying member excessively large. Hence, it becomes difficult for the toner to move to the light-receiving member in the developing step, also tending to cause a decrease in image density.

(5) Measurement of Physical Properties Relating to Toner:

Physical properties relating to the toner according to the present invention are measured by the following methods. Physical properties relating to toners in Examples given later can be measured by these methods.

1) Measurement of Tg (Glass Transition Temperature)

The Tg (glass transition temperature) is measured according to ASTM D3418-82, using a differential scanning calorimeter (DSC measuring device) DSC-7 (manufactured by Perkin Elmer Co.).

A sample for measurement is precisely weighed in an amount of from 5 to 20 mg, preferably 10 mg. This sample is put in a pan made of aluminum and an empty pan made of aluminum is set as reference. Measurement is made in an environment of normal temperature/normal humidity at a heating rate of 10° C./min within the measuring temperature range of from 30° C. to 200° C. In the course of this heating, an endothermic peak at the time of heating in the temperature range of from 40° C. to 100° C. is obtained. The point at which the line at a middle point of the base lines before and after appearance of the main endothermic peak obtained here and the differential thermal curve intersect is regarded as the glass transition point Tg (glass transition temperature) in the present invention.

2) Measurement of Molecular Weight Distributions of Binder Resin and Toner

Molecular weight distribution on chromatograms obtained by GPC from the binder resin and toner is measured under the following conditions.

Columns are stabilized in a heat chamber of 40° C. To the columns kept at this temperature, THF (tetrahydrofuran) as a solvent is flowed at a flow rate of 1 ml per minute, and about 100 μl of THF sample solution is injected thereinto to make measurement. In measuring the molecular weight of the sample, the molecular weight distribution ascribed to the sample is calculated from the relationship between the logarithmic value and the count number of a calibration curve prepared using several kinds of monodisperse polystyrene standard samples.

As the standard polystyrene samples used for the preparation of the calibration curve, it is suitable to use samples with molecular weights of from 100 to 10,000,000, which are available from Showa Denko K. K. or Toso Co., Ltd., and to use at least about 10 standard polystyrene samples.

An RI (refractive index) detector is used as a detector. Columns should be used in a combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K. K.; or a combination of TSKgel G1000H($H_{XL}$), G2000H($H_{XL}$), G3000H($H_{XL}$), G4000H($H_{XL}$), G5000H ($H_{XL}$), G6000H($H_{XL}$) G7000OH($H_{XL}$) and TSK guard column, available from Toso Co., Ltd.

The sample is prepared in the following way.

A sample is put in THF, then left standing for several hours, followed by thorough shaking to well mix the sample with THF (until no coalesced sample comes to be seen), and the mixture is left standing still for at least 12 hours. Here, the time the mixture is left standing in THF is set to be at least 24 hours. Thereafter, the mixture is passed through a sample-treating filter (pore size: 0.45 to 0.5 μm; for example, MAISHORIDISK H-25-5, available from Toso Co., Ltd., or EKIKURODISK 25CR, available from German Science Japan, Ltd., may be used). The solution obtained is used as the sample for GPC. The concentration of the polyester resin is controlled to be 0.5 to 5 mg/ml as binder resin component.

3) Measurement of THF-Insoluble Matter

THF-insoluble matter is measured under the following conditions.

A toner sample is weighed, then put in a cylindrical filter paper (e.g., No. 86R of 28×10 mm in size, available from Toyo Roshi K. K.) and set on a Soxhlet extractor. Extraction is conducted for 6 hours using 200 ml of toluene as a solvent. Here, the extraction is conducted at such a reflux rate that the extraction cycle with THF is roughly once every 4 to 5 minutes. After the extraction is completed, the cylindrical filter paper is taken out and weighed to measure the insoluble matter.

In the case when the toner contains THF-insoluble matter such as the magnetic material or pigment other than the binder resin component, the weight of the toner put in the cylindrical filter paper is represented by $W_1$ g, the weight of the THF-soluble resin component by $W_2$ g, and the weight of THF-insoluble matter other than the resin components contained in the toner by $W_3$ g. Thus, the content of the THF-insoluble matter of the resin component in the toner is determined from the following expression.

$$\text{Toluene-insoluble matter } (wt.\ \%)=[\{(W_1-(W_3+W_2)\}/(W_1-W_3)]\times 100$$

4) Molecular Weight Distribution of Wax

The molecular weight distribution of the wax is measured by GPC under the following conditions.

Apparatus: GPC-150C (Waters Co.)

Column: GMH-HT 30 cm, combination of two columns (available from Toso Co., Ltd.)

Temperature: 135° C.

Solvent: o-Dichlorobenzene (0.1% mmol-added)

Flow rate: 1.0 ml/min

Sample: 0.4 ml of 0.15% sample is injected.

Measurement is carried out under the conditions as shown above. The molecular weight of the sample is calculated using a molecular weight calibration curve prepared from a monodisperse polystyrene standard sample. The calculated values are further converted to a polyethylene basis according to a conversion expression derived from the Mark-Houwink viscosity equation.

5) Endothermic Peak at the Time of Heating of Wax

The endothermic peak at the time of heating of the wax is measured according to ASTM D3418-82, using a differential scanning calorimeter (DSC measuring device) DSC-7 (manufactured by Perkin Elmer Co.).

A sample for measurement is precisely weighed in an amount of from 5 to 10 mg, preferably 5 mg. This sample is put in a pan made of aluminum and an empty pan made of aluminum is set as reference. Measurement is made in an environment of normal temperature/normal humidity at a rate of heating of 10° C./min within the measuring temperature range of from 30° C. to 200° C. In the course of this heating, an endothermic peak of the DSC curve in the temperature range of from 30° C. to 200° C. appears.

6) Weight-Average Particle Diameter of Toner

The weight-average particle diameter of the toner is measured using a measuring device COULTER MULTISIZER (manufactured by Coulter Electronics, Inc.). As an electrolytic solution, an aqueous to 1% NaCl solution is prepared using special-grade or first-grade sodium chloride. For example, ISOTON R-II (manufactured by Coulter Scientific Japan Co.) may be used. Measurement is made by adding as a dispersant 0.1 to 5 ml of a surface active agent, preferably an alkylbenzene sulfonate, to 100 to 150 ml of the above aqueous electrolytic solution, and further adding 2 to 20 mg of a sample to be measured. The electrolytic solution in which the sample has been suspended is subjected to dispersion for about 1 minute to about 3 minutes in an ultrasonic dispersion machine. The volume distribution and number distribution of the toner are calculated by measuring the volume and number of toner particles, using an aperture of 100 p.m. Then the weight-average particle diameter is determined from the volume distribution (the middle value of each channel is used as the representative value for each channel).

EXPERIMENTS

The present invention will be described in greater detail by giving various Experiments.

Experiment 1

Using the film-forming system as described above, light-receiving members having the a-Si photosensitive layer (photoconductive layer) were produced as electrophotographic photosensitive members. Changing substrate surface configuration and individual parameters of production conditions, light-receiving members 1A to 1L varied in microscopic surface roughness Ra and macroscopic surface roughness Rz were produced.

For each light-receiving member, the microscopic surface roughness Ra was measured with an AFM in the range of 10 $\mu$m×10 $\mu$m and the macroscopic surface roughness Rz with a contact-type surface profile analyzer, and also image evaluation was made, to obtain the results shown in Table 1.

Here, the macroscopic surface roughness Rz in the present invention is surface roughness measured with a contact-type surface profile analyzer SURFCOADER SE-3400, manufactured by K. K. Kosaka Kenkyusho, in a measuring length of 1.25 mm.

The image evaluation was made on 1,000,000-sheet paper feed running, using a remodeled machine of an electrophotographic apparatus NP6350, manufactured by CANON INC., and toner adhesion proofness was evaluated here.

Letter symbols in Table 1 indicate that;

A: Excellent; B: Average; and C: Poor.

As can be seen from the results shown in Table 1, no correlation was found between the conventional macroscopic surface roughness Rz and the toner adhesion proofness.

Experiment 2

Next, using the above film-forming system and changing individual parameters of production conditions, light-receiving members 2A to 2L varied in microscopic surface roughness Ra and each having an interface between the surface protective layer and the photosensitive layer were produced, and light-receiving members 2Q and 2R were produced in the same way but being made to have no interface between these layers. As conductive substrates, cylindrical substrates made of aluminum having a purity of 99.9% or higher were used, and their surfaces were mirror-finished by cutting to provide a substrate-surface microscopic surface roughness Ra of less than 6 nm uniformly.

For each of the light-receiving members 2A to 2L, 2Q and 2R, the microscopic surface roughness Ra was measured with the AFM in the range of 10 $\mu$m×10 $\mu$m and the macroscopic surface roughness Rz with the contact-type surface profile analyzer, and also image evaluation was made, to obtain the results shown in Table 2.

The image evaluation was made on 1,000,000-sheet paper feed running, using a remodeled machine of an electrophotographic apparatus NP6350, manufactured by CANON INC., and toner adhesion proofness, cleanability and digital-image sharpness were evaluated.

Letter symbols in Table 2 indicate that;

A: Excellent; B: Average; and C: Poor.

As can be seen from the results shown in Table 2, good results were obtained both in the evaluation of toner adhesion proofness and that of cleanability in the case of light-receiving members having the microscopic surface roughness Ra in the range of from 15 nm to 100 nm.

In the case of light-receiving members having a microscopic surface roughness Ra of from 20 nm to 80 nm, very good results were obtained in all the evaluation of toner adhesion proofness, cleanability and digital-image sharpness. Also, making the above layers have no interface between them brought about a broader range for the toner adhesion proofness or image sharpness.

Experiment 3

Next, using the above film-forming system and changing individual parameters of production conditions, light-receiving members 3A to 3P varied in microscopic surface roughness Ra and each having an interface between the surface protective layer and the photosensitive layer were produced, and light-receiving members 3Q and 3R were produced in the same way but being made to have no interface between these layers. As conductive substrates, cylindrical substrates made of aluminum having a purity of 99.9% or higher were used, and their surfaces were mirror-finished by cutting to provide a substrate-surface microscopic surface roughness Ra of less than 6 nm uniformly.

For each of the light-receiving members 3A to 3P, 3Q and 3R, the microscopic surface roughness Ra was measured with the AFM in the range of 10 μm×10 μm and the macroscopic surface roughness Rz with the contact-type surface profile analyzer, and also the surface free energy was measured in the manner as described previously and image evaluation was made, to obtain the results shown in Table 3.

The image evaluation was made on 1,000,000-sheet paper feed running, using a remodeled machine of an electrophotographic apparatus NP6350, manufactured by CANON INC., and toner adhesion proofness, cleanability and digital-image sharpness were evaluated.

Letter symbols in Table 3 indicate that;

A: Excellent; B: Average; and C: Poor.

As can be seen from the results shown in Table 3, in the case of light-receiving members having a microscopic surface roughness Ra of from 20 nm to 80 nm and having a surface free energy of from 35 mN/m to 47 mN/m, very good results were obtained in all the evaluation of toner adhesion proofness, cleanability and digital-image sharpness. Also, making the above layers have no interface between them brought about a broader range where good evaluation results were obtainable on the toner adhesion proofness or image sharpness.

Experiment 4

Next, using conductive substrates varied in substrate-surface microscopic surface roughness Ra measured with the AFM in the range of 10 μm×10 μm, light-receiving members 4A to 4F were produced. As the conductive substrates, cylindrical substrates made of aluminum having a purity of 99.9% or higher were used. As for the surface roughness of the light-receiving members themselves, they were all in a microscopic surface roughness Ra of about 38 nm.

For each of the light-receiving members 4A to 4F, the microscopic surface roughness Ra of the conductive substrate was measured and image evaluation was made, to obtain the results shown in Table 4.

The image evaluation was made on 1,000,000-sheet paper feed running, using a remodeled machine of an electrophotographic apparatus NP6350, manufactured by CANON INC., and spotty faulty images were examined. The spotty faulty images are meant to be black spots or white spots rarely appearing on printed images as a result of any local abnormal growth of films in the formation of photosensitive layers (photoconductive layers).

Letter symbols in Table 4 indicate that;

A: Very excellent; B: Excellent; C: Average; and D: Poor.

As can be seen from the results shown in Table 4, in the case of light-receiving members with conductive substrates having a microscopic surface roughness Ra of less than 6 nm, no spotty faulty images appeared and very good images were obtained.

EXAMPLES

The present invention is described below by giving Examples and Comparative Examples.

Examples I1 to I4 & Comparative Examples I1 to I3

Using the above film-forming system and changing substrate surface configuration and individual parameters of production conditions, light-receiving members (electrophotographic photosensitive members) varied in microscopic surface roughness Ra and macroscopic surface roughness Rz (Examples I1 to I4, Comparative Examples I1 to I3) were produced.

For each of the photosensitive members of Examples I1 to I4 and Comparative Examples I1 to I3, the microscopic surface roughness Ra was measured with the AFM in the range of 10 μm×10 μm and the macroscopic surface roughness Rz of the conductive substrates and the surface free energy were measured, and also image evaluation was made, to obtain the results shown in Table 5.

Figure 15:
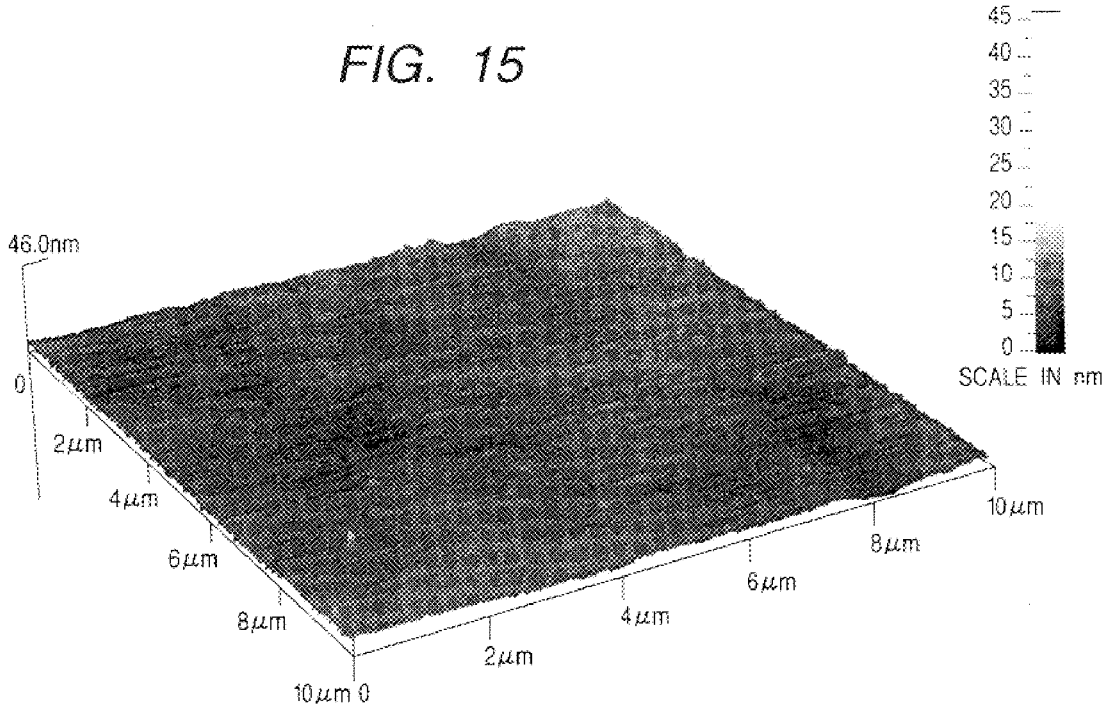
FIGS. 15, 16 and 17 are each an example of an image observed with an atomic force microscope.
Figure 16:
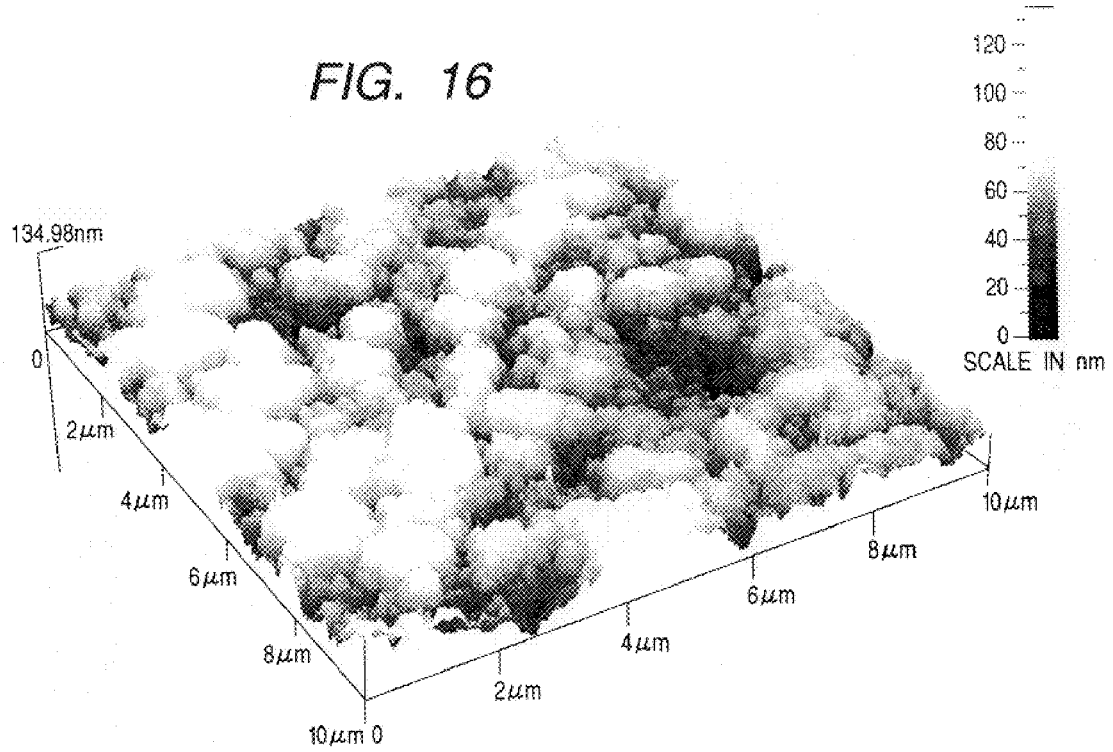
Figure 17:
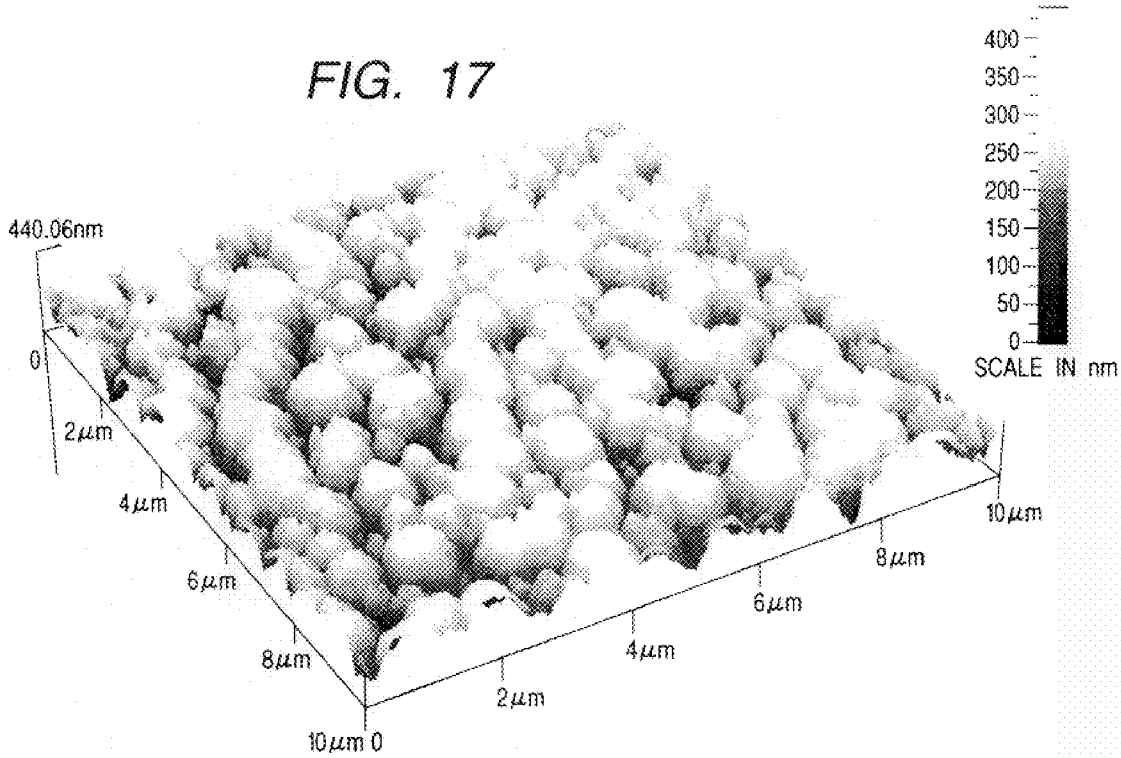

Also shown in FIGS. 15, 16 and 17 are an image of microscopic surface roughness of the conductive substrate used in Example I1, measured with the AFM in the range of 10 μm×10 μm; an image of microscopic surface roughness of the photosensitive member used in Comparative Example I1, measured with the AFM in the range of 10 μm×10 μm; and an image of microscopic surface roughness of the photosensitive member used in Example I1, measured with the AFM in the range of 10 μm×10 μm; respectively.

The image evaluation was made on 1,000,000-sheet paper feed running, using a remodeled machine of an electrophotographic apparatus NP6350, manufactured by CANON INC., and toner adhesion proofness, cleanability and digital-image sharpness were evaluated, and overall evaluation was made on the basis of the results obtained. Here, in Example I2 and Comparative Example I2, the evaluation was made on analog images, using a remodeled machine of CANON NP6350.

Letter symbols in Table 5 indicate that;

A: Excellent; B: Average; and C: Poor.

Example II1

Using the film-forming system shown in FIG. 13, a lower-part blocking layer, a photoconductive layer (photosensitive layer) and a surface protective layer were superposingly formed in order on each conductive substrate cylindrical aluminum substrate under conditions shown below. Thus, light-receiving members (II1a) to (II1e) were completed.

(1) Lower-Part Blocking Layer

| (1) Lower-part blocking layer | |
|---|---|
| $SiH_4$: | 200 ml/min |
| $H_2$: | 500 ml/min |
| NO: | 5 ml/min |
| $B_2H_6$: | 2,000 ppm (based on $SiH_4$) |
| Power: | 150 W |
| Internal pressure: | 80 Pa |
| Substrate temperature: | 200° C. |
| Layer thickness: | 1.5 μm |
| (2) Photoconductive layer (photosensitive layer) | |
| $SiH_4$: | 510 ml/min |
| $H_2$: | 450 ml/min |
| Power: | 450 W |
| Internal pressure: | 73 Pa |
| Substrate temperature: | 200° C. |
| Layer thickness: | 20 μm |

-continued

| (3) Surface protective layer | |
|---|---|
| $CH_4$: | 200 ml/min |
| Power: | 1,000 W |
| Internal pressure: | 67 Pa |
| Substrate temperature: | 200° C. |
| Layer thickness: | 0.5 μm |

A light-receiving member (II1f) having no interface between the photoconductive layer and the surface protective layer was also produced in the same manner as the above except that a change layer was superposingly formed between the photoconductive layer and the surface protective layer under the following conditions.

| | |
|---|---|
| $SiH_4$: | 510 → 0 ml/min |
| $H_2$: | 450 → 0 ml/min |
| $CH_4$: | 0 → 200 ml/min |
| Power: | 450 → 1,000 W |
| Internal pressure: | 73 → 67 Pa |
| Substrate temperature: | 200° C. |
| Layer thickness: | 0.1 μm |

A light-receiving member (II1g) was also produced the photoconductive layer of which was functionally separated into a charge transport layer and a charge generation layer and also on the charge generation layer of which a change layer was provided to make the light-receiving member have no interface between the photoconductive layer and the surface protective layer. In the light-receiving member (II1g), the layers were superposed in the order of the lower-part blocking layer, charge transport layer, charge generation layer, change layer and surface protective layer. The charge transport layer and charge generation layer were formed under the following conditions. The lower-part blocking layer and surface protective layer were formed under the same conditions as those for the light-receiving members (II1a) to (II1e). The change layer was formed under the same conditions as those for the light-receiving member (II1f).

Charge Transport Layer

| Charge transport layer | |
|---|---|
| $SiH_4$: | 200 ml/min |
| $H_2$: | 500 ml/min |
| $CH_4$: | 50 ml/min |
| $B_2H_6$: | 1 ppm (based on $SiH_4$) |
| Power: | 450 W |
| Internal pressure: | 73 Pa |
| Substrate temperature: | 200° C. |
| Layer thickness: | 20 μm |

-continued

| Charge generation layer | |
|---|---|
| $SiH_4$: | 510 ml/min |
| $H_2$: | 450 ml/min |
| Power: | 450 W |
| Internal pressure: | 73 Pa |
| Substrate temperature: | 200° C. |
| Layer thickness: | 2 μm |

Next, the above light-receiving members (II1a) to (II1g) were surface-etched (plasma etching) under conditions, and within the range, shown below, so as to be varied in surface roughness, among which, in the present Example, seven light-receiving members II1a to II1g having the surface roughness within the range of the present invention were thus produced. The microscopic surface roughness Ra in a reference length of 10 μm of each light-receiving member thus obtained was measured with the AFM (atomic force microscope). Results obtained are shown in Table 6. Also, on a mirror-polished silicon wafer, only the surface protective layer was deposited in a thickness of 1 μm under the same conditions as the above, to prepare a sample for measuring infrared absorption.

Etching Conditions

| | |
|---|---|
| $CF_4$: | 400 ml/min |
| Power: | 50 W to 2,000 W |
| Substrate temperature: | 200° C. |
| Pressure: | 50 Pa |

Production of Toner

The following materials were premixed, and thereafter the mixture was melt-kneaded by means of a twin-screw extruder set at 130° C.

| | (by weight) |
|---|---|
| Styrene/butyl acrylate/butyl maleate half ester copolymer (Tg: 60.1° C.) | 100 parts |
| Magnetite powder (number-average particle diameter: 0.2 μm) | 100 parts |
| Low-molecular weight polypropylene (differential thermal analysis endothermic peak: 135° C.; peak molecular weight: 3,500) | 4 parts |
| Azo iron comoplex compound represented by the following Formula (10) | 2 parts |

(10)

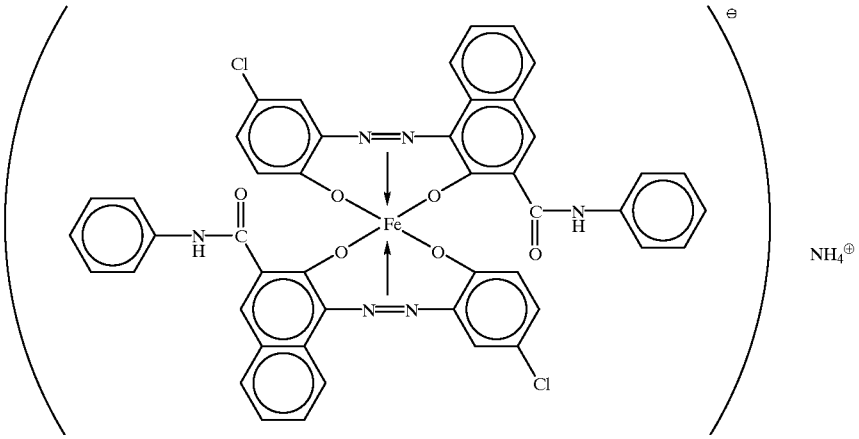

The kneaded product obtained was cooled, and thereafter the cooled product obtained was crushed, and then finely pulverized by means of a grinding mill making use of jet streams, further followed by classification by means of an air classifier. The classified product was further surface-treated by mechanical impact force to obtain a black powder, toner particles (1). In the toner particles (1), the THF-insoluble matter of the binder resin was 0% by weight.

In 100 parts by weight of the toner particles (1), 1.2 parts by weight of dry-process silica treated with hexamethyldisilazane and dimethylsilicone oil was mixed with stirring by means of a Henschel mixer to obtain a negatively chargeable toner (1). The negatively chargeable toner (1) thus obtained had a weight-average particle diameter of 7.8 $\mu$m and a peak molecular weight of 30,000.

The light-receiving members II1a to II1g produced as described above were used in combination with the above toner (1) to make 100,000-sheet image reproduction tests. As the result, good images were obtained in all instances where any light-receiving members were used. Evaluation was further made on the following. Results obtained are shown in Table 6.

Evaluation on Melt Adhesion

The light-receiving members II1a to II1g obtained as described above were each set in a remodeled machine of a copying machine NP6085 (photosensitive drum having a diameter of 108 mm), manufactured by CANON INC., having the construction shown in FIG. 1. The light-receiving member 101 was so controlled by the along-face inner-surface heater 123 as to have a surface temperature of 50° C. As an A4-size continuous paper feed running test, images were formed on 100,000 sheets under environmental conditions of 25° C. and 10% RH (relative humidity) and setting the movement speed of the light-receiving member 101 at 400 mm/sec to make evaluation on any melt adhesion of toner. Here, used as an original was a one-line chart on the white background of which one black line of 1 mm wide was printed in a stripe.

After the running was finished, the quantity of charge electric current of the primary charging assembly 102 was so controlled that the dark-area potential at the position of the developing assembly 104 was kept at 400 V. Then a solid white original 112 was placed on the original glass plate 111, and the voltage at which the halogen lamp 110 was lighted was so controlled that the light-area potential was kept at 50 V, where an A3-size solid white image was prepared. On this image, any black spots caused by the melt-adhesion of toner were observed and the light-receiving member surface was also observed by microscope.

Evaluation on the melt-adhesion is made by relative comparison assuming as 100 the rank of occurrence of melt-adhesion in Comparative Example II1 given later. Thus, it shows that, the smaller the numerical value is, the less the melt-adhesion has occurred and the better.

Evaluation on Filming

With regard to the light-receiving members on which the continuous A4-size 100,000-sheet paper feed running test was made under the conditions shown above, the layer thickness of each surface protective layer was measured with a reflection spectrometer. Next, aluminum powder of 100 $\mu$m in particle diameter was applied to a wet soft cloth, and the light-receiving member surface was gently rubbed ten times with it. As extent of this rubbing, the surface was rubbed at such a force that one made sure that the surface protective layer was not abraded when a virgin light-receiving member was rubbed. Thereafter, the layer thickness of each surface protective layer was again measured with the reflection spectrometer, and its difference was assumed to be the extent of filming.

Evaluation on the extent of filming is made by relative comparison assuming as 100 the extent of filming in Comparative Example II1 given later. Thus, it shows that, the smaller the numerical value is, the less the filming has occurred and the better.

Evaluation on the Extent of Abrasion

The layer thickness of each surface protective layer before the above 100,000-sheet paper feed running test was previously measured with the reflection spectrometer. From this layer thickness, the layer thickness of the surface protective layer after the removing of the above filming was subtracted to find a difference which was defined as the extent of abrasion.

Evaluation on the extent of abrasion is made by relative comparison assuming as 100 the extent of abrasion in Comparative Example II1 given later. Thus, it shows that, the smaller the numerical value is, the less the abrasion has occurred and the better.

Determination of Hydrogen Content

Using the surface protective layer sample formed on a silicon wafer, infrared absorption spectra were measured with an infrared spectrophotometer. Here, in-film hydrogen content was determined from the area of a C-Hn absorption peak appearing around 2,960 $cm^{-1}$ and the layer thickness.

Comparative Example II1

Using the film-forming system shown in FIG. 13, a lower-part blocking layer, a photoconductive layer (photosensitive layer) and a surface protective layer were superposingly formed in order on each cylindrical aluminum substrate in the same manner as in Example II1 but under conditions shown below. Thus, a light-receiving member (II1a) was completed.

| | |
|---|---|
| (1) Lower-part blocking layer | |
| $SiH_4$: | 200 ml/min |
| $H_2$: | 500 ml/min |
| NO: | 5 ml/min |
| $B_2H_6$: | 2,000 ppm |
| (based on $SiH_4$) | |
| Power: | 150 W |
| Internal pressure: | 80 Pa |
| Substrate temperature: | 200° C. |
| Layer thickness: | 1.5 μm |
| (2) Photoconductive layer (photosensitive layer) | |
| $SiH_4$: | 510 ml/min |
| $H_2$: | 450 ml/min |
| Power: | 450 W |
| Internal pressure: | 73 Pa |
| Substrate temperature: | 200° C. |
| Layer thickness: | 20 μm |
| (3) Surface protective layer | |
| $SiH_4$: | 2 ml/min |
| $CH_4$: | 200 ml/min |
| Power: | 150 W |
| Internal pressure: | 67 Pa |
| Substrate temperature: | 200° C. |
| Layer thickness: | 0.5 μm |

Next, the surface of the above light-receiving member was surface-etched (plasma etching) under conditions, and within the range, shown in Example II1, to control its surface roughness to be 50 nm to obtain a light-receiving members II1'a.

In the present Comparative Example, the surface protective layer was formed of a-SiC:H. The microscopic surface roughness Ra in a reference length of 10 μm of the light-receiving member thus obtained was measured with the AFM (atomic force microscope) to find that it was about 50 nm. At the same time, on a mirror-polished silicon wafer, only the surface protective layer was deposited in a thickness of 1 μm under the same conditions as the above, to prepare a sample for measuring infrared absorption.

The light-receiving member II1'a thus produced was used in combination with the toner (1) to make evaluation in the same manner as in Example II1. Results obtained are shown in Table 6.

Comparative Example II2

The light-receiving member (II1) obtained in Example II1, having not been surface-etched, was surface-etched under conditions shown below. Its surface roughness was controlled, among which light-receiving members II2'a and II2'b having surface roughness outside the present invention were thus obtained.

Etching Conditions

| | |
|---|---|
| $CF_4$: | 400 ml/min |
| Power: | 50 W to 2,000 W |
| Substrate temperature: | 200° C. |
| Pressure: | 50 Pa |

The microscopic surface roughness Ra in a reference length of 10 μm of the light-receiving members II2'a and II2'b was 10 nm and 110 nm, respectively. At the same time, on a mirror-polished silicon wafer, only the surface protective layer was deposited in a thickness of 1 μm under the same conditions as the above, to prepare a sample for measuring infrared absorption.

The light-receiving member II2'a and II2'b thus produced were used in combination with the toner (1) to make the same evaluation as in Example II1. Results obtained are shown in Table 6.

As can be seen from Table 6, the present invention is effective in that the a-C:H surface protective layer controlled to have a microscopic surface roughness Ra of from 15 nm to 100 nm does not cause the difficulties such as melt-adhesion and filming even when used in combination with the well fixable toner, and also does not cause any abrasion, and hence the light-receiving member can stably be used over a long period of time.

Example II2

Using the film-forming system shown in FIG. 13, a lower-part blocking layer, a photoconductive layer (photosensitive layer), a buffer layer and a surface protective layer were superposingly formed in order on each conductive substrate cylindrical aluminum substrate under conditions shown below. Thus, light-receiving members (II2a) to (II2e) were completed.

| | |
|---|---|
| (1) Lower-part blocking layer | |
| $SiH_4$: | 100 ml/min |
| $H_2$: | 600 ml/min |
| $B_2H_6$: | 800 ppm |
| (based on $SiH_4$) | |
| Power: | 200 W |
| Internal pressure: | 80 Pa |
| Substrate temperature: | 280° C. |
| Layer thickness: | 2 μm |
| (2) Photoconductive layer (photosensitive layer) | |
| $SiH_4$: | 350 ml/min |
| $H_2$: | 600 ml/min |
| Power: | 400 W |
| Internal pressure: | 73 Pa |
| Substrate temperature: | 280° C. |
| Layer thickness: | 20 μm |
| (3) Buffer layer | |
| $SiH_4$: | 10 ml/min |
| $CH_4$: | 500 ml/min |
| Power: | 150 W |
| Internal pressure: | 67 Pa |
| Substrate temperature: | 280° C. |
| Layer thickness: | 0.5 μm |
| (4) Surface protective layer | |
| $CH_4$: | 100 ml/min |
| $H_2$: | 10 to 500 ml/min |
| Power: | 1,800 W |
| Internal pressure: | 67 Pa |

-continued

| | |
|---|---|
| Substrate temperature: | 180° C. |
| Layer thickness: | 0.2 μm |

A light-receiving member (II2f) having no interface between the photoconductive layer and the surface protective layer was also produced in the same manner as the above except that change layers were individually formed between the photoconductive layer and the buffer layer and between the buffer layer and the surface protective layer. The change layers were superposingly formed under the following conditions.

| Change layer between photoconductive layer and buffer layer | |
|---|---|
| $SiH_4$: | 350 → 10 ml/min |
| $H_2$: | 600 → 0 ml/min |
| $CH_4$: | 0 → 500 ml/min |
| Power: | 400 → 150 W |
| Internal pressure: | 73 → 67 Pa |
| Substrate temperature: | 280° C. |
| Layer thickness: | 0.05 μm |
| **Change layer between buffer layer and surface protective layer** | |
| $SiH_4$: | 10 → 0 ml/min |
| $H_2$: | 0 → 300 ml/min |
| $CH_4$: | 500 → 100 ml/min |
| Power: | 150 → 1,800 W |
| Internal pressure: | 67 Pa |
| Substrate temperature: | 180° C. |
| Layer thickness: | 0.05 μm |

A light-receiving member (II2g) was also produced the photoconductive layer of which was functionally separated into a charge transport layer and a charge generation layer and also in which change layers were individually provided between the charge generation layer and the buffer layer and between the buffer layer and the surface protective layer to make the light-receiving member have no interface between the photoconductive layer and the surface protective layer. In the light-receiving member (II2g), the layers were superposed in the order of the lower-part blocking layer, charge transport layer, charge generation layer, change layer, buffer layer, change layer and surface protective layer. The charge transport layer and charge generation layer were formed under the following conditions. The lower-part blocking layer, buffer layer and surface protective layer were formed under the same conditions as those for the light-receiving members (II2a) to (II2e). The change layers were formed under the same conditions as those for the light-receiving member (II2f).

| Charge transport layer | |
|---|---|
| $SiH_4$: | 100 ml/min |
| $H_2$: | 600 ml/min |
| $CH_4$: | 50 ml/min |
| $B_2H_6$: | 1 ppm (based on $SiH_4$) |
| Power: | 200 W |
| Internal pressure: | 80 Pa |
| Substrate temperature: | 280° C. |
| Layer thickness: | 20 μm |

-continued

| Charge generation layer | |
|---|---|
| $SiH_4$: | 350 ml/min |
| $H_2$: | 600 ml/min |
| Power: | 400 W |
| Internal pressure: | 73 Pa |
| Substrate temperature: | 280° C. |
| Layer thickness: | 2 μm |

The light-receiving members (II2a) to (II2g) were surface-etched under conditions shown below. Their microscopic surface roughness Ra in a reference length of 10 μm was so controlled as to be 40 nm, to obtain light-receiving members II2a to II2g.

Etching Conditions

| | |
|---|---|
| $CF_4$: | 400 ml/min |
| Power: | 50 W to 2,000 W |
| Substrate temperature: | 200° C. |
| Pressure: | 50 Pa |

In the present Example, the hydrogen content in the a-C:H layer was changed to vary the quantity of hydrogen atoms contained in the film. With regard to this in-film hydrogen content, only the surface protective layer was deposited in a thickness of 1 μm on a mirror-polished silicon wafer, and the content was determined by infrared absorption. Results obtained are shown in Table 7.

Production of Toner

The following materials were premixed, and thereafter the mixture was melt-kneaded by means of a twin-screw extruder set at 130° C.

| | (by weight) |
|---|---|
| Polyester resin (Tg: 58.2° C.; a condensation polymer of propoxidized and epoxidized bisphenol with fumaric acid and trimellitic acid) | 100 parts |
| Magnetite powder (number-average particle diameter: 0.2μm) | 90 parts |
| Long-chain alkyl alcohol (differential thermal analysis endothermic peak: 105° C.; peak molecular weight: 830) | 4 parts |
| Azo iron complex compound represented by the above Formula (10) | |

The kneaded product obtained was cooled, and thereafter the cooled product obtained was crushed, and then finely pulverized by means of a grinding mill making use of jet streams, further followed by classification by means of an air classifier to obtain a black powder, toner particles (2). In the toner particles (2), the THF-insoluble matter of the binder resin was 25% by weight.

In 100 parts by weight of the toner particles (2), 1.0 part by weight of dry-process silica treated with hexamethyldisilazane was mixed with stirring by means of a Henschel mixer to obtain a negatively chargeable toner (2). The negatively chargeable toner (2) thus obtained had a weight-average particle diameter of 8.0 μm and a peak molecular weight of 8,000.

The light-receiving members II2a to II2g produced as described above were used in combination with the toner (2) to make image evaluation in the same manner as in Example II1. Results obtained are shown in Table 7.

Comparative Example II3

In the same manner as in Example II2, a lower-part blocking layer, a photoconductive layer (photosensitive layer), a buffer layer comprised of a-SiC and a surface protective layer were superposingly formed in order on each conductive substrate cylindrical aluminum substrate to complete light-receiving members. In the present Comparative Example, light-receiving members (II3'a and II3'b) were completed.

Next, the light-receiving members (II3'a and II3'b) were surface-etched in the same manner as in Example II2. Their microscopic surface roughness Ra in a reference length of 10 $\mu$m was so controlled as to be 40 nm, to obtain light-receiving members II3'a and II3'b.

In the present Example, the hydrogen content in the a-C:H layer was changed to set conditions so that the quantity of hydrogen atoms contained in the film came to be 30 atom % (II3'a) and 60 atom % (II3'b).

The light-receiving members II3 'a and II3'b thus produced were used in combination with the toner (2) to make evaluation in the same manner as in Example II1. Results obtained are shown in Table 7.

As can be seen from the results shown in Table 7, the present invention is well effective especially when the hydrogen content in the film is in the range of from 35 atom % to 55 atom %.

Example II3

Using the film-forming system shown in FIG. 13, a lower-part blocking layer, a photoconductive layer (photosensitive layer) and a surface protective layer were superposingly formed in order on each conductive substrate cylindrical aluminum substrate under conditions shown below. Thus, a light-receiving member (II3) used under negative charging was completed.

| (1) Lower-part blocking layer | |
|---|---|
| $SiH_4$: | 100 ml/min |
| $H_2$: | 300 ml/min |
| $PH_3$: | 800 ppm (based on $SiH_4$) |
| NO: | 5 ml/min |
| Power: | 150 W |
| Internal pressure: | 80 Pa |
| Substrate temperature: | 250° C. |
| Layer thickness: | 3 $\mu$m |
| **(2) Photoconductive layer (photosensitive layer)** | |
| $SiH_4$: | 350 ml/min |
| $H_2$: | 600 ml/min |
| Power: | 400 W |
| Internal pressure: | 73 Pa |
| Substrate temperature: | 280° C. |
| Layer thickness: | 20 $\mu$m |
| **(3) Surface protective layer** | |
| $CH_4$: | 100 ml/min |
| $H_2$: | 300 ml/min |
| Power: | 1,500 W |
| Internal pressure: | 67 Pa |
| Substrate temperature: | 150° C. |
| Layer thickness: | 0.3 $\mu$m |

The light-receiving member (II3) was surface-etched under conditions shown below. Its microscopic surface roughness Ra in a reference length of 10 $\mu$m was so controlled as to be 30 nm, to obtain a light-receiving member II3.

Etching Conditions

| | |
|---|---|
| $CF_4$: | 400 ml/min |
| Power: | 500 W |
| Substrate temperature: | 200° C. |
| Internal pressure: | 50 Pa |

On a mirror-polished silicon wafer, only the surface protective layer was deposited in a thickness of 1 $\mu$m under the same conditions as the above, and the in-film hydrogen content was measured by infrared absorption to find that it was 46 atom %.

The light-receiving member II3 thus produced was used in combination with the following toner to make evaluation.

Toner Production Conditions

The following materials were premixed, and thereafter the mixture was melt-kneaded by means of a twin-screw extruder set at 130° C.

| | (by weight) |
|---|---|
| Styrene/butyl acrylate copolymer (Tg: 58.5° C.) | 100 parts |
| Magnetite powder (number-average particle diameter: 0.2 $\mu$m) | 90 parts |
| Low-molecular weight polyethylene (differential thermal analysis enothermic peak: 110° C.; peak molecular weight 1,200) | 4 parts |
| Triphenylmethane compound representd by the following Formula (11) | 2 parts |

(11)

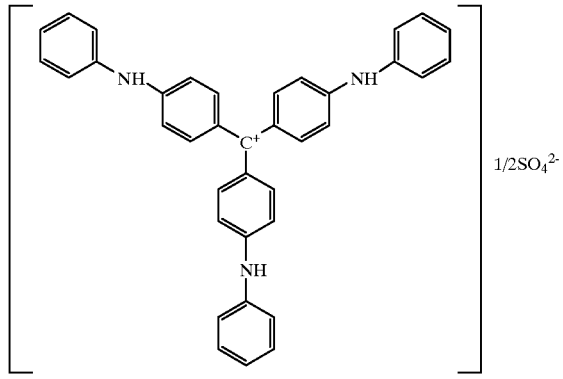

The kneaded product obtained was cooled, and thereafter the cooled product obtained was crushed, and then finely pulverized by means of a grinding mill making use of jet streams, further followed by classification by means of an air classifier. The classified product was further surface-treated by mechanical impact force to obtain a black powder, toner particles (3). In the toner particles (3), the THF-insoluble matter of the binder resin was 0% by weight.

In 100 parts by weight of the toner particles (3), 0.8 part by weight of dry-process silica treated with amino-modified silicone oil was mixed with stirring by means of a Henschel mixer to obtain a positively chargeable toner (3). The positively chargeable toner (3) thus obtained had a weight-average particle diameter of 7.3 $\mu$m and peak molecular weights of 12,000 and 450,000.

In the present Example, the light-receiving member of the image-forming apparatus shown in FIG. 1 was changed from a drum for positive charging to a drum for negative charging (i.e., the light-receiving member II3), and also the preset temperature of the fixing assembly was varied, where the light-receiving member II3 was used in combination with the toner (3) to make image reproduction. After the image reproduction, the images formed were rubbed with an eraser to observe fixing performance. The results were evaluated according to the following four ranks. Results obtained are shown in Table 8.

A: Images do not become thin at all even when rubbed fairly strongly, showing a very good fixing performance.

B: Images become slightly thin only when rubbed fairly strongly, but no problem at all in usual use.

C: Images become thin only rubbed strongly to come into question in some cases.

D: Images become thin even though rubbed gently, showing a poor fixing performance.

As can be seen from these results, the use of the toner according to the present invention causes no problem at all on the fixing performance even when the fixing temperature is set lower than 200° C. which is usual preset temperature. Thus, it has been made clear that the use of the light-receiving member of the present invention in combination with the toner according to the present invention can provide a copying process that is energy saving and may cause no faulty images due to melt-adhesion or the like.

Example II4

Using the film-forming system shown in FIG. 13, a lower-part blocking layer, a photoconductive layer (photosensitive layer), a buffer layer and a surface protective layer were superposingly formed in order on each conductive substrate cylindrical aluminum substrate under conditions shown below. Thus, light-receiving members (II4a) to (II4e) used under negative charging were completed.

| (1) Lower-part blocking layer | |
|---|---|
| $SiH_4$: | 100 ml/min |
| $PH_3$: | 500 ppm (based on $SiH_4$) |
| Power: | 200 W |
| Internal pressure: | 80 Pa |
| Substrate temperature: | 240° C. |
| Layer thickness: | 1 μm |
| **(2) Photoconductive layer (photosensitive layer)** | |
| $SiH_4$: | 300 ml/min |
| Power: | 500 W |
| Internal pressure: | 73 Pa |
| Substrate temperature: | 240° C. |
| Layer thickness: | 15 μm |
| **(3) Buffer layer** | |
| $SiH_4$: | 50 ml/min |
| $CH_4$: | 500 ml/min |
| Power: | 200 W |
| Internal pressure: | 67 Pa |
| Substrate temperature: | 240° C. |
| Layer thickness: | 0.5 μm |
| **(4) Surface protective layer** | |
| $CH_4$: | 100 ml/min |
| $C_2F_6$: | 10 to 100 ml/min |
| Power: | 1,000 W |
| Internal pressure: | 67 Pa |

-continued

| | |
|---|---|
| Substrate temperature: | 150° C. |
| Layer thickness: | 0.1 μm |

A light-receiving member (II4f) was also produced the photoconductive layer of which was functionally separated into a charge transport layer and a charge generation layer and also in which change layers were individually provided between the charge generation layer and the buffer layer and between the buffer layer and the surface protective layer to make the light-receiving member have no interface between the photoconductive layer and the surface protective layer. In the light-receiving member (II4f), the layers were superposed in the order of the lower-part blocking layer, charge transport layer, charge generation layer, change layer (1), buffer layer, change layer (2) and surface protective layer. The charge transport layer, charge generation layer and change layers (1) and (2) were formed under the following conditions. The lower-part blocking layer, buffer layer and surface protective layer were formed under the same conditions as those for the light-receiving members (II4a) to (II4e).

| Charge transport layer | |
|---|---|
| $SiH_4$: | 100 ml/min |
| $H_2$: | 600 ml/min |
| $CH_4$: | 50 ml/min |
| $B_2H_6$: | 1 ppm (based on $SiH_4$) |
| Power: | 200 W |
| Internal pressure: | 80 Pa |
| Substrate temperature: | 280° C. |
| Layer thickness: | 20 μm |
| **Charge generation layer** | |
| $SiH_4$: | 350 ml/min |
| $H_2$: | 600 ml/min |
| Power: | 400 W |
| Internal pressure: | 73 Pa |
| Substrate temperature: | 280° C. |
| Layer thickness: | 2 μm |
| **Change layer (1)** | |
| $SiH_4$: | 300 → 50 ml/min |
| $CH_4$: | 0 → 500 ml/min |
| Power: | 500 → 200 W |
| Internal pressure: | 73 → 67 Pa |
| Substrate temperature: | 240° C. |
| Layer thickness: | 0.05 μm |
| **Change layer (2)** | |
| $SiH_4$: | 50 → 0 ml/min |
| $CH_4$: | 500 → 100 ml/min |
| $C_2F_6$: | 0 → 50 ml/min |
| Power: | 200 → 1,000 W |
| Internal pressure: | 67 Pa |
| Substrate temperature: | 150° C. |
| Layer thickness: | 0.05 μm |

At this stage, the microscopic surface roughness Ra in a reference length of 10 μm of each of the light-receiving members (II4a) to (II4f) was measured to reveal that it was in the range of from 20 to 40 nm. Accordingly, their surface roughness was not especially regulated, and these were used as light-receiving members II4a to II4f.

In the present Example, when the surface protective layer was formed, $C_2F_6$ gas was used so as to incorporate fluorine. Also, on a mirror-polished silicon wafer, only the surface protective layer was deposited in a thickness of 1 μm under the same conditions as the above to prepare a sample. This sample was analyzed with an infrared spectrophotometer to measure fluorine content.

The light-receiving members II4a to II4f produced according to the above procedure were used in combination with the toner obtained in Example II1to make evaluation in the same manner as in Example II1 but using a remodeled machine in which the light-receiving member of the image-forming apparatus shown in FIG. 1 was changed from a drum for positive charging to a drum for negative charging (i.e., each of the light-receiving members II4a to II4f). Results obtained are shown in Table 9.

As can be seen from the results shown in Table 9, the incorporation of a halogen (fluorine) in the surface protective layer bring about good results.

Example II5

Using the film-forming system shown in FIG. 13, making use of VHF, a lower-part blocking layer, a photoconductive layer (photosensitive layer), a buffer layer and a surface protective layer were superposingly formed in order on each conductive substrate cylindrical aluminum substrate under conditions shown below. Thus, a light-receiving members (II5a) was completed.

| | |
|---|---|
| (1) Lower-part blocking layer | |
| $SiH_4$: | 200 ml/min |
| $H_2$: | 500 ml/min |
| $B_2H_6$: | 300 ppm (based on $SiH_4$) |
| Power: | 1,000 W |
| Internal pressure: | 0.8 Pa |
| Substrate temperature: | 290° C. |
| Layer thickness: | 3 μm |
| (2) Photoconductive layer | |
| $SiH_4$: | 200 ml/min |
| $H_2$: | 500 ml/min |
| Power: | 1,000 W |
| Internal pressure: | 0.8 Pa |
| Substrate temperature: | 290° C. |
| Layer thickness: | 30 μm |
| (3) Buffer layer | |
| $SiH_4$: | 5 ml/min |
| $CH_4$: | 100 ml/min |
| Power: | 1,000 W |
| Internal pressure: | 0.8 Pa |
| Substrate temperature: | 290° C. |
| Layer thickness: | 0.5 μm |
| (4) Surface protective layer | |
| $CH_4$: | 100 ml/min |
| Power: | 1,800 W |
| Internal pressure: | 0.8 Pa |
| Substrate temperature: | 200° C. |
| Layer thickness: | 0.3 μm |

A light-receiving member (II5b) was also produced the photoconductive layer of which was functionally separated into a charge transport layer and a charge generation layer and also in which change layers were individually provided between the charge generation layer and the buffer layer and between the buffer layer and the surface protective layer to make the light-receiving member have no interface between the photoconductive layer and the surface protective layer. In the light-receiving member (II5b), the layers were superposed in the order of the lower-part blocking layer, charge transport layer, charge generation layer, change layer (1), buffer layer, change layer (2) and surface protective layer. The charge transport layer, charge generation layer and change layers (1) and (2) were formed under the following conditions. The lower-part blocking layer, buffer layer and surface protective layer were formed under the same conditions as those for the light-receiving member (II5a).

| | |
|---|---|
| Charge transport layer | |
| $SiH_4$: | 200 ml/min |
| $H_2$: | 500 ml/min |
| $CH_4$: | 30 ml/min |
| $B_2H_6$: | 1.5 ppm (based on $SiH_4$) |
| Power: | 1,000 W |
| Internal pressure: | 0.8 Pa |
| Substrate temperature: | 290° C. |
| Layer thickness: | 20 μm |
| Charge generation layer | |
| $SiH_4$: | 200 ml/min |
| $H_2$: | 500 ml/min |
| Power: | 1,000 W |
| Internal pressure: | 0.8 Pa |
| Substrate temperature: | 290° C. |
| Layer thickness: | 5 μm |
| Change layer (1) | |
| $SiH_4$: | 200 → 5 ml/min |
| $CH_4$: | 0 → 100 ml/min |
| $H_2$: | 500 → 0 |
| Power: | 1,000 W |
| Internal pressure: | 0.8 Pa |
| Substrate temperature: | 290° C. |
| Layer thickness: | 0.1 μm |
| Change layer (2) | |
| $SiH_4$: | 5 → 0 ml/min |
| $CH_4$: | 100 ml/min |
| Power: | 1,000 → 1,800 W |
| Internal pressure: | 0.8 Pa |
| Substrate temperature: | 200° C. |
| Layer thickness: | 0.05 μm |

At this stage, the microscopic surface roughness Ra in a reference length of 10 μm of each of the light-receiving members (II5a) and (II5b) was measured to reveal that it was 70 nm. Accordingly, their surface roughness was not especially regulated, and these were used as light-receiving members II5a and II5b. Also, on a mirror-polished silicon wafer, only the surface protective layer was deposited in a thickness of 1 μm under the same conditions as the above to prepare a sample.

The light-receiving members II5a and II5b produced according to the above procedure were used in combination with the same toner (1) as that obtained in Example II1 to make evaluation in the same manner as in Example II1. Results obtained are shown in Table 10.

As can be seen from the results shown in Table 10, the effect attributable to the present invention can similarly sufficiently be obtained also in the case of the light-receiving members II5a and II5b produced by VHF plasma-assisted CVD.

Example II6

A light-receiving member II6 having a diameter of 30 mm was produced under the same conditions as the light-receiving member II5b.

This light-receiving member II6 was set in a remodeled machine of a copying machine GP405, manufactured by CANON INC. Setting the surface movement speed of the light-receiving member at 210 mm/sec and using as a toner the toner (1) used in Example II1, images were formed to make a continuous 100,000-sheet (A4 size) paper feed running test in an environment of 25° C./10% RH, and evaluation was made in the same manner as in Example II1. Results obtained are shown in Table 11.

As can be seen from the results shown in Table 11, good images can be formed over a long period of time also when the light-receiving member has a diameter as small as 30 mm.

According to the present invention, in the light-receiving member comprising the conductive substrate, and formed superposingly thereon the photosensitive layer containing at least an amorphus silicon and the surface protective layer in order, its surface roughness Ra in the measuring range of 10 μm×10 μm is controlled to be from 15 nm to 100 nm. Thus, it has become possible to prevent the toner adhesion at the time of cleaning and to form good images.

According to the present invention, where the surface roughness Ra of the light-receiving member in the measuring range of 10 μm×10 μm has been controlled to be from 15 nm to 100 nm, the light-receiving member can readily be controlled to have a surface free energy of 49 mN/m or less. Thus, it has become possible to prevent the toner adhesion at the time of cleaning and to form good images.

According to the present invention, the surface roughness Ra of the conductive substrate in the measuring range of 10 μm×10 μm is controlled to be smaller than 6 nm and also the surface roughness Ra of the light-receiving member in the measuring range of 10 μm×10 μm is controlled to be from 15 nm to 100 nm. Thus, it has become possible to prevent the toner adhesion at the time of cleaning and to form good images.

According to the present invention, the surface roughness Ra of the light-receiving member in the measuring range of 10 μm×10 μm is controlled to be from 20 nm to 80 nm and the light-receiving member is controlled to have a surface free energy of from 35 mN/m to 47 mN/m. Thus, it has become possible to prevent the toner adhesion at the time of cleaning and to form good images even when digital images are formed using the light source composed chiefly of a single wavelength.

In the foregoing, the interfacial composition between the surface protective layer and the photosensitive layer of the light-receiving member may continuously be changed and also, in that interfacial composition, the spectral reflectance satisfies $0 \leqq (Max-Min)/(Max+Min) \leqq 0.4$ where Min and Max represent the minimum value and maximum value, respectively, of reflectance (%) of light having a wavelength in the range of from 450 nm to 650 nm. Thus, it has become possible to more effectively keep the toner from adhering.

According to the present invention, the electrostatic-latent-image-developing toner containing at least the binder resin, the charge control agent and the wax, and having a weight-average particle diameter of from 3 μm to 11 μm; the binder resin having a Tg of from 40° C. to 80° C., and the wax having a main peak in the region of molecular weight of from 400 to 10,000, and having at least one endothermic peak in the region of from 60° C. to 150° C. at the time of heating in differential thermal analysis is used in combination with the light-receiving member having the conductive substrate, and formed thereon the photosensitive layer comprising a non-single-crystal material composed chiefly of silicon atoms and as the outermost layer the surface layer comprising non-single-crystal carbon containing from 35 atom % to 55 atom % of atoms and having the surface roughness Ra in a reference length of 10 μm, of from 15 nm to 100 nm. Thus, the fixing assembly can be operated at a lower temperature, and this enables achievement of low-power consumption, and also the image-forming method and image-forming apparatus having a well superior running performance can be provided, which can always form sharp images without causing any faulty images due to melt-adhesion or filming in every environment and without causing any wear which is causative of scratches on the light-receiving member even when used over a long period of time.

TABLE 1

| | Microscopic surface roughness Ra (nm) | Macroscopic surface roughness Rz (nm) | Image evaluation Toner adhesion proofness |
|---|---|---|---|
| Light-receiving member: | | | |
| 1A | 37.7 | 0.21 | A |
| 1B | 30.9 | 0.19 | A |
| 1C | 14.3 | 0.11 | C |
| 1D | 23.1 | 0.11 | B |
| 1E | 14.3 | 1.03 | C |
| 1F | 15.4 | 2.09 | B |
| 1G | 23.2 | 2.57 | A |
| 1H | 18.0 | 0.68 | B |
| 1I | 70.1 | 0.51 | A |
| 1J | 51.0 | 0.32 | A |
| 1K | 20.3 | 3.24 | A |
| 1L | 10.2 | 3.25 | C |
| Evaluation machine: | | | |
| | AFM manufactured by Quesant Co. | Contact-type surface profile analyzer manufactured by Kosaka Kenkyusho | Inspected using remodeled machine of NP6350, manufactured by CANON INC. |

TABLE 2

| | Microscopic surface roughness RA (nm) | Macroscopic surface roughness Rz (nm) | Image evaluation Toner adhesion proofness | Clean-ability | Digital-image sharpness |
|---|---|---|---|---|---|
| Light-receiving member: | | | | | |
| 2A | 12.6 | 0.20 | C | A | A |
| 2B | 14.3 | 0.19 | C | A | A |
| 2C | 15.2 | 0.19 | B | A | A |
| 2D | 18.7 | 0.20 | B | A | A |
| 2E | 20.2 | 0.20 | A | A | A |
| 2F | 30.9 | 0.22 | A | A | A |
| 2G | 37.7 | 0.21 | A | A | A |
| 2H | 55.1 | 0.21 | A | A | A |
| 2I | 79.3 | 0.23 | A | A | A |
| 2J | 80.1 | 0.25 | A | A | B |
| 2K | 96.5 | 0.28 | A | B | B |
| 2L | 102.7 | 0.32 | A | C | C |
| 2Q | 15.2 | 0.19 | A | A | A |
| 2R | 96.5 | 0.28 | A | B | B |
| Evaluation machine: | | | | | |
| | AFM manufactured by Quesant Co. | Contact-type surface profile analyzer manufactured by Kosaka Kenkyusho | Inspected using remodeled machine of NP6350, manufactured by CANON INC. | | Inspected using digital remodeled machine of NP6350 |

TABLE 3

| | Microscopic surface roughness Ra (nm) | Macroscopic surface roughness Rz (nm) | Surface free energy (mN/m) | Image evaluation: Toner adhesion proofness | Image evaluation: Cleanability | Image evaluation: Digital-image sharpness |
|---|---|---|---|---|---|---|
| Light-receiving member: | | | | | | |
| 3A | 12.6 | 0.20 | 50.4 | C | A | A |
| 3B | 14.3 | 0.19 | 49.3 | C | A | A |
| 36 | 15.2 | 0.19 | 48.9 | B | A | A |
| 3D | 18.7 | 0.20 | 47.7 | B | A | A |
| 3E | 20.2 | 0.20 | 47.0 | A | A | A |
| 3F | 30.9 | 0.22 | 45.1 | A | A | A |
| 3G | 37.7 | 0.21 | 41.8 | A | A | A |
| 3H | 55.1 | 0.21 | 37.9 | A | A | A |
| 3I | 79.3 | 0.23 | 35.2 | A | A | A |
| 3J | 80.1 | 0.25 | 34.7 | A | A | B |
| 3K | 96.5 | 0.28 | 30.2 | A | B | B |
| 3L | 102.7 | 0.32 | 29.9 | A | C | C |
| 3M | 37.7 | 0.21 | 49.2 | C | A | A |
| 3N | 37.7 | 0.21 | 48.8 | B | A | A |
| 3O | 37.7 | 0.21 | 46.7 | A | A | A |
| 3P | 37.7 | 0.21 | 42.4 | A | A | A |
| 3Q | 18.7 | 0.20 | 47.7 | A | A | A |
| 3R | 96.5 | 0.28 | 30.2 | A | A | A |
| Evaluation machine: | | | | | | |
| | AFM manufactured by Quesant Co. | Contact-type surface profile analyzer manufactured by Kosaka | Contact angle meter manufactured by Kyowa Kaimen | Inspected using remodeled machine of NP6350, manufactured by CANON INC. | | Inspected using digital remodeled machine of |

TABLE 3-continued

| | Microscopic surface roughness Ra (nm) | Macroscopic surface roughness Rz (nm) | Surface free energy (mN/m) | Image evaluation: Toner adhesion proofness | Image evaluation: Cleanability | Image evaluation: Digital-image sharpness |
|---|---|---|---|---|---|---|
| | | Kenkyusho | | | | NP6350 |

TABLE 4

| | Microscopic surface roughness Ra (nm) | Image evaluation Spotty faulty images |
|---|---|---|
| Light-receiving member: | | |
| 4A | 3.1 | A |
| 4B | 5.9 | A |
| 4C | 6.4 | B |
| 4D | 8.5 | B |
| 4E | 12.3 | C |
| 4F | 18.9 | C |
| Evaluation machine: | | |
| | AFM manufactured by Quesant Co. | Inspected using remodeled machine of NP6350 manufactured by CANON INC. |

TABLE 5

| | Light = receiving member microscopic surface roughness Ra (nm) | Substrate microscopic surface roughness Ra (nm) | Interface | Surface free energy (mN/m) | Image evaluation: Toner adhesion proofness | Image evaluation: Cleanability | Image evaluation: Spotty faulty image | Image evaluation: Digital = image sharpness | Image evaluation: Overall evaluation |
|---|---|---|---|---|---|---|---|---|---|
| Example: | | | | | | | | | |
| I1 | 37.7 | 5.9 | yes | 46.7 | A | A | A | A | A |
| I2 | 37.7 | 5.9 | yes | 46.7 | A | A | A | — | A |
| I3 | 37.7 | 8.5 | yes | 43.5 | A | A | B | A | B |
| I4 | 15.2 | 5.9 | no | 48.5 | A | A | A | A | A |
| Comparative Example: | | | | | | | | | |
| I1 | 14.3 | 5.9 | yes | 49.3 | C | A | A | A | C |
| I2 | 14.3 | 5.9 | yes | 49.3 | C | A | A | — | C |
| I3 | 102.7 | 5.9 | Yes | 30.2 | A | B | A | C | C |
| Evaluation machine: | | | | | | | | | |
| AFM manufactured by Quesant Co. | | | | Contact angle meter of Kyowa Kaimen | Inspected using remodeled machine of NP6350, manufactured by CANON INC. | | | | |

TABLE 6

| | Example II1 | | | | | | | Comparative Example II1 | Comparative Example II2 | |
|---|---|---|---|---|---|---|---|---|---|---|
| Light-receiving member: | II1a | II1b | II1c | II1d | II1e | II1f | II1g | II1'a | II2'a | II2'b |
| Surface roughness Ra: (nm) | 15 | 20 | 50 | 80 | 100 | 15 | 100 | 50 | 10 | 110 |
| Melt-adhesion: | 23 | 20 | 19 | 18 | 26 | 18 | 18 | 100 | 65 | 63 |
| Filming: | 18 | 19 | 12 | 11 | 16 | 12 | 12 | 100 | 33 | 39 |
| Abrasion: | 68 | 55 | 52 | 58 | 55 | 67 | 66 | 100 | 69 | 71 |
| Hydrogen content: (atom %) | 43 | 44 | 42 | 45 | 46 | 43 | 43 | 38 | 44 | 46 |
| Interface: (spectral reflectance) | yes (0.76) | yes (0.75) | yes (0.77) | yes (0.77) | yes (0.74) | no (0.25) | no (0.24) | yes (0.62) | yes (0.74) | yes (0.76) |

TABLE 7

| | Example II2 | | | | | | | Comparative Example II3 | |
|---|---|---|---|---|---|---|---|---|---|
| Light-receiving member: | II2a | II2b | II2c | II2d | II2e | II2f | II2g | II3'a | II3'b |
| Melt-adhesion: | 22 | 24 | 23 | 21 | 25 | 19 | 18 | 39 | 42 |
| Filming: | 19 | 18 | 14 | 13 | 11 | 10 | 9 | 32 | 31 |
| Abrasion: | 51 | 52 | 55 | 61 | 68 | 55 | 55 | 49 | 72 |
| Hydrogen content: (atom %) | 35 | 40 | 45 | 50 | 55 | 45 | 45 | 30 | 60 |
| Interface: (Spectral reflectance) | yes (0.62) | yes (0.62) | yes (0.64) | yes (0.65) | yes (0.69) | no (0.19) | no (0.20) | yes (0.61) | yes (0.69) |

TABLE 8

| | Example II3 | | | | |
|---|---|---|---|---|---|
| Fixing temperature: (° C.) | 140 | 160 | 180 | 200 | 220 |
| Fixing performance: | B | A | A | A | A |

TABLE 9

| | Example II4 | | | | | |
|---|---|---|---|---|---|---|
| Light-receiving member: | II4a | II4b | II4c | II4d | II4e | II4f |
| Melt-adhesion: | 25 | 21 | 20 | 19 | 24 | 15 |
| Filming: | 17 | 22 | 13 | 10 | 17 | 9 |
| Abrasion: | 66 | 52 | 50 | 60 | 53 | 52 |
| Hydrogen content: (atom %) | 43 | 32 | 23 | 18 | 12 | 20 |
| Fluorine content: (atom %) | 5 | 14 | 19 | 32 | 41 | 21 |
| Interface: (Spectral reflectance) | yes (0.66) | yes (0.62) | yes (0.64) | yes (0.65) | yes (0.64) | no (0.21) |

TABLE 10

| | Example II5 | |
|---|---|---|
| Light-receiving member: | II5a | II5C |
| Surface roughness Ra: (nm) | 70 | 70 |
| Melt-adhesion: | 12 | 8 |
| Filming: | 10 | 5 |
| Abrasion: | 40 | 40 |

TABLE 10-continued

| | Example II5 | |
|---|---|---|
| Hydrogen content: (atom %) | 51 | 51 |
| Interface: (Spectral reflectance) | yes (0.64) | no (0.22) |

TABLE 11

| | Example II6 |
|---|---|
| Light-receiving member: | II6 |
| Surface roughness Ra: (nm) | 70 |
| Melt-adhesion: | 31 |
| Filming: | 20 |
| Hydrogen content: (atom %) | 51 |
| Interface: (Spectral reflectance) | no (0.21) |

What is claimed is:

1. A light-receiving member comprising a conductive substrate, and formed superposingly thereon a photosensitive layer and a surface protective layer in order; said light-receiving member having a surface roughness Ra of from 15 nm to 100 nm, wherein an interfacial composition of the photosensitive layer and the surface protective layer satisfies the following expression:

$$0 \leqq (Max-Min)/(Max+Mm) \leqq 0.4$$

(where Mm and Max represent the minimum value and maximum value, respectively, of reflectance (%) of light having a wavelength in the range of from 450 nm to 650 nm).

2. The light-receiving member according to claim 1, which has a surface roughness Ra of from 20 nm to 80 nm.

3. The light-receiving member according to claim 1, which has a surface free energy of from 25 mN/m to 49 mN/m.

4. The light-receiving member according to claim 1, which has a surface free energy of from 35 mN/m to 47 mN/m.

5. The light-receiving member according to claim 1, wherein said conductive substrate has a surface roughness Ra smaller than 6 nm.

6. The light-receiving member according to claim 1, wherein the surface roughness Ra is on the basis of the measuring range of 10 $\mu$m×10 $\mu$m.

7. An image-forming apparatus comprising the light-receiving member according to claim 1.

8. The image-forming apparatus according to claim 7, which has at least a charging assembly, a light source and a developing assembly.

9. An image-forming method comprising the step of rendering visible an electrostatic pattern formed on the light-receiving member according to claim 1, by developing the electrostatic pattern with a toner containing at least a binder resin, a charge control agent and a wax, and having a weight-average particle diameter of from 3 $\mu$m to 11 $\mu$m; said binder resin having a glass transition temperature of from 40° C. to 80° C., and said wax having a main peak in the region of molecular weight of from 400 to 10,000, and having at least one endothermic peak in the region of from 60° C. to 150° C. at the time of heating in differential thermal analysis.

10. An image-forming method comprising:

a charging step of applying a voltage to a charging member to charge a light-receiving member;

an electrostatic-latent-image-forming step of forming an electrostatic latent image on the light-receiving member thus charged;

a developing step of forming a developed image on the light-receiving member by causing an electrostatic-latent-image-developing toner carried on a toner-carrying member, to move to the electrostatic latent image fanned on the light-receiving member;

a transfer step of electrostatically transferring the developed image formed on the light-receiving member, to a transfer material via, or not via, an intermediate member; and a fixing step of fixing to the transfer material the developed image held thereon;

said light-receiving member being a light-receiving member comprising a conductive substrate, and formed superposingly thereon a photosensitive layer and a surface protective layer in order; said surface protective layer comprising non-single-crystal carbon containing from 35 atom % to 55 atom % of atoms selected from the group consisting of hydrogen atoms and halogen atoms, and having a surface roughness Ra of from 15 nm to 100 nm, wherein an interfacial composition of the photosensitive layer and the surface protective layer satisfies the following expression:

$$0 \leqq (Max-Min)/(Max+Mm) \leqq 0.4$$

(where Mm and Max represent the minimum value and maximum value, respectively, of reflectance (%) of light having a wavelength in the range of from 450 nm to 650 nm); and said photosensitive layer comprising a non-single-crystal material composed chiefly of silicon atoms and containing atoms selected from the group consisting of hydrogen atoms and halogen atoms; and said toner containing at least a binder resin, a charge control agent and a wax, and having a weight-average particle diameter of from 3 $\mu$m to 11 $\mu$m;

said binder resin having a glass transition temperature of from 40° C. to 80° C., and said wax having a main peak in the region of molecular weight of from 400 to 10,000 and having at least one endothermic peak in the region of from 60° C. to 150° C. at the time of heating in differential thermal analysis.

11. The image-forming method according to claim 10, wherein said surface protective layer has a surface roughness Ra of from 20 nm to 80 nm.

12. The image-forming method according to claim 10; wherein said toner has a weight-average particle diameter of from 5 $\mu$m to 10 $\mu$m.

13. The image-forming method according to claim 10, wherein said binder resin has a glass transition temperature of from 50° C. to 70° C.

14. The image-forming method according to claim 10, wherein said wax has at least one endothermic peak in the region of from 75° C. to 140° C. at the time of heating in differential thermal analysis.

15. The image-forming method according to claim 10, wherein said wax has a main peak in the region of molecular weight of from 700 to 5,000.

16. The image-forming method according to claim 10, wherein said surface protective layer contains from 40 atom % to 50 atoms of hydrogen atoms and contains from 5 atom % to 15 atoms of halogen atoms.

17. The image-forming method according to claim 10, wherein said surface protective layer contains from 45 atom % to 50 atom % of hydrogen atoms and contains from 5 atom % to 10 atom % of halogen atoms.

18. The image-forming method according to claim 10, wherein said light-receiving member is a photosensitive drum having a diameter of 100 mm or smaller.

19. The image-forming method according to claim 10, wherein said light-receiving member is a photosensitive drum having a diameter of 75 mm or smaller.

20. The image-forming method according to claim 10, wherein said photosensitive layer is separated into a charge generation layer and a charge transport layer.

21. An image-forming apparatus comprising;

a light-receiving member for holding thereon an electrostatic latent image;

a charging means for applying a voltage to a charging member to charge the light-receiving member;

an electrostatic-latent-image-forming means for forming the electrostatic latent image on the light-receiving member thus charged;

a developing means for forming a developed image on the light-receiving member by causing an electrostatic-latent-image-developing toner carried on a toner-carrying member, to move to the electrostatic latent image formed on the light-receiving member;

a transfer means for electrostatically transferring the developed image formed on the light-receiving member, to a transfer material via, or not via, an intermediate member; and a fixing means for fixing to the transfer material the developed image held thereon;

said light-receiving member being a light-receiving member comprising a conductive substrate, formed superposingly thereon a photosensitive layer and a surface protective layer in order, and wherein an interfacial composition of the photosensitive layer and the surface protective layer satisfies the following expression:

$$0 \leqq (Max-Min)/(Max+Mm) \leqq 0.4$$

(where Mm and Max represent the minimum value and maximum value respectively, of reflectance (%) of light having a wavelength in the range of from 450 nm to 650 nm);

said surface protective layer comprising non-single-crystal carbon containing from 35 atom % to 55 atom % of atoms selected from the group consisting of hydrogen atoms and halogen atoms, and having a surface roughness Ra of from 15 nm to 100 nm; and said photosensitive layer comprising a non-single-crystal material composed chiefly of silicon atoms and containing atoms selected from the group consisting of hydrogen atoms and halogen atoms; and said toner containing at least a binder resin, a charge control agent and a wax, and having a weight-average particle diameter of from 3 μm to 11 μm;

said binder resin having a glass transition temperature of from 40° C. to 80° C., and said wax having a main peak in the region of molecular weight of from 400 to 10,000 and having at least one endothermic peak in the region of from 60° C. to 150° C. at the time of heating in differential thermal analysis.

22. The image-forming apparatus according to claim 21, wherein said surface protective layer has a surface roughness Ra of from 20 nm to 80 nm.

23. The image-forming apparatus according to claim 21, wherein said toner has a weight-average particle diameter of from 5 μm to 10 μm.

24. The image-forming apparatus according to claim 21, wherein said binder resin has a glass transition temperature of from 50° C. to 70° C.

25. The image-forming apparatus according to claim 21, wherein said wax has at least one endothermic peak in the region of from 75° C. to 140° C. at the time of heating in differential thermal analysis.

26. The image-forming apparatus according to claim 21, wherein said wax has a main peak in the region of molecular weight of from 700 to 5,000.

27. The image-forming apparatus according to claim 21, wherein said surface protective layer contains from 40 atom % to 50 atom % of hydrogen atoms and contains from 5 atom % to 15 atom % of halogen atoms.

28. The image-forming apparatus according to claim 21, wherein said surface protective layer contains from 45 atom % to 50 atom % of hydrogen atoms and contains from 5 atom % to 10 atom % of halogen atoms.

29. The image-forming apparatus according to claim 21, wherein said light-receiving member is a photosensitive drum having a diameter of 100 mm or smaller.

30. The image-forming apparatus according to claim 21, wherein said light-receiving member is a photosensitive drum having a diameter of 75 mm or smaller.

31. The image-forming apparatus according to claim 21, wherein said photosensitive layer is separated into a charge generation layer and a charge transport layer.

* * * * *

UNITED STATES PATENT AND TRADEMARK OFFICE

CERTIFICATE OF CORRECTION

PATENT NO. : 6,586,149 B2
DATED : September 9, 2003
INVENTOR(S) : Kunimasa Kawamura et al.

It is certified that error appears in the above-identified patent and that said Letters Patent is hereby corrected as shown below:

Column 1,
Line 21, “an” should read -- a --; and
Line 50, “contrived are” should read -- these are contrived --.

Column 2,
Line 52, “109” should read -- 109. --.

Column 4,
Line 12, “much” should read -- much of --.

Column 8,
Lines 7 and 50, “comprising;” should read -- comprising: --.

Column 11,
Line 29, “has” should read -- have --, and “is” should read -- are --; and
Line 57, “can not” should read -- cannot --.

Column 12,
Line 29, “roughing” should read -- roughening --.

Column 13,
Line 36, “phenomenon” should read -- phenomenon of --; and
Line 43, “Regard to the Adhesion Wetting,” should read -- regard to the adhesion wetting, --.

Column 16,
Lines 63 and 65, “atoms” should read -- of atoms --.

Column 19,
Line 12, “form” should read -- from --.

Column 20,
Line 66, “full” should read -- fully --.

UNITED STATES PATENT AND TRADEMARK OFFICE

CERTIFICATE OF CORRECTION

PATENT NO. : 6,586,149 B2
DATED : September 9, 2003
INVENTOR(S) : Kunimasa Kawamura et al.

It is certified that error appears in the above-identified patent and that said Letters Patent is hereby corrected as shown below:

Column 22,
Line 34, “glow surrounded” should read -- glow discharge to take place in the discharge space 9130. Thus, in the discharge space 9130 surrounded --; and
Line 59, “full” should be -- fully --.

Column 23,
Line 7, “though” should read -- through --; and
Line 10, “is,” should read -- are, --.

Column 27,
Line 12, “may” should read -- may be --.

Column 30,
Lines 20 and 23, “represent” should read -- represents --.

Column 31,
Line 16, “MI” should read -- M' --.

Column 32,
Line 11, “can not” should read -- cannot --.

Column 34,
Line 66, “roxidation” should read -- oxidation --.

Column 38,
Line 11, “G7000OH($H_{XL}$)” should read -- G7000H($H_{XL}$) --.

Column 40,
Lines 1 and 36, “that;” should read -- that: --.

Column 41,
Lines 13 and 49, “that;” should read -- that: --.

UNITED STATES PATENT AND TRADEMARK OFFICE

CERTIFICATE OF CORRECTION

PATENT NO. : 6,586,149 B2
DATED : September 9, 2003
INVENTOR(S) : Kunimasa Kawamura et al.

It is certified that error appears in the above-identified patent and that said Letters Patent is hereby corrected as shown below:

Column 42,
Line 21, "10μmx10μm;" should read -- 10μmx10μm, --; and
Line 34, "that;" should read -- that: --.

Column 50,
Line 48, "Formula (10)" should read -- Formula (10) - - - - - - - - - - - - - - - 2 parts. --.

Column 63,
Line 42, "fanned" should read -- formed --; and
Line 67, "and said" should read -- and ¶ said --.

Column 64,
Line 16, "10;" should read -- 10, --;
Lines 31 and 32, "atoms" should read -- atom % --; and
Line 46, "comprising;" should read -- comprising: --.

Signed and Sealed this

Thirtieth Day of March, 2004

JON W. DUDAS
*Acting Director of the United States Patent and Trademark Office*